US007125657B2

(12) United States Patent
Watanabe et al.

(10) Patent No.: US 7,125,657 B2
(45) Date of Patent: Oct. 24, 2006

(54) PHOTOTHERMOGRAPHIC MATERIAL

(75) Inventors: Katsuyuki Watanabe, Kanagawa (JP); Hiroyuki Mifune, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 186 days.

(21) Appl. No.: 10/736,334

(22) Filed: Dec. 16, 2003

(65) Prior Publication Data

US 2004/0126723 A1 Jul. 1, 2004

(30) Foreign Application Priority Data

Dec. 20, 2002 (JP) ..... 2002-370299
Sep. 18, 2003 (JP) ..... 2003-325985

(51) Int. Cl.
*G03C 1/498* (2006.01)
*G03C 1/34* (2006.01)

(52) U.S. Cl. ..... 430/619; 430/600; 430/601; 430/610; 430/611; 430/613; 430/614; 430/615

(58) Field of Classification Search ..... 430/619, 430/610, 611, 600, 601, 613, 614, 615
See application file for complete search history.

(56) References Cited

U.S. PATENT DOCUMENTS 6,120,983 A * 9/2000 Okada et al. ..... 430/619
6,593,075 B1 * 7/2003 Ichikawa et al. ..... 430/603
2003/0232288 A1 * 12/2003 Oka et al. ..... 430/350
2004/0033454 A1 * 2/2004 Ohzeki et al. ..... 430/619

FOREIGN PATENT DOCUMENTS

EP 1096310 * 5/2001

* cited by examiner

*Primary Examiner*—Thorl Chea
(74) *Attorney, Agent, or Firm*—Margaret A. Burke; Sheldon J. Moss

(57) ABSTRACT

The present invention provides a photothermographic material including a support having disposed thereon an image-forming layer that contains at least a non-photosensitive organic silver salt, a photosensitive silver halide, a reducing agent and a binder, and further including a compound represented by the following formula (I):

A-(W)n-P (I)

wherein A represents an atomic group having at least two mercapto groups as the substituent; W represents a divalent linking group; n represents 0 or 1; and P represents a pyrazolidone group.

17 Claims, No Drawings

PHOTOTHERMOGRAPHIC MATERIAL

CROSS-REFERENCE TO RELATED APPLICATION

This application claims priority under 35 USC 119 from Japanese Patent Application Nos. 2002-370299 and 2003-325985, the disclosures of which are incorporated by reference herein.

BACKGROUND OF THE INVENTION

1. Field of the Invention

The present invention relates to a photothermographic material, and particularly, to a photothermographic material containing a novel chemical sensitizer. Further, the present invention relates to a photothermographic material that is produced using a silver halide emulsion having a high silver iodide content, and exhibits considerably improved sensitivity, has low Dmin and high Dmax, and excellent storability before being subjected to a developing treatment, and further has excellent image storability after being subjected to the developing treatment.

2. Description of the Related Art

In recent years, photographic development processing conducted in a dry state is strongly desired in the fields of medical and printing plate making from the standpoints of environmental protection and space saving. In these fields, digitalization is progressing, and accordingly a system in which image information is taken in a computer, stored, optionally processed, transmitted, outputted to a photosensitive material by a laser image setter or a laser imager, and developed to form an image is rapidly spreading.

As for the photosensitive materials, capability of recording by laser exposure of high illuminance and forming a clear black image having high resolution and sharpness is required. As for digital imaging recording materials, various types of hard copy systems utilizing a pigment or a dye, such as an ink-jet printer and an electronic photographic system, are distributed as an ordinary image-forming system. However, none of the hard copy systems are satisfactory with regard to image quality (sharpness, graininess, gradation, and color tone) used in the medical field for diagnosis and recording speed (sensitivity) for the purpose of replacing conventional wet-development-type silver salt film for medical use.

On the other hand, thermally developable image-forming systems utilizing an organic silver salt are described in, for example, U.S. Pat. Nos. 3,152,904 and 3,457,075 and D. H. Klosterboer, "Thermally Processed Silver Systems" (see Imaging Processes and Materials, Neblette, 8th Ed. compiled by J. Sturge, V. Walworth and A. Shepp, Chap. 9, page 279, 1989). In particular, the photothermographic material comprises a photosensitive layer in which a photosensitive silver halide, a reducing agent, a reducible silver salt (e.g., organic silver salt), and optionally, a toning agent for controlling silver color tone are ordinarily dispersed in a binder matrix.

When the photothermographic material is heated at a high temperature (e.g., 80° C. or higher) after being imagewise exposed, a monochromatic black silver image is produced by a redox reaction between the silver halide or the reducible silver salt (functioning as an oxidizing agent) and the reducing agent. The redox reaction is accelerated by a catalytic action of a latent image of the silver halide formed by such exposure. As a result, the monochromatic silver images are formed at exposed areas of the material. Such photothermographic materials are disclosed not only in U.S. Pat. No. 2,910,377 and Japanese Patent Application Publication (JP-B) No. 43-4924, but also in many references other than those described above. Thus, Fuji Medical Dry Imager FM-DP L was launched on the market for practical use as an image-forming system for medical use utilizing the photothermographic material.

Since such an image forming system utilizing the organic silver salt includes no fixing step, it has a problem in image storability after being subjected to a developing treatment, particularly a problem of deteriorated print-out upon light exposure. As a method for improving such a printout problem, a method which utilizes silver iodide obtained by converting an organic silver salt is disclosed (see, e.g., U.S. Pat. No. 6,143,488 and EP-A 0922995). However, each method of converting the organic silver salt by iodine as disclosed in these patents was incapable of obtaining sufficient sensitivity, whereupon it was difficult to construct a practical system. Other sensitive materials utilizing silver iodide which are described in some references cited in the specification of patents (see, e.g., WO97/48014, WO97/48015, U.S. Pat. No. 6,165,705, Japanese Patent Application Laid-Open (JP-A) No. 8-297345, and Japanese Patent No. 2785129) have not attained sufficient sensitivity and fogging levels, and these materials are not practical to be used as materials sensitive to laser exposure.

As a measure for increasing sensitivity of a silver iodide photographic emulsion, it has been known in literatures that sensitization is performed by utilizing halogen receptors such as sodium nitrite, pyrogallol and hydroquinone, immersion in a silver nitrate aqueous solution, or sulfur sensitization at pAg 7.5 (see, e.g., P. B. Gilman, Photographic Science and Engineering, Vol. 18(5), page 475 (1974), W. L. Gardner, ibid. Vol. 18(5), page 475 (1974), or T. H. James, ibid. Vol. 5, page 216 (1961)). However, a sensitizing effect exerted by these halogen receptors in photothermographic materials is known to be very small and thus unsatisfactory. Accordingly, development of a technique which is capable of substantially enhancing sensitivity of the photothermographic material having a high silver iodide content has been desired.

On the other hand, a technique has been disclosed in which, by using a compound having an adsorptive group to a silver halide and a reducing group or a precursor thereof, sensitivity of a silver iodide emulsion having a low silver iodide content can be enhanced for use in a color negative emulsion or an X-ray emulsion usable for a liquid developing treatment (see, e.g., JP-A No. 8-272024).

However, in a case of a silver halide photosensitive material used in a liquid developing treatment, a silver image is ordinarily formed by reducing silver halide by means of a developing agent (reducing agent) contained in the developing liquid, or a color image is formed by making use of an oxidized form of the developing agent to be generated as a by-product of a fundamental reaction to reduce the silver halide by the developing agent. On the other hand, in a case of the photothermographic material, the silver halide only acts to form a latent image by light exposure and the silver halide itself is not reduced by the reducing agent. Namely, it is a silver ion supplied from a reduced non-photosensitive organic silver salt. Reducing agents in the case of the photosensitive material used in the liquid developing treatment are ionic reducing agents such as hydroquinones, 3-pyrazolidones and p-phenylene diamines, while reducing agents in the case of the photothermographic material are hindered phenol derivatives which are ordinarily known as radical reacting agents.

As described above, in the photosensitive material for the liquid developing treatment and the photothermographic material, mechanisms of developing reactions (reduction reaction) are completely different from each other in the above-described cases, and hence compound systems to be used in these cases are completely different from each other. Therefore, compounds which are effective in the liquid developing treatment are not always effective as they are when applied to the photothermographic material. Applying compounds described in the foregoing JP-A No. 8-272024 to the photothermographic material has not yet been conceived, let alone applying those compounds in the photothermographic material that has a high silver iodide emulsion. Thus, it was impossible to estimate an effect thereof.

SUMMARY OF THE INVENTION

An object of the present invention is to provide an improved photothermographic material, and particularly, to provide a photothermographic material having a high silver iodide content that exhibits high light-fastness, high sensitivity, low Dmin and high Dmax.

The present invention is a photothermographic material which comprises a support having disposed thereon an image-forming layer that contains at least a non-photosensitive organic silver salt, a photosensitive silver halide, a reducing agent and a binder, and further comprises a compound represented by the following formula (I):

A-(W)n-P (I)

wherein A represents an atomic group having at least two mercapto groups as the substituent; W represents a divalent linking group; n represents 0 or 1; and P represents a pyrazolidone group.

Preferably, the pyrazolidone group is a group obtained by removing a hydrogen atom from a compound represented by the following formula (P-2):

Formula (P-2)

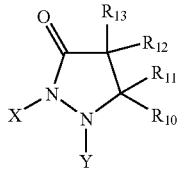

wherein Y represents a hydrogen atom, an alkyl group, an aryl group or a heterocyclic group; X represents a hydrogen atom, an alkyl group, an acyl group, a carbamoyl group, an alkoxycarbonyl group, an alkylsulfonyl group or an arylsulfonyl group; $R_{10}$, $R_{11}$, $R_{12}$ and $R_{13}$ each represent a hydrogen atom or a substituent; and wherein at least one of Y, X, $R_{10}$, $R_{11}$, $R_{12}$ and $R_{13}$ is a hydrogen atom.

DETAILED DESCRIPTION OF THE INVENTION

Hereinafter, the present invention will be described in detail.

1. Photothermographic Material

A photothermographic material according to the present invention comprises a support having disposed thereon an image-forming layer that contains at least a non-photosensitive organic silver salt, a photosensitive silver halide, a reducing agent, a compound represented by the above formula (I) and a binder. Further, the photothermographic material according to the invention may preferably comprise a surface protective layer on the image-forming layer, or a back layer or a back protective layer on an opposite surface of the support.

A construction of these layers and preferable components for forming the layers will be described in detail below.

1-1. Image-Forming Layer

1-1-1. Compound Represented by Formula (I) According to the Invention

In the photothermographic material according to the invention, the compound represented by the following formula (I) is used:

A-(W)n-P (I)

wherein A represents an atomic group having at least two mercapto groups as the substituent; W represents a divalent linking group; n represents 0 or 1; and P represents a pyrazolidone group.

It is preferable that the atomic group is at least one group selected from the group consisting of an alkyl group, an aryl group, and a heterocyclic group.

The alkyl group is any one of straight-chain, branched-chain, and cyclic alkyl groups which each have preferably from 1 to 30 carbon atoms in total and more preferably from 2 to 20 carbon atoms in total whereupon examples of such alkyl groups include a butyl group, a hexyl group, and a benzyl group.

The aryl group is an aryl group which has preferably from 6 to 30 carbon atoms in total and more preferably from 6 to 20 carbon atoms in total whereupon examples of such aryl groups include a phenyl group and a naphthyl group.

The heterocyclic group is an aromatic or non-aromatic heterocyclic group which is of a monocycle or a condensed ring having from 5 to 7 members whereupon examples of such heterocyclic groups include a pyrimidine ring group, a triazine ring group, an imidazole ring group, a triazole ring group, a purine ring group, a pyridine ring group, a quinoline ring group, and an isoquinoline ring group. Further, they may include a heterocyclic group having a quaternized nitrogen atom; on this occasion, a substituted mercapto group may be dissociated to be a mesoion.

In formula (I), A has at least two mercapto groups, preferably two or three mercapto groups, and most preferably two mercapto groups.

The mercapto group may be of a salt. When the mercapto group forms a salt, examples of counter-ions include a cation ($Li^+$, $Na^+$, $K^+$, $Mg^{2+}$, $Ag^+$, $Zn^{2+}$ or the like) of an alkaline metal, an alkaline earth metal, or a heavy metal, an ammonium ion, a heterocyclic group having a quaternized nitrogen atom, and a phosphonium ion.

When the mercapto group can be tautomerized (e.g., in case where the mercapto group is substituted in an aromatic heterocyclic group), the mercapto group may be in thione group form whereupon specific examples of such thione groups include thioamide, thioureido, and thiourethane.

The group represented by A may further have substituents other than the mercapto group. Examples of the substituents include a halogen atom (e.g., a fluorine atom, a chlorine atom, a bromine atom, or an iodine atom), an alkyl group (e.g., a linear, branched, or cyclic alkyl group which contains a bicycloalkyl group or an active methine group), an alkenyl group, an alkynyl group, an aryl group, a heterocyclic group (a position to be substituted is not limited), an acyl group, an alkoxycarbonyl group, an aryloxycarbonyl group, a heterocyclic oxycarbonyl group, a carbamoyl group, an N-hydroxycarbamoyl group, an N-acylcarbamoyl group, an N-sufonylcarbamoyl group, an N-carbamoylcarbamoyl group, a thiocarbamoyl group, an N-sulfamoylcarbamoyl group, a carbazoyl group, a carboxyl group or a salt thereof, an oxalyl group, an oxamoyl group, a cyano group, a carbonimidoyl group, a formyl group, a hydroxyl group, an alkoxy group (containing a group having a unit of an ethyleneoxy group or a propyleneoxy group in a repeating manner), an aryloxy group, a heterocycloxy group, an acyloxy group, an (alkoxy or aryloxy) carbonyloxy group, a carbamoyloxy group, a sufonyloxy group, an amino group, (an alkyl, aryl, or a heterocycle) amino group, an acylamino group, a sulfonamide group, a ureido group, a thioureido group, an N-hydroxyureido group, an imido group, an (alkoxy or aryloxy) carbonylamino group, a sufamoylamino group, a semicarbazide group, a thiosemicarbazide group, a hydrazino group, an ammonio group, an oxamoylamino group, an N-(alkyl or aryl)sufonylureido group, an N-acylureido group, an N-acylsulfamoylamino group, a hydroxyamino group, a nitro group, a heterocyclic group containing a quaternized nitrogen atom (for example, a pyridinio group, an imidazolio group, a quinolinio group, or an isoquinolinio group), an isocyano group, an imino group, (an alkyl, aryl, or a heterocyclic)thio group, (an alkyl, aryl, or a heterocyclic)dithio group, an (alkyl or aryl)sulfonyl group, an (alkyl or aryl)sulfinyl group, a sulfo group or a salt thereof, a sulfamoyl group, an N-acylsulfamoyl group, an N-sulfonylsulfamoyl group or a salt thereof, a phosphino group, a phosphinyl group, a phosphinyloxy group, a phosphinylamino group, and a silyl group. Further, the term "salt" as used herein is intended to mean a cationic ion of, for example, an alkaline metal, an alkaline earth metal, or a heavy metal, or an organic cationic ion such as an ammonium ion, and a phosphonium ion.

In formula (I), a group represented by A is preferably a heterocyclic group, and more preferably an aromatic nitrogen-containing heterocyclic group.

Specific examples of such groups represented by A include a 2,4-dimercaptopyrimidine group, a 2,4-dimercaptotriazine group, and a 3,5-dimercapto-1,2,4-triazole group.

In formula (I), W represents a divalent linking group. The linking group may be any linking group insofar as it does not exert any detrimental effect to photographic characteristics. For example, any divalent linking group constituted by at least one member selected from the group consisting of a carbon atom, a hydrogen atom, an oxygen atom, a nitrogen atom, and a sulfur atom may be utilized.

Examples of such linking groups include an alkylene group having from 1 to 20 carbon atoms (e.g., a methylene group, an ethylene group, a trimethylene group, a tetramethylene group, or a hexamethylene group), an arylene group having from 6 to 20 carbon atoms (e.g., a phenylene group, or a naphthylene group), a —CO— group, an —$SO_2$— group, an —O— group, an —S— group, an —$NR_1$— group and combinations thereof. In this case, $R_1$ represents at least one member selected from the group consisting of a hydrogen atom, an aliphatic group, and an aryl group.

As for such aliphatic groups represented by $R_1$, mentioned are an alkyl group, an alkenyl group, an alkynyl group, and an aralkyl group each, in linear, branched, or cyclic form, having preferably from 1 to 30 carbon atoms and particularly preferably from 1 to 20 carbon atoms (e.g., a methyl group, an ethyl group, an isopropyl group, a t-butyl group, an n-octyl group, an n-decyl group, an n-hexadecyl group, a cyclopropyl group, a cyclopentyl group, a cyclohexyl group, an allyl group, a 2-butenyl group, a 3-pentenyl group, a propargyl group, a 3-pentinyl group and a benzyl group).

As for such aryl groups represented by $R_1$, mentioned is an aryl group of a monocycle or a condensed cycle having preferably from 6 to 30 carbon atoms and more preferably from 6 to 20 carbon atoms whereupon examples of such aryl groups include a phenyl group, and a naphthyl group.

Any one of the above-described substituents represented by $R_1$ may further have any other substituent.

In formula (I), P represents a pyrazolidone group. The term "pyrazolidone group" as used herein refers to a group obtained by removing a hydrogen atom from a compound represented by the following formula (P-2):

Formula (P-2)

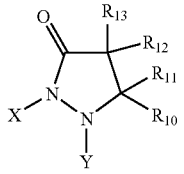

wherein Y represents a hydrogen atom, an alkyl group, an aryl group or a heterocyclic group; X represents a hydrogen atom, an alkyl group, an acyl group, a carbamoyl group, an alkoxylcarbonyl group, an alkylsulfonyl group or an arylsulfonyl group; $R_{10}$, $R_{11}$, $R_{12}$ and $R_{13}$ each represent a hydrogen atom or a substituent, and wherein at least one of Y, X, $R_{10}$, $R_{11}$, $R_{12}$ and $R_{13}$ is a hydrogen atom.

The alkyl group represented by Y is a straight-chain, branched chain or cyclic alkyl group having preferably from 1 to 30 carbon atoms in total and more preferably from 2 to 20 carbon atoms in total whereupon examples of such alkyl groups include a butyl group, a hexyl group and a benzyl group.

The aryl group represented by Y is an aryl group having preferably from 6 to 30 carbon atoms in total and more preferably from 6 to 20 carbon atoms in total whereupon examples of such aryl groups include a phenyl group and a naphthyl group.

The heterocyclic group represented by Y is an aromatic or non-aromatic heterocyclic group which is of a monocycle or a condensed ring having from 5 to 7 members whereupon examples of such heterocyclic groups include a pyridine ring group, a pyrimidine ring group, a triazine ring group, a thiazole ring group, a benzothiazole ring group, an oxazole ring group, a benzoxazole ring group, an imidazole ring group, a benzimidazole ring group, a pyrazole ring group, an indazole ring group, an indole ring group, a purine ring group, a quinoline ring group, an isoquinoline ring group, and a quinazoline ring group.

The group represented by Y may further be substituted by another substituent.

Y is preferably an alkyl group or an aryl group, and more preferably an aryl group.

X represents at least one atom or group selected from the group consisting of a hydrogen atom, an acyl group (e.g., an acetyl group, a chloroacetyl group, or a trifluoroacetyl group), an alkylsulfonyl group (e.g., a methane sulfonyl group, or an ethane sulfonyl group), an arylsulfonyl group (e.g., a benzene sulfonyl group, a p-toluene sulfonyl group, or a p-chlorophenyl sulfonyl group), a carbamoyl group (e.g., an N-phenyl carbamoyl group, or an N-methyl carbamoyl group), an alkoxycarbonyl group (e.g., a methoxycarbonyl group, or an ethoxycarbonyl group), an alkyl group (e.g., a 2-cyanoethyl group, or a 2-phenylethyl group) whereupon a hydrogen atom or an acyl group is preferable and an acyl group is more preferable.

$R_{10}$, $R_{11}$, $R_{12}$, and $R_{13}$ each independently represent a hydrogen atom, or a substituent whereupon the substituent is the same as that of A in the foregoing formula (I).

$R_{10}$, $R_{11}$, $R_{12}$, and $R_{13}$ are each preferably a hydrogen atom, an alkyl group or an aryl group.

As for alkyl groups, a lower alkyl group having from 1 to 8 carbon atoms is preferable whereupon the lower alkyl group may be substituted by a hydroxyl group or the like. Among other things, a methyl group or a hydroxymethyl group is particularly preferable.

As for aryl groups, a phenyl group is preferable whereupon the phenyl group may have at least one substituent selected from the group consisting of a halogen atom (e.g., fluorine, chlorine, bromine, or iodine), an alkoxy group, an cyano group and the like. On this occasion, a non-substituted phenyl group is particularly preferable.

Preferable examples of compounds represented by formula (P-2) include 1-phenyl-3-pyrazolidone, 4,4-dimethyl-1-phenyl-3-pyrazolidone, 4-hydroxymethyl-4-methyl-1-phenyl-3-pyrazolidone, and 1,5-diphenyl-3-pyrazolidone.

The compound represented by formula (I) according to the invention may also be a compound in which a ballast group or a polymer chain that is ordinarily used in an immobile photographic additive such as a coupler has been incorporated. Further, as for polymers, mentioned is a polymer as described in JP-A No. 1-100530.

The compound represented by formula (I) according to the invention may also be a compound in bis or tris form.

A molecular weight of the compound represented by formula (I) according to the invention is preferably in the range of from 100 to 10,000, more preferably in the range of from 120 to 1,000 and particularly preferably in the range of from 150 to 500.

Examples of such compounds represented by formula (I) according to the invention are mentioned below; however, the invention is not limited thereto.

(1)

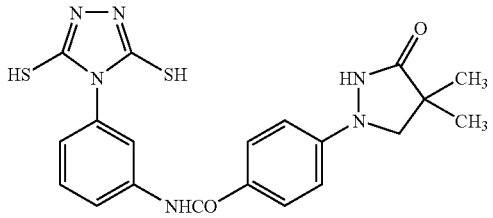

(2)

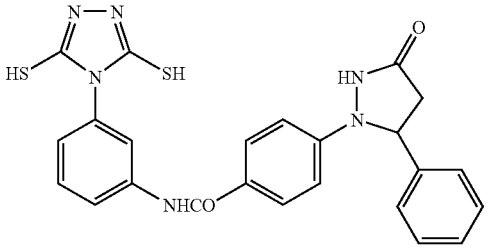

(3)

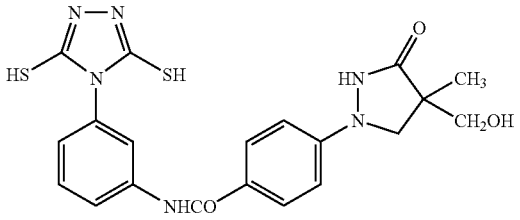

(4)

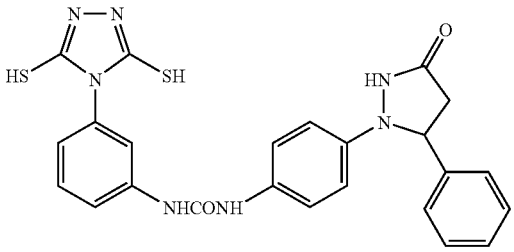

(5)

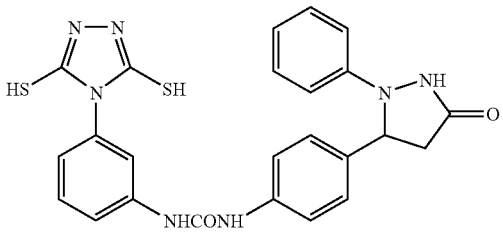

(6)

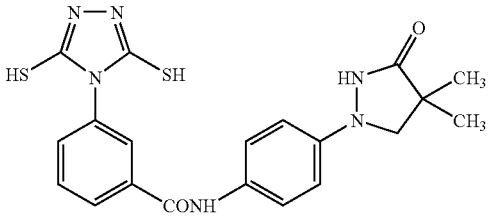

(7)

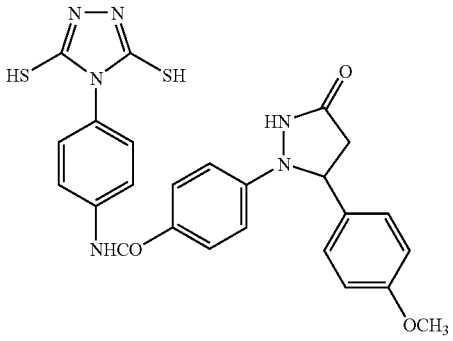

(8)

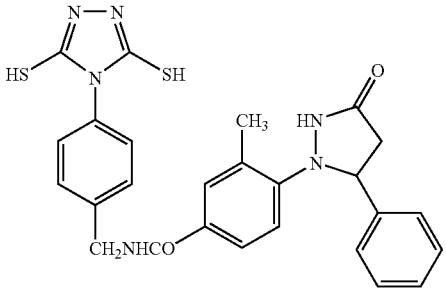

-continued
(9)
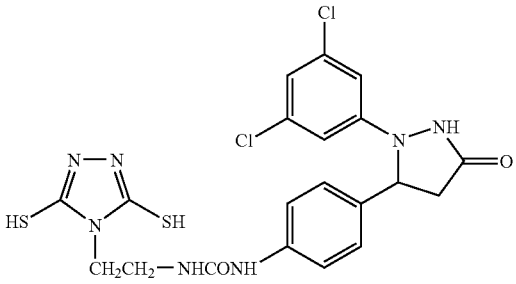
(10)
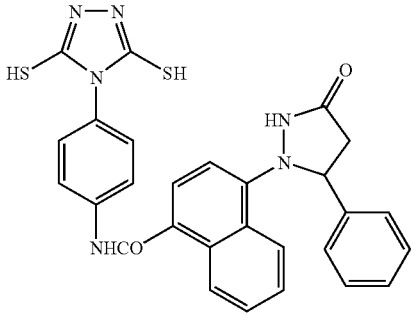
(11)
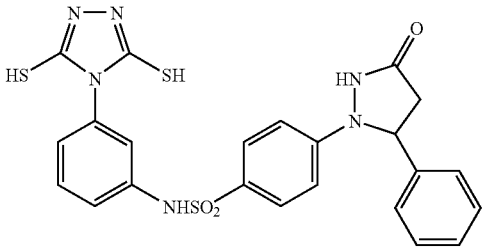
(12)
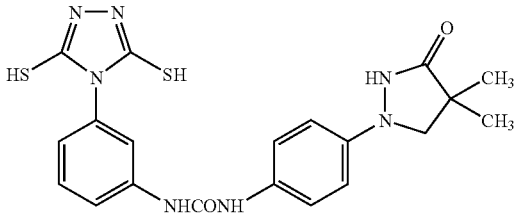
(13)
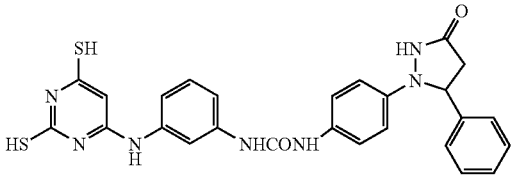
(14)
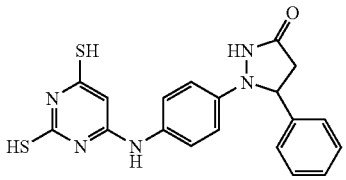
(15)
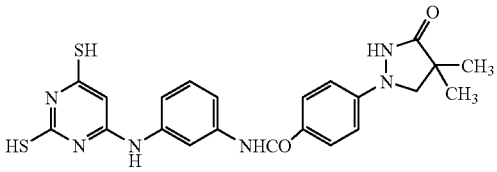
(16)
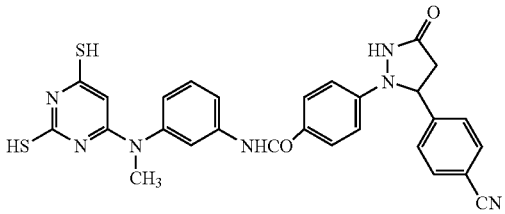
(17)
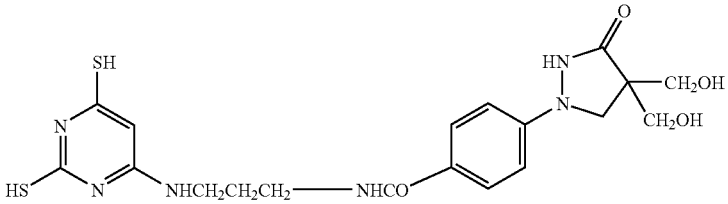
(18)
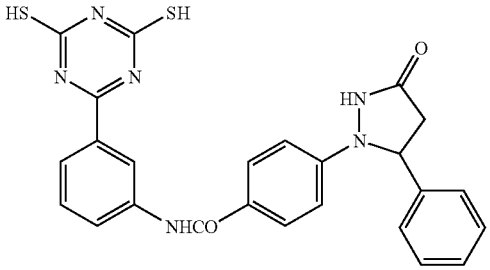
(19)
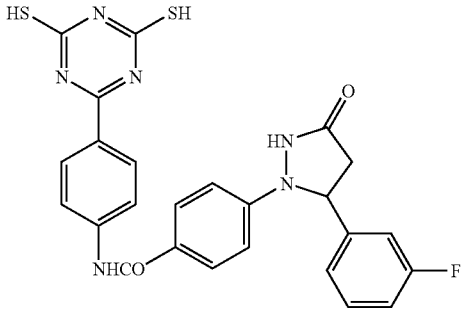

-continued
(20)
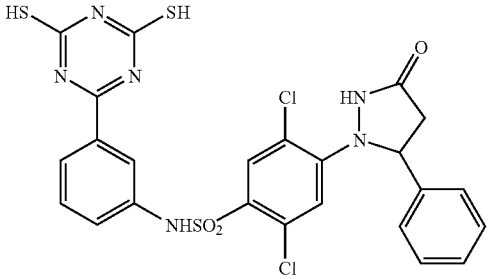
(21)
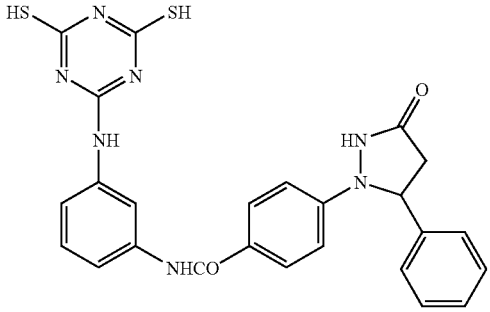
(22)
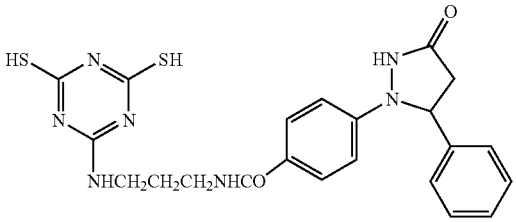
(23)
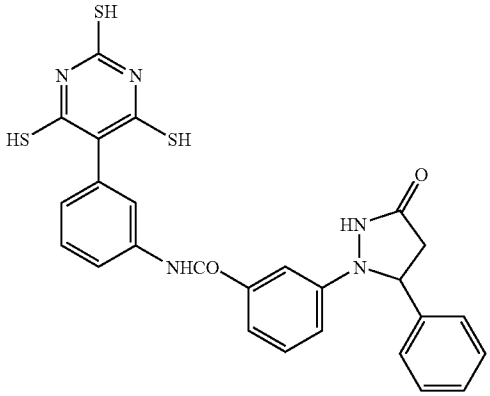
(24)
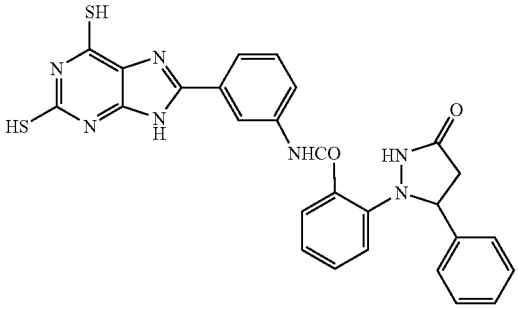
(25)
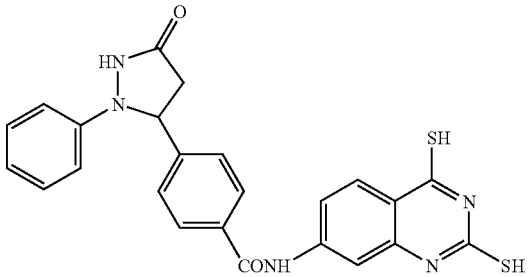
(26)
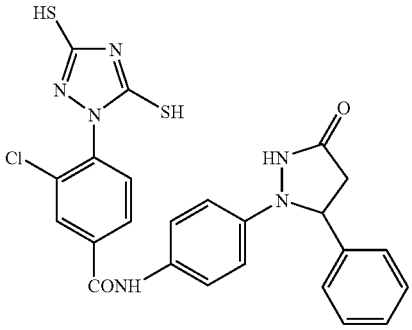
(27)
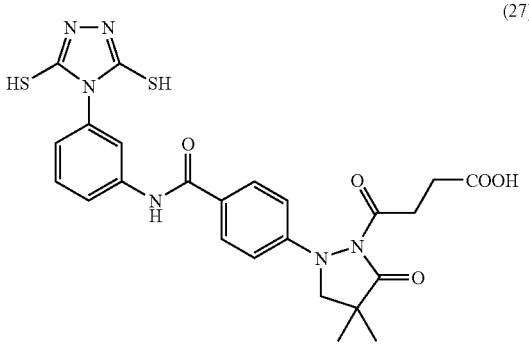

-continued
(28)
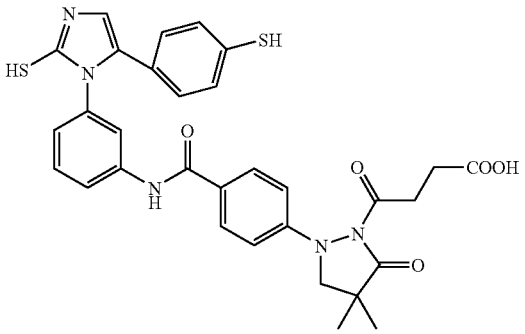
(29)
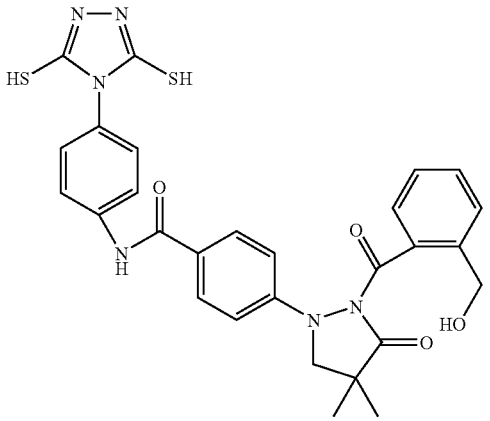
(30)
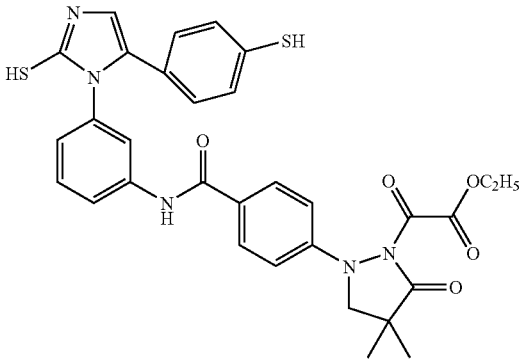
(31)
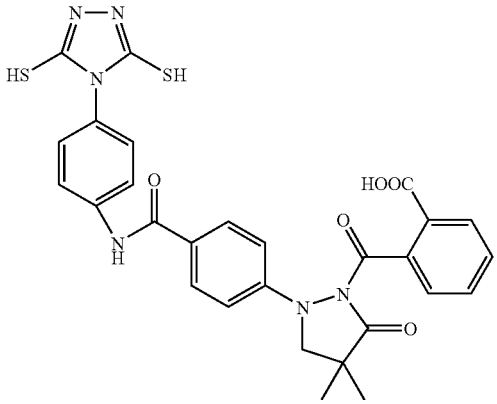
(32)
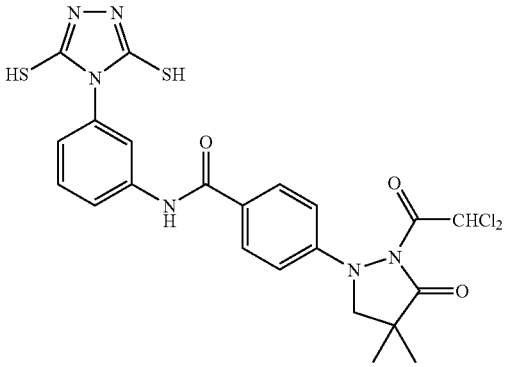
(33)
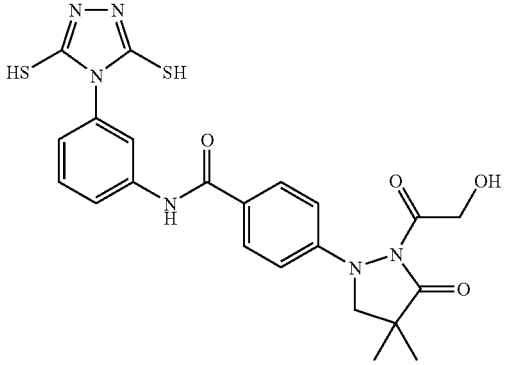
(34)
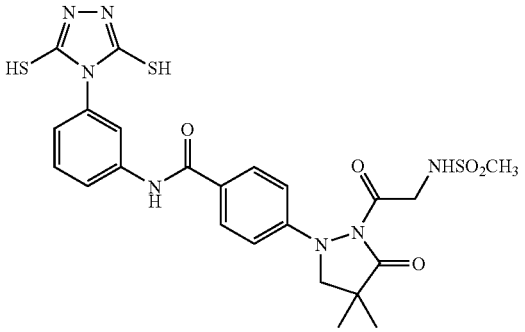
(35)
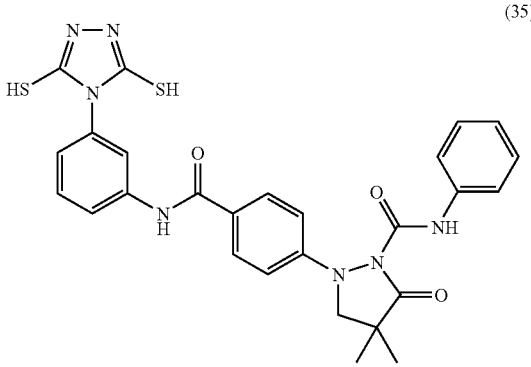

-continued

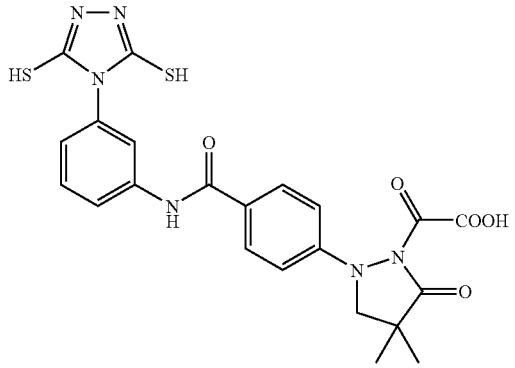

(36)

The compound for use in the photothermographic material according to the invention may readily be synthesized in accordance with conventionally known methods. A method for synthesizing an illustrative compound (1) according to the invention is described below as a specific example.

A synthesis scheme and a synthesis formulation will be described below.

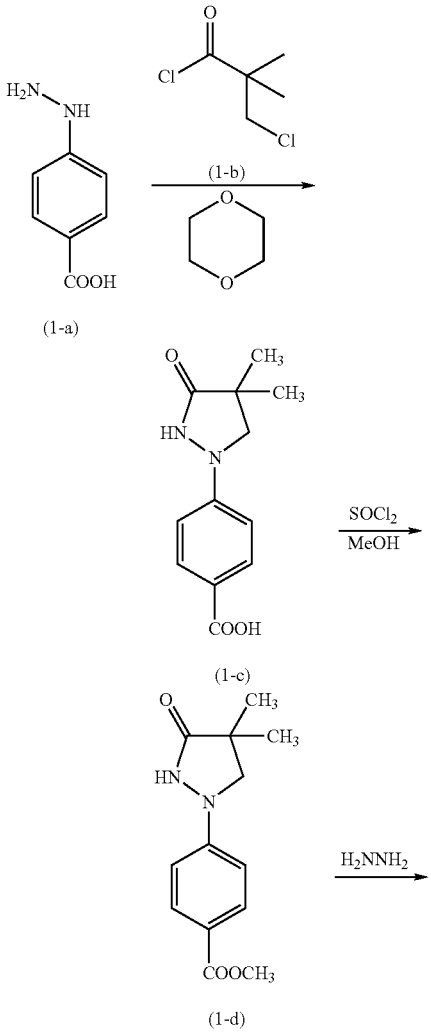

-continued

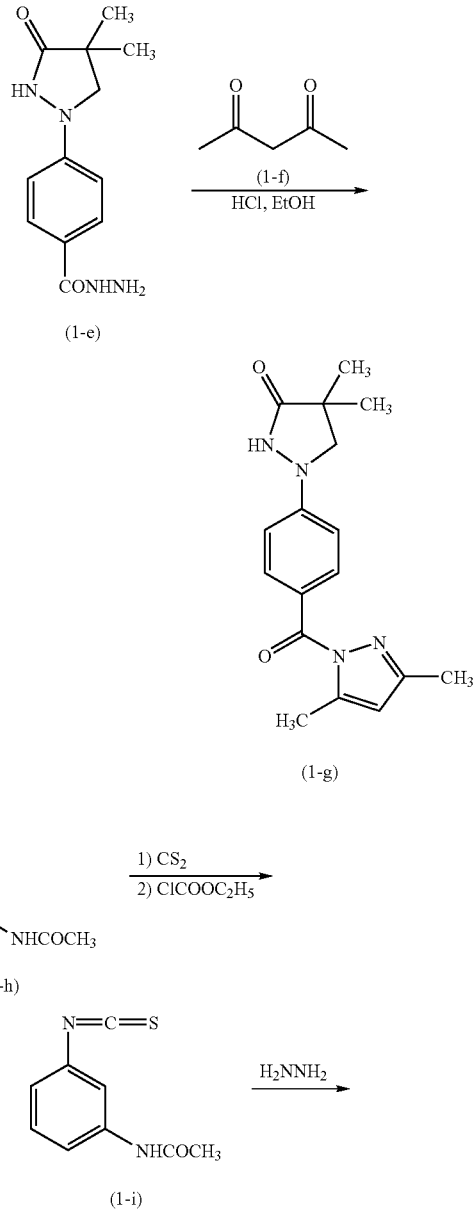

-continued

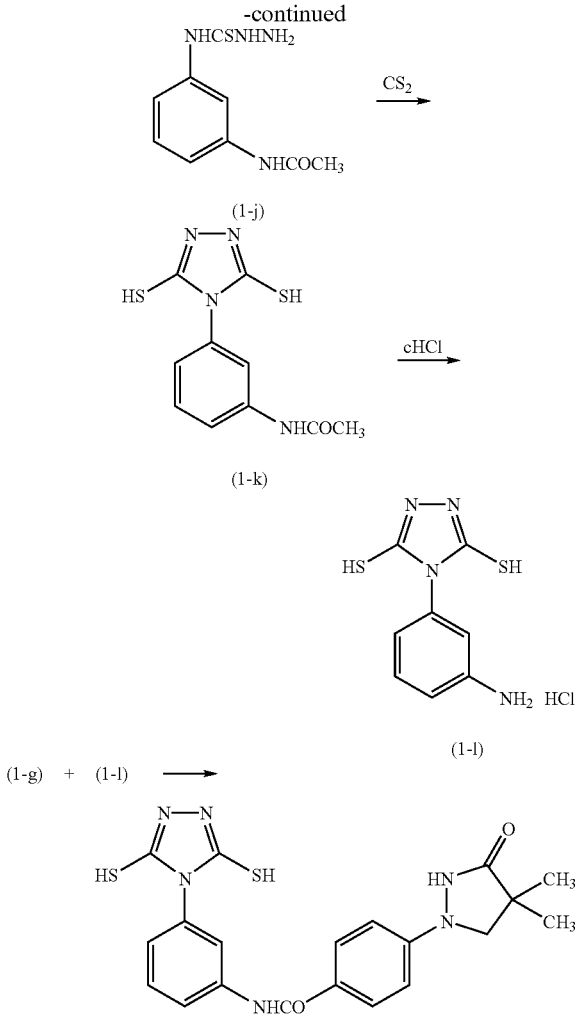

(Illustrative Compound 1)

(Synthesis of Intermediate Form 1-c)

20.7 ml of a form (1-b) was added dropwise to a mixed solution containing 20.5 g of a hydrazine form (1-a), 26 ml of pyridine, and 270 ml of dioxane at room temperature and, then, heated for 4 hours under reflux. The resultant mixture was left to stand as it is for one day at room temperature, added with 130 ml of water and, then, stirred vigorously to precipitate a crystal. The thus-precipitated crystal was removed by filtration. A yield thereof was 22 g.

(Synthesis of Intermediate Form 1-d)

18.7 g of the form (1-b) was suspended in 40 ml of methanol. 14 ml of thionyl chloride was added dropwise in a small quantity at a time to the resultant suspension while being cooled on ice. The resultant mixture was heated for 7 hours under reflux and, then, added to ice water to precipitate a crystal. The thus-precipitated crystal was removed by filtration and rinsed with cold methanol. A yield thereof was 16.8 g.

(Synthesis of Intermediate Form 1-e)

A mixed solution containing 16.0 g of the form (1-d) and 25.8 g of hydrazine monohydrate was stirred for 3 hours at 50° C. to allow components to react with each other. The thus-reacted liquid was added to 100 ml of ice water and stirred to precipitate a crystal. The thus-precipitated crystal was removed by filtration and, then, rinsed with water and cold acetonitrile. A yield thereof was 9.9 g.

(Synthesis of Intermediate Form 1-g)

A solution containing 9.0 g of the form (1-e), 5.1 ml of 5N hydrochloric acid, and 50 ml of ethanol was stirred while being cooled by ice and, then, added with 4.5 g of acetyl acetone (1-g) dropwise in a small quantity at a time. The resultant mixture was stirred for one hour as it is to precipitate a crystal. The thus-precipitated crystal was removed by filtration and, then, rinsed with water and cold ethanol. A yield thereof was 9.6 g.

(Synthesis of Intermediate Form 1-i)

A mixed liquid comprising 120 g of a form (1-h) which is commercially available, 320 ml of acetonitrile, and 134 ml of triethylamine was added with 72 ml of carbon disulfide. The resultant mixture was stirred for 3 hours at 45° C., cooled by ice, added with 84 ml of ethyl chloroformate dropwise, stirred for further one hour and, then, added with 320 ml of water while being cooled on ice to precipitate a crystal. The precipitated crystal was removed by filtration and, then, rinsed with a mixed liquid of acetonitrile and water in equivalent weights. A yield thereof was 144 g.

(Synthesis of Intermediate Form 1-j)

A mixed solution containing 113 g of hydrazine monohydrate, 400 ml of isopropanol, and 400 ml of THF was cooled to 10° C. or less and, then, added with 144 g of a THF solution (1900 ml) of the form (1-i) dropwise in a small quantity at a time to precipitate a crystal. After completion of such dropwise addition, the precipitated crystal was removed by filtration. A yield thereof was 137 g.

(Synthesis of Intermediate Form 1-k)

A mixed solution containing 48.3 g of potassium hydroxide, 200 ml of water, and 1000 ml of ethanol was added with 137 g of a form (1-j) and, subsequently, added with 74 ml of carbon disulfide and, then, heated for 6 hours at 70° C. while stirring. The resultant mixture was added with 500 ml of hexane, 2500 ml of water and 75 ml of concentrated hydrochloric acid followed by stirring to precipitate a crystal. The precipitated crude crystal was removed by filtration and rinsed with hexane. A yield thereof was 104 g.

(Synthesis of Intermediate Form 1-l)

A mixed solution containing 104 g of the form (1-k), 700 ml of water, and 1400 ml of concentrated hydrochloric acid was heated for 4 hours under reflux, cooled to room temperature, added with 700 ml of acetonitrile and, then, stirred to precipitate a crystal. The thus-precipitated crystal was removed by filtration. A yield thereof was 99 g.

(Synthesis of Illustrative Compound (1))

A mixed solution containing 1.1 g of the intermediate form (1-l), 6 ml of dimethyl acetamide, and 0.36 ml of pyridine was stirred at 60° C. to allow components to be dissolved thereamong, added with 1.4 g of the intermediate form (1-g) allowing it to be dissolved therein. The resultant mixture was added with 3 ml of acetic acid, stirred for 2.5 hours at a temperature of from 70° C. to 90° C. to gradually precipitate a crystal and, subsequently, added with 25 ml of acetonitrile to precipitate the crystal. The precipitated crystal was removed by filtration and, then, rinsed with cold acetonitrile. A yield thereof was 1.5 g.

A quantity of the compound represented by formula (I) according to the invention to be used varies in accordance with silver halide grains to be used; however, the compound can be used in a quantity of approximately from $10^{-6}$ mol to 1 mol, preferably approximately from $10^{-5}$ mol to $10^{-1}$ mol and more preferably approximately from $10^{-4}$ mol to $10^{-2}$ mol, on the basis of 1 mol of silver halide in each case.

The compound according to the invention is dissolved in water or an appropriate organic solvent, which is miscible with water and does not give a detrimental influence to photographic characteristics, selected from the group consisting of alcohols, glycols, ketones, esters, and amides and, then, can be added in liquid form or as a solid dispersion.

A time point of adding the compound represented by formula (I) according to the invention may be any time in a period of from after formation of a grain of an emulsion having a high silver iodide content to immediately before a coating operation, preferably in the period of from before start of chemical sensitization to immediately before the coating operation, and particularly preferably immediately before the coating operation.

1-1-2. Photosensitive Silver Halide

1) Halogen Composition

It is important that a photosensitive silver halide according to the invention has a composition in which a silver iodide content is as high as 40% by mol to 100% by mol. A remaining content is not particularly limited and that of at least one member selected from the group consisting of silver chloride, silver bromide, and organic silver salts such as silver thiocyanate, and silver phosphate is permissible whereupon, particularly, silver bromide or silver chloride is preferable. By using the silver halide having a composition in which the silver iodide content is high as described above, a preferable photothermographic material in which image storability after being subjected to a developing treatment is enhanced, particularly in a point that an increase of fogging caused by light irradiation is remarkably small may be designed.

Further, the silver iodide content is more preferably in the range of from 80% by mol to 100% by mol and particularly preferably in the range of either from 85% by mol to 100% by mol, or from 90% by mol to 100% by mol from the standpoint of the image storability against light irradiation after the developing treatment.

Regarding the halide distribution in individual grains, the halide may be uniformly distributed throughout the grain, or may stepwise distributed, or may continuously distributed. Silver halide grains having a core/shell structure are preferably used. Preferably, the core/shell structure of the grains has 2 to 5 layers, more preferably 2 to 4 layers. Also a technique to localize silver bromide on the surface of silver chloride or silver chlorobromide grains is preferably employed.

2) Grain Size

As far as the silver halide of high silver iodide according to the invention is concerned, a grain size is particularly important. When a size of the silver halide is unduly large, a quantity of the silver halide to be applied necessary for attaining a required maximum density is increased. The present inventor has found that, when a quantity to be applied of the silver halide, having a composition in which a silver iodide content is high, that is favorably used according to the invention, development thereof is remarkably restrained to decrease sensitivity thereof and also density stability thereof against a development period of time becomes deteriorated; such case is not favorable whereupon a grain size which is larger than a certain magnitude can not obtain a maximum density in a predetermined development period of time. On the other hand, the inventor has found that, when the quantity thereof to be applied is restricted, even silver iodide has sufficient developing properties.

When the silver halide having a high silver iodide content is used as described above, it is necessary for attaining a sufficient maximum optical density that a size of a silver halide grain is substantially small compared with that of conventional silver bromide or silver iodobromide having a low iodide content. A grain size of the silver halide is preferably in the range of from 5 nm to 70 nm, more preferably in the range of from 5 nm to 55 nm and particularly preferably in the range of from 10 nm to 45 nm. The term "grain size" as used herein refers to an average diameter obtained by converting a projected area observed by an electron microscope into a circle having the same area as the projected area.

3) Coating Amount

A coating amount of the silver halide grain to be applied is, based on 1 mol of silver of a non-photosensitive organic silver salt to be described below, in the range of from 0.5% by mol to 15% by mol, preferably in the range of from 0.5% by mol to 12% by mol, more preferably in the range of from 0.5% by mol to 10% by mol, even more preferably in the range of from 1% by mol to 9% by mol, and particularly preferably in the range of from 1% by mol to 7% by mol. A selection of such an amount to be applied is extremely important, in order to suppress such remarkable development restraint by the silver halide, having a composition in which the silver iodide content is high, that has been found by the inventor.

4) Grain-Forming Method

A method for forming a photosensitive silver halide is well known in the art; for example, methods as described in Research Disclosure No. 17029 (June, 1978) and U.S. Pat. No. 3,700,458 may be used and, specifically, a method in which firstly a photosensitive silver halide is prepared by adding a silver-supplying compound and a halogen-supplying compound to gelatin or at least one of other polymer aqueous solutions and, then, the thus-prepared photosensitive silver halide is added with an organic silver salt is used. Further, a method as described in paragraphs [0217] to [0224] of JP-A No. 11-119374, a method as described in JP-A No. 11-352627, or a method as described in Japanese Patent Application No. 2000-42336 is preferably used.

5) Grain Shape

Silver halide grains may have various shapes including, for example, cubic grains, octahedral grains, tetradeca grains, dodeca grains, tabular grains, spherical grains, rod-like grains, and potato-like grains. Cubic silver halide grains are especially preferred for use in the present invention. Also preferred are roundish silver halide grains with their corners rounded. The surface index (Miller index) of the outer surface of the photosensitive silver halide grains for use in the present invention is not specifically limited, but it is preferred that the proportion of {100} plane, which ensures higher spectral sensitization when it has adsorbed a color-sensitizing dye, in the outer surface is large. Preferably, the proportion of {100} plane is at least 50%, more preferably at least 65%, and even more preferably at least 80%. The Miller index expressed by the proportion of {100} plane can be obtained according to the method described in *J. Imaging Sci.,* written by T. Tani, 29, 165 (1985), based on the adsorption dependency of {111} plane and {100} plane for sensitizing dyes.

6) Heavy Metal

According to the invention, the silver halide grain which allows a hexacyano metal complex to be present on an outermost surface thereof is preferable. Examples of such hexacyano metal complexes include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. According to the invention, a hexacyano Fe complex is preferable thereamong.

Although a counter cation of the hexacyano metal complex is not important because the hexacyano metal complex exists in ionic form in an aqueous solution, it is preferable to use an alkali metal ion such as a sodium ion, a potassium ion, a rubidium ion, a cesium ion or a lithium ion; an ammonium ion; or an alkyl ammonium ion (e.g., a tetramethyl ammonium ion, a tetraethyl ammonium ion, a tetrapropyl ammonium ion or a tetra (n-butyl) ammonium ion), which are each individually easily compatible with water and appropriate for a precipitation operation of a silver halide emulsion.

The hexacyano metal complex can be mixed with water, a mixed solvent of water and an appropriate organic solvent mixable with water (e.g., alcohols, ethers, glycols, ketones, esters, and amides), or gelatin and, then, added.

A quantity of the hexacyano metal complex to be added is, based on 1 mol of silver, preferably in the range of from $1\times10^{-5}$ mol to $1\times10^{-2}$ mol and more preferably in the range of from $1\times10^{-4}$ mol to $1\times10^{-3}$ mol.

In order to allow the hexacyano metal complex to be present on the outermost surface of the silver halide grain, the hexacyano metal complex is directly added in any stage of: before a loading step which is from completion of an addition of an aqueous silver nitrate solution to be used for grain formation to before a chemical sensitization step in which chalcogen sensitization such as sulfur sensitization, selenium sensitization or tellurium sensitization, or precious metal sensitization such as gold sensitization is performed; during a washing step; during a dispersion step; and before the chemical sensitization step is performed. To inhibit the growth of the silver halide grain, the hexacyano metal complex is preferably added immediately after the grain is formed and, accordingly, preferably before the loading step is completed.

Further, addition of the hexacyano metal complex may be started after 96% by mass of a total weight of silver nitrate to be added for the grain formation is added, preferably started after 98% by mass thereof is added, and particularly preferably started after 99% by mass thereof is added.

When any of these hexacyano metal complexes is added during a period of time between after an addition of the aqueous silver nitrate solution is performed and immediately before grain formation is completed, the hexacyano metal complex can be adsorbed on the outermost surface of the silver halide grain whereupon most of such hexacyano metal complexes each form an insoluble salt with a silver ion on a grain surface. Since a silver salt of hexacyanoiron (II) is a more insoluble salt than AgI, it can prevent redissolving to be caused by fine grains; as a result, it has become possible to manufacture a silver halide fine grain having a small grain size.

The photosensitive silver halide grain according to the invention may contain a metal belonging to Groups VIII to X of the Periodic Table (including Groups I to XVIII) or a complex thereof. The metal or a center metal of the metal complex belonging to Groups VIII to X of the Periodic Table is preferably any one of rhodium, ruthenium, and iridium. One type of these metal complexes may be used or, otherwise, two or more types of complexes of the same or different metals may simultaneously be used. A content thereof is preferably in the range, based on 1 mol of silver, of from $1\times10^{-9}$ mol to $1\times10^{-3}$ mole. Such heavy metals and metal complexes and, also, addition methods thereof are described in JP-A No. 7-225449, paragraphs [0018] to [0024] of JP-A No. 11-65021, and paragraphs [0227] to [0240] of JP-A No. 11-119374.

Other metal atoms (e.g., $[Fe(CN)_6]^{4-}$) capable of being contained in the silver halide grain according to the invention, a desalting method and a chemical sensitization method of the silver halide emulsion are described in paragraphs [0046] to [0050] of JP-A No. 11-84574, paragraphs [0025] to [0031] of JP-A No. 11-65021, and paragraphs [00242] to [0250] of JP-A No. 11-119374.

7) Gelatin

Various types of gelatin can be used as gelatin to be contained in the photosensitive silver halide emulsion according to the invention. In order to maintain an excellent dispersion state of the photosensitive silver halide emulsion in a coating solution containing an organic silver salt, it is preferable to use low molecular weight gelatin having a molecular weight in the range of from 500 to 60,000. These types of gelatin may be used at the time of grain formation or at the time of dispersion after a desalting treatment is performed; however, they are preferably used at the time of dispersion after the desalting treatment is performed.

8) Chemical Sensitization

The photosensitive silver halide according to the invention may chemically be unsensitized; however, the photosensitive silver halide according to the invention is preferably chemically sensitized by at least one method selected from the group consisting of chalcogen sensitization method, a gold sensitization method, and a reduction sensitization method. As for such chalcogen sensitization methods, mentioned are a sulfur sensitization method, a selenium sensitization method and a tellurium sensitization method.

In the sulfur sensitization method, an unstable sulfur compound is used whereupon examples of such unstable sulfur compounds capable of being used include those as described, for example, in P. Grafkides, Chimie et Physique Photographique, 5th ed., Paul Momtel, (1987), and Research Disclosure, Vol. 307, No. 307105.

Specifically, at least one of known sulfur compounds such as thiosulfates (for example, hyposulfite), thioureas (e.g., diphenyl thiourea, triethyl thiourea, N-ethyl-N'-(4-methyl-2-thiazolyl)thiourea, and carboxymethyl trimethyl thiourea), thioamides (e.g., thioacetamide), rhodanines (for example, diethyl rhodanine, 5-benzylidene-N-ethyl rhodanine), phosphine sulfides (e.g., trimethyl phosphine sulfide), thiohydantoins, 4-oxo-oxazolidine-2-thiones, disulfides or polysulfides (e.g., dimorpholine disulfide, cystine, and lenthionine), polythionates, elemental sulfur and, active gelatin and the like can be used. Particualrly, the thiosulfates, the thioureas, and the rhodanines are preferable thereamong.

In the selenium sensitization, an unstable selenium compound is used. Examples of such selenium compounds capable of being used include those as described, for example, in JP-B Nos. 43-13489, and 44-15748, JP-A Nos. 4-25832, 4-109340, 4-271341, 5-40324, and 5-11385, Japanese Patent Application Nos. 4-202415, 4-330495, 4-333030, 5-4203, 5-4204, 5-106977, 5-236538, 5-241642, and 5-286916.

Specifically, any one member selected from the group consisting of colloidal metal selenium, selenoureas (e.g., N,N-dimethyl selenourea, trifluoromethyl carbonyl-trimethyl selenourea, and acetyl-trimethyl selenourea), selenamides (e.g., selenamide, and N,N-diethylphenyl selenamide), phosphine selenides (e.g., triphenyl phosphine selenide, and pentafluorophenyl-triphenyl phosphine selenide), selenophosphates (e.g., tri-p-tolylselenophosphate, and tri-n-butylselenophosphate), selenoketones (e.g., selenobenzophenone), isoselenocyanates, selenocarboxylates, selenoesters, diacyl selenides and the like may be used. Further, at least one of non-unstable selenium compounds (e.g., selenious acid, selenocyanates, selenazoles and selenides) as described in JP-B Nos. 46-4553, 52-34492 and the like can be used whereupon, particularly, phosphine selenides, selenoureas and selenocyanates are preferable.

In the tellurium sensitization, an unstable tellurium compound is used. Examples of such selenium compounds capable of being used include those as described, for example, in JP-A Nos. 4-224595, 4-271341, 4-333043, 5-303157, 6-27573, 6-175258, 6-180478, 6-208186, 6-208184, 6-317867, 7-140579, 7-301879, and 7-301880.

Specifically, any one member selected from the group consisting of phosphine tellurides (e.g., butyl-diisopropyl phosphine telluride, tributyl phosphine telluride, tributoxy phosphine telluride, and ethoxy-diphenyl phosphine telluride), diacyl (di)tellurides (e.g., bis(diphenylcarbamoyl) ditelluride, bis(N-phenyl-N-methyl carbamoyl)ditelluride, bis(N-phenyl-N-methylcarbamoyl) telluride, bis(N-phenyl-N-benzylcarbamoyl) telluride, and bis(ethoxycarbonyl) telluride), tellurureas (e.g., N,N'-dimethylethylene tellurourea, and N,N'-diphenylethylene tellurourea), telluroamides, telluroeaters, and the like may be used. Particularly, the diacyl (di)tellurides and the phosphine tellurides are preferable thereamong and, further, compounds as described in paragraph [0030] of JP-A No. 11-65021 and compounds represented by the general formulas (II), (III), and (IV) in JP-A No. 5-313284 are more preferable.

Particularly, in the chalcogen sensitization according to the invention, the selenium sensitization and the tellurium sensitization are preferable and, thereamong, the tellurium sensitization is particularly preferable.

In the gold sensitization, at least one of gold sensitizers as described in P. Grafkides, Chimie et Physique Photographique, 5th ed., Paul Momtel, (1987), and Research Disclosure, Vol. 307, No. 307105 can be used. Specific examples of the gold sensitizers include chloroauric acid, potassium chloroaurate, potassium aurithiocyanate, gold sulfide and gold selenide, and, further, gold compounds as described, for example, in U.S. Pat. Nos. 2,642,361, 5,049,484, 5,049,485, 5,169,751, and 5,252,455, and Belgian Patent No. 691857. Further, at least one of salts of noble metals other than gold such as platinum, palladium, and iridium as described in P. Grafkides, Chimie et Physique Photographique, 5th ed., Paul Momtel, (1987), and Research Disclosure, Vol. 307, No. 307105 may also be used.

Although the gold sensitization may be used alone, it is preferably used in combination with the chalcogen sensitization. Specific examples thereof include gold-sulfur sensitization, gold-selenium sensitization, gold-tellurium sensitization, gold-sulfur-selenium sensitization, gold-sulfur-tellurium sensitization, gold-selenium-tellurium sensitization, and gold-sulfur-selenium-tellurium sensitization.

According to the invention, the chemical sensitization can be performed at any time so long as it is performed in a period of from after the grain is formed to before application is performed whereupon a time point of performing the chemical sensitization may be, after desalination, at least one of (1) before spectral sensitization, (2) simultaneously with the spectral sensitization, (3) after the spectral sensitization, (4) immediately before application, and the like.

A quantity of the chalcogen sensitizer to be used according to the invention is, though varying depending on the silver halide grain to be used, chemical ripening conditions and the like, in the range of from $10^{-8}$ mol to $10^{-1}$ mol, and preferably in the range of approximately from $10^{-7}$ mol to $10^{-2}$ mol per mol of silver halide in each case.

In the same manner as in the chalcogen sensitizer, a quantity of the gold sensitizer to be used according to the invention is, though varying depending on various types of conditions, as approximate numbers, in the range of from $10^{-7}$ mol to $10^{-2}$ mol, and preferably in the range of from $10^{-6}$ mol to $5\times10^{-3}$ mol per mol of silver halide in each case. As for environmental conditions under which the emulsion is chemically sensitized, any condition may be selected; however, pAg is 8 or less, preferably 7.0 or less, more preferably 6.5 or less, and particularly preferably 6.0 or less; pAg is 1.5 or more, preferably 2.0 or more, and particularly preferably 2.5 or more; pH is in the range of from 3 to 10, and preferably in the range of from 4 to 9; and a temperature is in the range of from 20° C. to 95° C. and preferably in the range of approximately from 25° C. to 80° C.

According to the present invention, reduction sensitization may be used simultaneously with the chalcogen sensitization or the gold sensitization. It is particularly preferable that the reduction sensitization is used simultaneously with the chalcogen sensitization.

Specific examples of preferred compounds which may be used in a reduction sensitization method include ascorbic acid, thiourea dioxide, and dimethylamine borane, as well as stannous chloride, aminoiminomethane sulfinic acid, hydrazine derivatives, borane compounds, silane compounds, and polyamines. Further, addition of a reduction sensitizer may be performed at any step in a manufacturing process of the photosensitive emulsion, that is, in a preparation process of from crystal growth to immediately before application. Still further, the reduction sensitization is preferably performed by ripening the emulsion while maintaining the pH thereof at 8 or more, or the pAg thereof at 4 or less. Furthermore, the reduction sensitization is preferably performed by introducing a single addition portion of a silver ion during grain formation.

A quantity of the reduction sensitizer to be added is, though varying depending on various types of conditions in the same manner as in the chalcogen sensitizer or gold sensitizer, as approximate numbers, preferably in the range of from $10^{-7}$ mol to $10^{-1}$ mol, more preferably in the range of from $10^{-6}$ mol to $5\times10^{-2}$ mol per mol of silver halide in each case.

The photosensitive silver halide emulsion according to the invention may preferably contain an FED sensitizer (Fragmentable electron donating sensitizer) as a compound which generates two electrons by one photon. As for such FED sensitizers, compounds as described in U.S. Pat. Nos. 5,413,909, 5,482,825, 5,747,235, 5,747,236, 6,054,260, and 5,994,051, and Japanese Patent Application No. 2001-86161 may preferably be used. As for steps in which the FED sensitizer is added, any step in a manufacturing process of the photosensitive emulsion, that is, in a preparation process from crystal growth to immediately before application is permissible. A quantity thereof to be added is, though varying depending on various types of conditions, as approximate numbers, preferably from $10^{-7}$ mol to $10^{-1}$ mol, and more preferably from $10^{-6}$ mol to $5\times10^{-2}$ mol, per mol of silver halide in each case.

In the silver halide emulsion according to the invention, a thiosulfonic acid compound may be added by a method as described in EP-A No. 293,917.

It is preferable from the standpoint of designing a high sensitive photothermographic material that the photosensitive silver halide grain according to the invention is chemically sensitized by at least one of the gold sensitization method and the chalcogen sensitization method.

9) Sensitizing Dye

As for sensitizing dyes applicable to the invention, a sensitizing dye capable of spectrally sensitizing the silver halide grain in a desired wavelength region when adsorbed thereby and having spectral sensitivity appropriate to spectral characteristics of an exposure light source can advantageously be selected. It is preferable that the photothermographic material according to the invention is spectrally sensitized such that it has a spectral sensitive peak, particularly, in the range of from 600 nm to 900 nm, or in the range of from 300 nm to 500 nm. The sensitizing dyes and addition methods thereof are described in paragraphs [0103] to [0109] of JP-A No. 11-65021, as compounds represented by the general formula (II) in JP-A No. 10-186572, as dyes represented by the general formula (I) in JP-A No. 11-119374, in paragraph [0106] of JP-A No. 11-119374, U.S. Pat. No. 5,510,236, as dyes mentioned in Example 5 in U.S. Pat. No. 3,871,887, in JP-A No. 2-96131, as dyes disclosed in JP-A No. 59-48753, in pp. 19 (line 38) to 20 (line 35) of EP-A No. 0803764, Japanese Patent Application Nos. 2000-86865, 2000-102560, and 2000-205399, and the like. These sensitizing dyes may be used either alone or in combination of two or more types.

A quantity of the sensitizing dye according to the invention to be added is, though desirably varying depending on sensitivity or fogging performance, preferably in the range of from $10^{-6}$ mol to 1 mol and more preferably in the range of from $10^{-4}$ mol to $10^{-1}$ mol, based on 1 mol of silver halide in a photosensitive layer in each case.

According to the invention, in order to enhance spectral sensitizing efficiency, a super-sensitizer may be used. As for such super-sensitizers according to the invention, mentioned are compounds as described in, for example, EP-A No. 587,338, U.S. Pat. Nos. 3,877,943 and 4,873,184, JP-A Nos. 5-341432, 11-109547 and 10-111543.

10) Simultaneous Use of Silver Halides

In the photosensitive silver halide emulsion in the photothermographic material according to the invention, one type thereof may be used, or two or more types thereof (e.g., those having different average grain sizes, different halogen compositions, different crystal habits or different chemical sensitization conditions from one another) may simultaneously be used. Using a plurality of types of photosensitive silver halides having different extents of sensitivity from one another allows gradation to be adjusted. Related technologies are described in, for example, JP-A Nos. 57-119341, 53-106125, 47-3929, 48-55730, 46-5187, 50-73627 and 57-150841. Sensitivity difference between any two emulsions is preferably 0.21 logE or more.

11) Mixing of Silver Halide with Organic Silver Salt

It is particularly preferable that the photosensitive silver halide grain according to the invention is formed under conditions where a non-photosensitive organic silver salt is not present and, then, chemically sensitized. Such a procedure is adopted because a method (ordinarily called as "halogenation method") in which the silver halide is formed by adding a halogenating agent to the organic silver salt cannot attain sufficient sensitivity in some cases.

As for methods for mixing the silver halide with the organic silver salt, mentioned are, for example, a method in which the photosensitive silver halide and the organic silver salt which have separately been prepared are mixed by a device such as a high-speed stirrer, a ball mill, a sand mill, a colloid mill, a vibration mill, and a homogenizer, and a method in which the photosensitive silver halide which has previously been prepared is mixed at an appropriate time point in the process of preparing the organic silver salt to prepare the organic silver salt. Any of these methods may preferably obtain an effect according to the invention.

12) Mixing of Silver Halide to Coating Solution

A preferable time point at which the silver halide according to the invention is added to a coating solution for an image-forming layer may be during a period of from 180 minutes before coating is performed till immediately before the coating is performed, and preferably during a period of from 60 minutes before the coating is performed till 10 seconds before the coating is performed; however, a method and conditions for such an addition is not particularly limited, so long as an effect according to the invention may sufficiently be exhibited. Specific mixing methods include, for example, a method of mixing in a tank such that an average dwelling time, as calculated from an adding flow rate and a supplying flow rate to a coater, is allowed to be within a predetermined duration, and a method of using a static mixer or the like as described, for example, in N. Harnby, M. F. Edwards & A. W. Nienow, (translated by Koji Takahashi), "Liquid Mixing Technology" Chap. 8, The Nikkan Kogyo Shimbun, Ltd. (1989).

1-1-3. Description of Organic Silver Salt

The non-photosensitive organic silver salt which may be used in the invention is relatively stable to light, and is a silver salt which forms a silver image, when heated at 80° C. or more in the presence of an exposed photosensitive silver halide and a reducing agent. The organic silver salt may be any type of an organic substance containing a source which can reduce a silver ion. Such non-photosensitive organic silver salts are described in, for example, paragraphs [0048] and [0049] of JP-A No. 10-62899, pp. 18 (line 24) to 19 (line 37) of EP-A No. 0803764, EP-A No. 0962812, JP-A Nos. 11-349591, 2000-7683, and 2000-72711. Silver salts of organic acids, particularly, long chain aliphatic carboxylic acids (each having from 10 to 30 carbon atoms, preferably from 15 to 28 carbon atoms) are preferable. Preferable examples of such organic silver salts include silver behenate, silver arachidate, silver stearate, silver oleate, silver laurate, silver caproate, silver myristate, silver palmitate, and mixtures thereof. According to the invention, it is preferable to use an organic acid silver salt, among these organic silver salts, in which a content of silver behenate is from 50% by mol to 100% by mol. Particularly it is preferable that a content of silver behenate is from 75% by mol to 98% by mol.

The shape of particles of an organic silver salt usable in the present invention is not particularly limited, and may be a needle, rod, plate or flake shape.

Preferably, a flaky organic silver salt is used in the present invention. Herein, flaky organic silver salts are defined as follows. If the salt is examined through an electron microscope and the shape of the particles is considered to be approximately a rectangular parallelepiped, its sides are named "a", "b" and "c" in an order beginning with the shortest dimension ("c" may be equal to "b"), and the values of the two shortest sides "a" and "b" are used to calculate "x" by the following equation:

$$x=b/a$$

The value "x" is calculated for about 200 particles and if their mean value, x (mean)≧1.5, the particles are defined as flaky. Preferably, 30≧x (mean)≧1.5, and more preferably 20≧x (mean)≧2.0. Incidentally, the particles are needle-shaped if 1≦x (mean)<1.5.

Side "a" of a flaky particle can be regarded as the thickness of a plate-shaped particle having a principal face defined by sides "b" and "c". The mean value of "a" is preferably from 0.01 to 0.23 μm, and more preferably from 0.1 to 0.20 μm. The mean value of c/b is preferably from 1 to 6, more preferably from 1.05 to 4, still more preferably from 1.1 to 3, and particularly preferably from 1.1 to 2.

The particle sizes of the organic silver salt preferably have a monodispersed size distribution. In the monodispersed distribution, the standard deviation of the length of the minor axis or major axis of the particles divided by a length value of the minor axis or major axis, respectively, is preferably not more than 100%, more preferably not more than 80%, and still more preferably not more than 50%. The shape of particles of the salt can be determined from an observed image of a dispersion thereof through a transmission electron microscope. The particle size distribution of the salt can alternatively be determined by employing the standard deviation of the volume weighted mean diameter of the particles, and is monodispersed if a percentage obtained by dividing the standard deviation of the volume weighted mean diameter by the volume weighted mean diameter (coefficient of variation) is not more than 100%, more preferably not more than 80%, and still more preferably not more than 50%. The particle size (volume weighted mean diameter) can be determined, for example, by applying laser light to the organic silver salt dispersed in a liquid and determining an autocorrelation function of the variation of fluctuation of scattered light with time.

A preparation method and a dispersion method of the organic acid silver salt according to the invention may adopt any one of known methods and the like. Methods described in, for example, JP-A No. 10-62899, EP-A Nos. 0803763, and 0962812, JP-A Nos. 11-349591, 2000-7683, 2000-72711, 2001-163827, 2001-163889, 2001-163890, and 11-203413, Japanese Patent Application Nos. 2000-90093, 2000-195621, 2000-191226, 2000-213813, 2000-214155, and 2000-191226 can be referred to.

According to the invention, it is possible to prepare a photosensitive material by mixing an aqueous dispersion of the organic silver salt and an aqueous dispersion of the photosensitive silver halide. When such mixing is performed, a method in which two types or more of aqueous dispersions of the organic silver salt and two types or more of aqueous dispersions of the photosensitive silver halide are mixed is favorably used for the purpose of adjusting photographic characteristics.

The organic silver salt according to the invention may be used in a desired quantity whereupon a silver quantity is preferably in the range of from 0.1 g/m$^2$ to 5 g/m$^2$, more preferably in the range of from 1 g/m$^2$ to 3 g/m$^2$ and particularly preferably in the range of from 1.2 g/m$^2$ to 2.5 g/m$^2$.

1-1-4. Reducing Agent

The photothermographic material according to the invention comprises a reducing agent for an organic silver salt. The reducing agent may be any substance (preferably organic substance) which can reduce a silver ion to metallic silver. Examples of such reducing agents include those as described in paragraphs [0043] to [0045] of JP-A No. 11-65021, and in pp. 7 (line 34) to 18 (line 12) of EP-A No. 0803764.

A preferable reducing agent according to the invention is a so-called hindered phenol-type reducing agent or bisphenol-type reducing agent having a substituent at an ortho position of a phenolic hydroxyl group. Particularly, preferable are compounds represented by the following formula (R):

Formula (R)

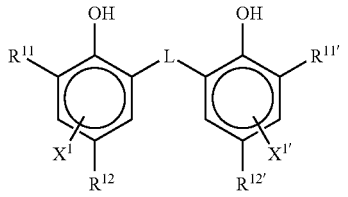

wherein $R^{11}$ and $R^{11'}$ each independently represent an alkyl group having from 1 to 20 carbon atoms;

$R^{12}$ and $R^{12'}$ each independently represent a hydrogen atom or a substituent for the benzene ring;

L represents a group of —S— or —CHR$^{13}$—, wherein $R^{13}$ represents a hydrogen atom or an alkyl group having from 1 to 20 carbon atoms; and $X^1$ and $X^{1'}$ each independently represent a hydrogen atom or a substituent for the benzene ring.

Now, each substituent will be described in detail.

1) $R^{11}$ and $R^{11'}$ $R^{11}$ and $R^{11'}$ each independently represent an alkyl group, which is substituted or non-substituted, having from 1 to 20 carbon atoms whereupon a substituent of the alkyl group is not particularly limited and preferable examples of such substituents include an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom.

2) $R^{12}$ and $R^{12'}$, and $X^1$ and $X^{1'}$ $R^{12}$ and $R^{12'}$ each independently represent a hydrogen atom or a substituent for the benzene ring.

$X^1$ and $X^{1'}$ each independently represent a hydrogen atom or a substituent for the benzene ring.

Preferable examples of such groups for use as the substituent for the benzene ring include an alkyl group, an aryl group, a halogen atom, an alkoxy group and an acylamino group.

3) L

L represents a group of —S— or —CHR$^{13}$—, wherein $R^{13}$ represents a hydrogen atom or an alkyl group having from 1 to 20 carbon atoms whereupon the alkyl group may have a substituent.

Specific examples of such alkyl groups which are non-substituted $R^{13}$ include a methyl group, an ethyl group, a propyl group, a butyl group, a heptyl group, an undecyl group, an isopropyl group, a 1-ethylpentyl group, and a 2,4,4-trimethylpentyl group.

Examples of substituents of the alkyl groups, being the same as those of $R^{11}$, include a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, and a sulfamoyl group.

4) Preferable Substituents $R^{11}$ and $R^{11'}$ are preferably a secondary or tertiary alkyl group having from 3 to 15 carbon atoms whereupon examples of such alkyl groups include an isopropyl group, an isobutyl group, a t-butyl group, a t-amyl group, a t-octyl group, a cyclohexyl group, a cyclopentyl group, a 1-methylcyclohexyl group, and a 1-methylcyclopropyl group. $R^{11}$ and $R^{11'}$ are more preferably a tertiary alkyl group having from 4 to 12 carbon atoms, still more preferably a t-butyl group, a t-amyl group, and a 1-methylcyclohexyl group, and most preferably a t-butyl group.

$R^{12}$ and $R^{12'}$ are preferably an alkyl group having from 1 to 20 carbon atoms whereupon specific examples of such alkyl groups include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, and a methoxyethyl group, and more preferably a methyl group, an ethyl group, a propyl group, an isopropyl group and a t-butyl group.

$X^1$ and $X^{1'}$ are preferably a hydrogen atom, a halogen atom, and an alkyl group, and more preferably a hydrogen atom.

L is preferably a group of —$CHR^{13}$—.

$R^{13}$ is preferably a hydrogen atom or an alkyl group having from 1 to 15 carbon atoms whereupon preferable examples of such alkyl groups include a methyl group, an ethyl group, a propyl group, an isopropyl group, and a 2,4,4-trimethypentyl group. Particularly preferable examples of $R^{13}$ include a hydrogen atom, a methyl group, a propyl group, and an isopropyl group.

When $R^{13}$ is a hydrogen atom, $R^{12}$ and $R^{12'}$ are preferably an alkyl group having from 2 to 5 carbon atoms whereupon an ethyl group and a propyl group are more preferable and an ethyl group is most preferable.

When $R^{13}$ is a primary or secondary alkyl group having 1 to 8 carbon atoms, $R^{12}$ and $R^{12'}$ are preferably a methyl group. As for the primary or secondary alkyl group each having from 1 to 8 carbon atoms of $R^{13}$, a methyl group, an ethyl group, a propyl group, an isopropyl group are more preferable, and a methyl group, an ethyl group and a propyl group are still more preferable.

When $R^{11}$, $R^{11'}$, $R^{12}$, and $R^{12'}$ are a methyl group, $R^{13}$ is preferably a secondary alkyl group. On this occasion, as for such secondary alkyl groups of $R^{13}$, an isopropyl group, an isobutyl group, and a 1-ethylpentyl group are preferable, and an isopropyl group is more preferable.

Various types of thermal developing properties of these reducing agents may be changed by combining at least two members selected from the group consisting of: $R^{11}$, $R^{11'}$, $R^{12}$, $R^{12'}$, and $R^{13}$. Since the thermal developing properties of reducing agents may be adjusted by simultaneously using at least two types of reducing agents at various proportions, it is preferable, though depending on applications, to use at least two types of reducing agents in combination.

Specific examples of compounds represented by formula (R) according to the invention are described below; however, the invention is by no means limited thereto.

(R-1)

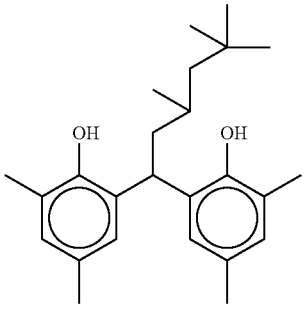

-continued (R-2)

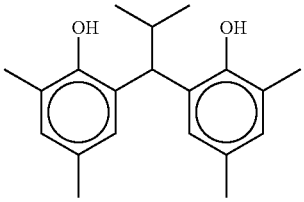

(R-3)

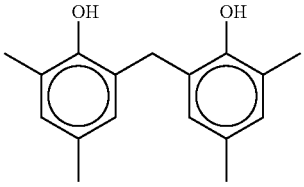

(R-4)

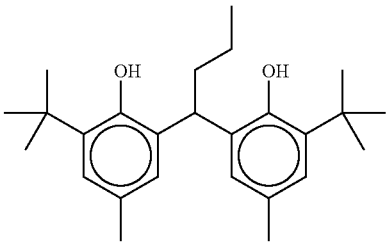

(R-5)

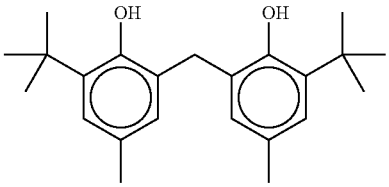

(R-6)

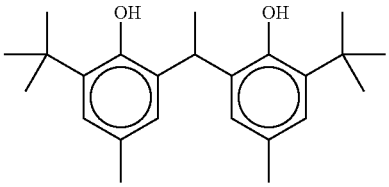

(R-7)

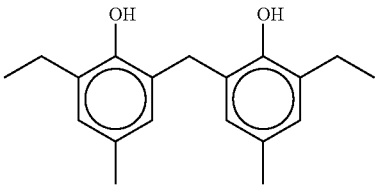

(R-8)

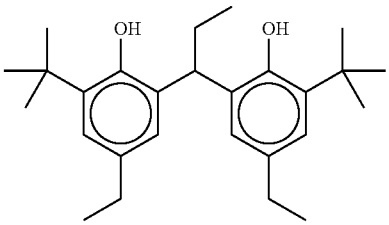

-continued
(R-9)
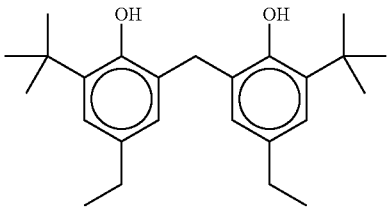
(R-10)
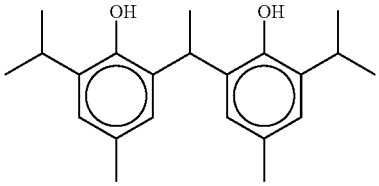
(R-11)
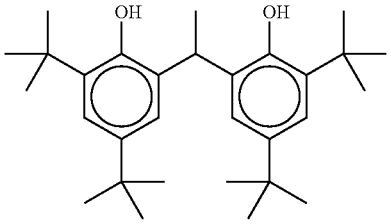
(R-12)
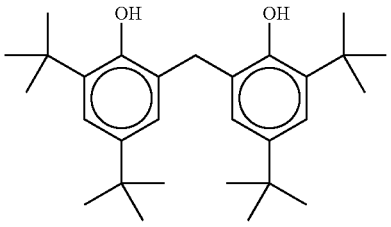
(R-13)
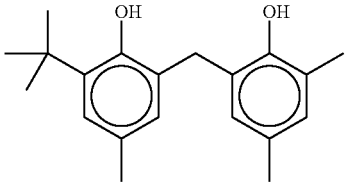
(R-14)
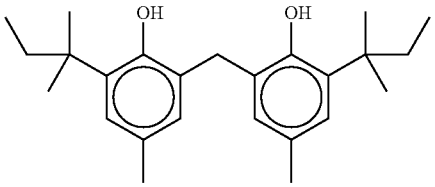
(R-15)
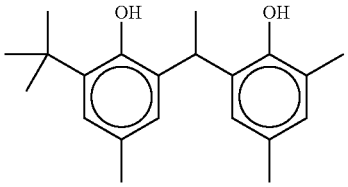
-continued
(R-16)
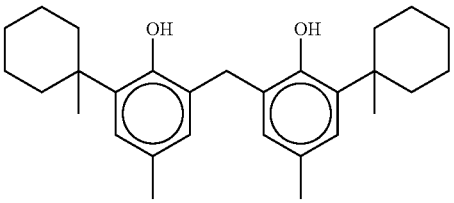
(R-17)
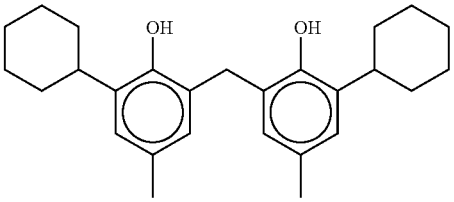
(R-18)
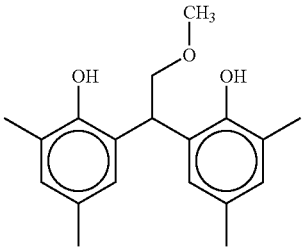
(R-19)
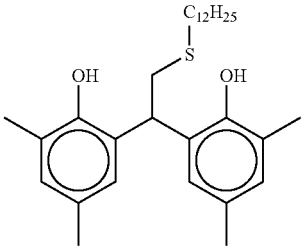
(R-20)
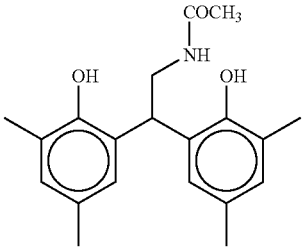
(R-21)
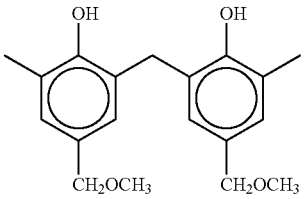

-continued
(R-22)
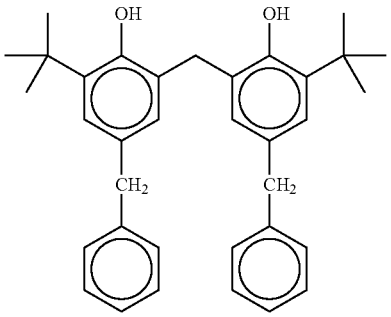
(R-23)
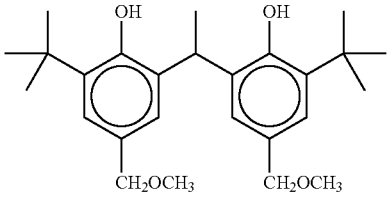
(R-24)
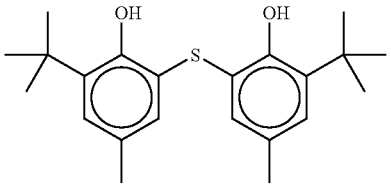
(R-25)
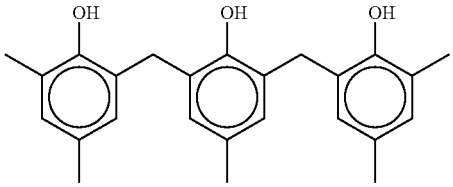
(R-26)
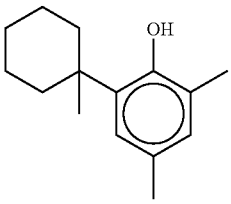
(R-27)
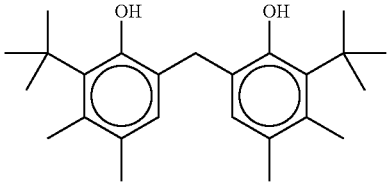
(R-28)
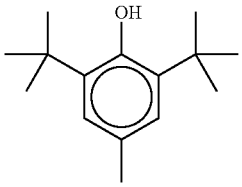
-continued
(R-29)
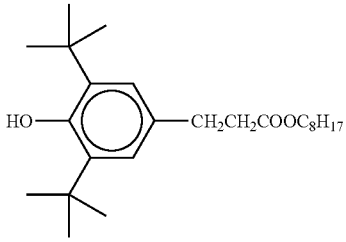
(R-30)
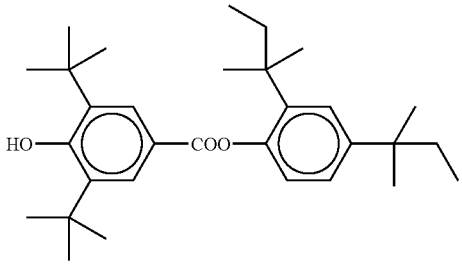
(R-31)
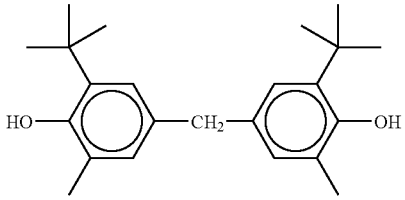
(R-32)
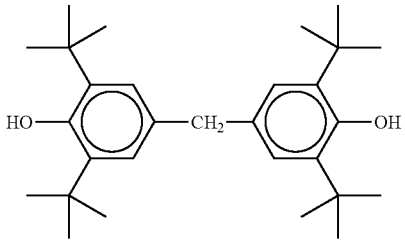
(R-33)
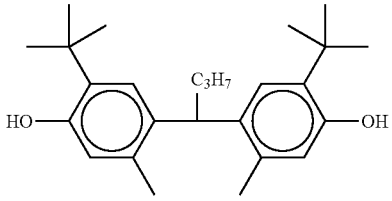
(R-34)
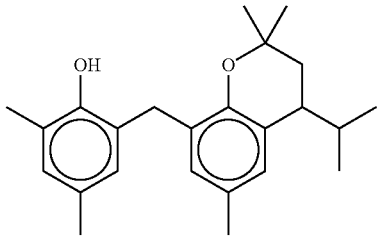
Particularly, compounds (R-1) to (R-20) are preferable.
A quantity of the reducing agent to be added according to the invention is preferably in the range of from 0.01 $g/m^2$ to 5.0 $g/m^2$, more preferably in the range of from 0.1 $g/m^2$ to 3.0 $g/m^2$ and, based on 1 mol of silver on a surface having an image-forming layer, preferably in the range of from 5% by mol to 50% by mol, and more preferably in the range of from 10% by mol to 40% by mol.

Although the reducing agent according to the invention may be added in the image-forming layer containing the organic silver salt and the photosensitive silver halide, and a layer adjacent thereto, it is more preferable to allow the reducing agent to be included in the image-forming layer.

The reducing agent according to the invention may be contained in the coating solution in any form of solution form, emulsify-dispersion form, solid fine grain dispersion form and the like and the resultant coating solution may be contained in the photosensitive material.

As for well known emulsifying-dispersing methods, mentioned is a method in which the reducing agent is dissolved using an auxiliary solvent such as dibutyl phthalate, tricresyl phosphate, glyceryl triacetate, an oil (e.g., diethyl phthalate), ethyl acetate, and cyclohexanone and, then, the resultant solution was mechanically treated to prepare an emulsified-dispersion.

Further, as for solid fine grain dispersion methods, mentioned is a method in which the reducing agent is dispersed in an appropriate solvent such as water by using a ball mill, a colloid mill, a vibration mill, a sand mill, a jet mill, a roller mill or an ultrasonic wave to prepare a solid dispersion. Preferably, the dispersion method is that of using the sand mill. On this occasion, any one of a protective colloid (e.g., polyvinyl alcohol), and a surfactant (e.g., an anionic surfactant such as sodium triisopropyl naphthalene sulfonate that is a mixture of different types of such sulfonates in which substitution positions of three isopropyl groups are different from one another) may be used. An antiseptic agent (e.g., a sodium salt of benzisothiazolinone) is allowed to be contained in an aqueous dispersion.

A particularly preferable method is the solid fine grain dispersion method. The reducing agent is added as fine grains having an average grain size in the range of from 0.01 μm to 10 μm, preferably in the range of from 0.05 μm to 5 μm, and more preferably in the range of from 0.1 μm to 1 μm. According to the invention, it is preferable that any one of other solid dispersions is dispersed in the above-described ranges of grain sizes and, then, the resultant dispersion is used.

2-1-3. Development Accelerator

In the photothermographic material according to the invention, sulfonamide phenolic compounds represented by the general formula (A) as described in JP-A Nos. 2000-267222 and 2000-330234, hindered phenolic compounds represented by the general formula (II) as described in JP-A No. 2001-92075, hydrazine-type compounds as described in JP-A No. 10-62895, and represented by the general formula (I) as described in JP-A No. 11-15116, the general formula (D) as described in JP-A No. 2002-156727, or the general formula (1) as described in Japanese Patent Application No. 2001-074278, and phenolic or naphthol-type compounds represented by the general formula (2) as described in JP-A No. 2001-264929 are preferably used. These development accelerators are used, against the reducing agent, in the range of from 0.1% by mol to 20% by mol, preferably in the range of from 0.5% by mol to 10% by mol, and more preferably in the range of from 1% by mol to 5% by mol. A method of introducing the development accelerator to the photosensitive material may be performed in the same manner as in the reducing agent whereupon, particularly, it is preferably incorporated after being changed into a solid dispersion or an emulsified-dispersion.

When the development accelerator is added as an emulsified-dispersion, it is preferable to add the development accelerator in a form of the emulsified-dispersion which has been prepared by emulsifying the development accelerator by simultaneously using a high-boiling solvent that is solid at room temperature and a low-boiling auxiliary solvent or in a form of a so-called oil-less emulsified-dispersion in which a high-boiling solvent is not used.

Among the above development accelerators, the hydrazine-type compounds represented by the general formula (D) as described in JP-A No. 2002-156727 and phenolic or naphthol-type compounds represented by the general formula (2) as described in JP-A No. 2001-264929 are particularly preferred in the invention.

Particularly preferable development accelerators according to the invention are compounds represented by formulas (A-1) and (A-2) described below.

$$Q_1\text{-NHNH-}Q_2 \qquad \text{(A-1)}$$

wherein $Q_1$ represents an aromatic group or a heterocyclic group whose carbon atom bonds to —NHNH-$Q_2$; and $Q_2$ represents at least one member selected from the group consisting of a carbamoyl group, an acyl group, an alkoxycarbonyl group, an aryloxycarbonyl group, a sulfonyl group, and a sufamoyl group.

In formula (A-1), the aromatic group or the heterocyclic group represented by $Q_1$ is preferably a 5- to 7-membered unsaturated ring. Preferable examples of such rings include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, and a thiophene ring whereupon a condensed ring in which these rings are condensed with each other is also preferable.

These rings may each have a substituent whereupon, when these rings each have two or more substituents, these substituents may be same with or different from each other. Examples of the substituents include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsufonyl group, an arylsulfonyl group, an alkoxycarbonyl group, an aryloxycarbonyl group, and an acyl group. When these substituents are groups capable of being substituted, these substituents may each further have a substituent whereupon examples of such latter substituents include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsufonyl group, an arylsulfonyl group, and an acyloxy group.

The carbamoyl group represented by $Q_2$ is a carbamoyl group having preferably from 1 to 50 carbon atoms and more preferably from 6 to 40 carbon atoms whereupon examples of such carbamoyl groups include an unsubstituted carbamoyl group, a methyl carbamoyl group, an N-ethyl carbamoyl group, an N-propyl carbamoyl group, an N-sec-butyl carbamoyl group, an N-octyl carbamoyl group, an N-cyclohexyl carbamoyl group, an N-tert-butyl carbamoyl group, an N-dodecyl carbamoyl group, an N-(3-dodecyloxypropyl) carbamoyl group, an N-octadecyl carbamoyl group, an N-{3-(2,4-tert-pentylphenoxy)propyl} carbamoyl group, an N-(2-hexyldecyl) carbamoyl group, an N-phenyl carbamoyl group, an N-(4-dodecyloxy phenyl) carbamoyl group, an N-(2-chloro-5-dodecyloxycarbonylphenyl) carbamoyl group, an N-naphthyl carbamoyl group, an N-3-pyridyl carbamoyl group, and an N-benzyl carbamoyl group.

The acyl group represented by $Q_2$ is an acyl group having preferably from 1 to 50 carbon atoms and more preferably from 6 to 40 carbon atoms whereupon examples of such acyl groups include a formyl group, an acetyl group, a 2-methylpropanoyl group, a cyclohexyl carbonyl group, an octanoyl group, a 2-hexyldecanoyl group, a dodecanoyl group, a chloroacetyl group, a trifluoroacetyl group, a benzoyl group, a 4-dodecyloxybenzoyl group, and a 2-hydroxymethyl benzoyl group. The alkoxycarbonyl group represented by $Q_2$ is an alkoxycarbonyl group having preferably from 2 to 50 carbon atoms and more preferably from 6 to 40 carbon atoms whereupon examples of such alkoxycarbonyl groups include a methoxycarbonyl group, an ethoxycarbonyl group, an isobutyloxycarbonyl group, a cyclohexyloxycarbonyl group, a dodecyloxycarbonyl group, and a benzyloxycarbonyl group.

The aryloxycarbonyl group represented by $Q_2$ is an aryloxycarbonyl group having preferably from 7 to 50 carbon atoms and more preferably from 7 to 40 carbon atoms whereupon examples of such aryloxycarbonyl groups include a phenoxycarbonyl group, a 4-octyloxyphenoxycarbonyl group, a 2-hydroxymethyl phenoxycarbonyl group, and a 4-dodecyloxyphenoxycarbonyl group. The sulfonyl group represented by $Q_2$ is a sulfonyl group having preferably from 1 to 50 carbon atoms and more preferably from 6 to 40 carbon atoms whereupon examples of such sulfonyl groups include a methyl sulfonyl group, a butyl sulfonyl group, an octyl sulfonyl group, a 2-hexadecyl sulfonyl group, a 3-dodecyloxypropyl sulfonyl group, a 2-octyloxy-5-tert-octylphenyl sulfonyl group, and a 4-dodecyloxyphenyl sulfonyl group.

The slulfamoyl group represented by $Q_2$ is a sulfamoyl group having preferably from 0 to 50 carbon atoms, and more preferably from 6 to 40 carbon atoms whereupon examples of such sulfamoyl groups include an unsubstituted sulfamoyl group, an N-ethyl sulfamoyl group, an N-(2-ethylhexyl) sulfamoyl group, an N-decyl sulfamoyl group, an N-hexadecyl sulfamoyl group, an N-{3-(2-ethylhexyloxy)propyl} sulfamoyl group, an N-(2-chloro-5-dodecyloxycarbonylphenyl) sulfamoyl group, and an N-(2-tetradecyloxyphenyl) sulfamoyl group. The group represented by $Q_2$ may further have a group described as an example of the substituent of the 5- to 7-membered unsaturated ring represented by $Q_1$ at a position at which a substitution can be conducted whereupon, when the group has two or more substituents, these substituents may be the same or different from one another.

Next, preferable compounds represented by formula (A-1) will be described. As $Q_1$, a 5- or 6-membered unsaturated ring is preferable, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isooxazole ring and a condensed ring in which these rings are each condensed with a benzene ring or an unsaturated heterocycle is more preferable. Further, as $Q_2$, a carbamoyl group is preferable, and a carbamoyl group having a hydrogen atom on a nitrogen atom is particularly preferable.

Formula (A-2)

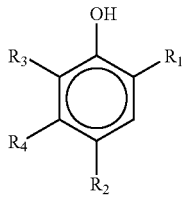

In formula (A-2), $R_1$ represents at least one member selected from the group consisting of: an alkyl group, an acyl group, an acylamino group, a sulfonamide group, an alkoxycarbonyl group, and a carbamoyl group;

$R_2$ represents at least one member selected from the group consisting of a hydrogen atom, a halogen atom, an alkyl group, an alkoxy group, an aryloxy group, an alkylthio group, an arylthio group, an acyloxy group and a carbonic acid ester; and $R_3$ and $R_4$ each independently represent a group, capable of being substituted to a benzene ring as described as an example of the substituent in formula (A-1) whereupon $R_3$ and $R_4$ may be linked with each other to form a condensed ring.

As $R_1$, preferable are an alkyl group having from 1 to 20 carbon atoms (e.g., a methyl group, an ethyl group, an isopropyl group, a butyl group, a tert-octyl group, or a cyclohexyl group), an acylamino group (e.g., an acetylamino group, a benzoylamino group, a methylureido group, or a 4-cyanophenylureido group), and a carbamoyl group (e.g., an n-butyl carbamoyl group, an N,N-diethyl carbamoyl group, a phenyl carbamoyl group, a 2-chlorophenyl carbamoyl group, or a 2,4-dichlorophenyl carbamoyl group) whereupon an acylamino group (inclusive of a ureido group and a urethane group) is more preferable.

As $R_2$, preferable are a halogen atom (more preferably a chlorine atom or a bromine atom), an alkoxy group (e.g., a methoxy group, a butoxy group, an n-hexyloxy group, an n-decyloxy group, a cyclohexyloxy group, or a benzyloxy group), and an aryloxy group (e.g., a phenoxy group or a naphthoxy group).

As $R_3$, preferable are a hydrogen atom, a halogen atom and an alkyl group having from 1 to 20 carbon atoms whereupon a halogen atom is most preferable. As $R_4$, preferable are a hydrogen atom, an alkyl group, and an acylamino group whereupon an alkyl group and an acylamino group are more preferable. Preferable substituents of these groups are the same as in $R_1$. It is also preferable that, when $R_4$ represents an acylamino group, $R_3$ and $R_4$ may be linked each other to form a carbostyryl ring.

In formula (A-2), when $R_3$ and $R_4$ are linked each other to form a condensed ring, the condensed ring is particularly preferably a naphthalene ring. The same substituent as that described in the formula (A-1) may be combined to the naphthalene ring. It is preferable that, when the formula (A-2) represents a naphthol-type compound, $R_1$ preferably represents a carbamoyl group. Among such carbamoyl groups, a benzoyl group is particularly preferable. As $R_2$, an alkoxy group and an aryloxy group are preferable whereupon an alkoxy group is particularly preferable.

Specific examples of development accelerators according to the invention are described below; however, the invention is by no means limited thereto.

(A-1)

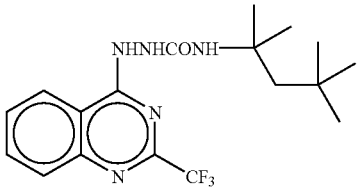

(A-2)

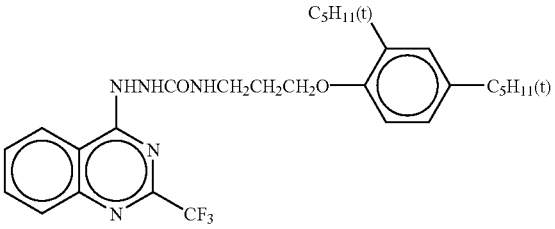

(A-3)

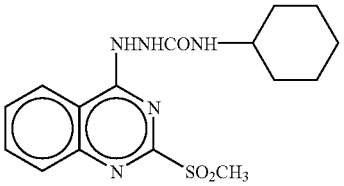

(A-4)

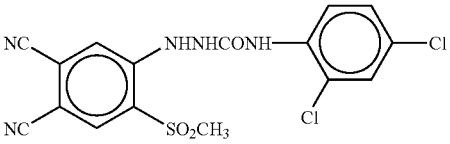

(A-5)

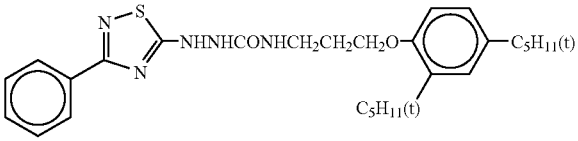

(A-6)

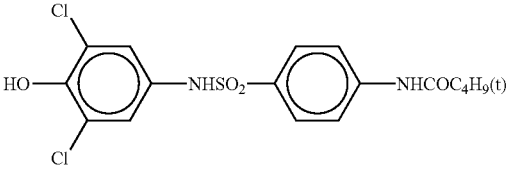

(A-7)

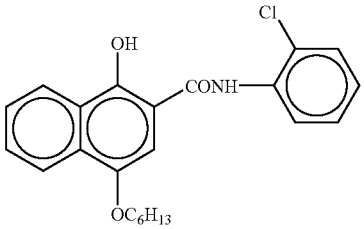

-continued (A-8)

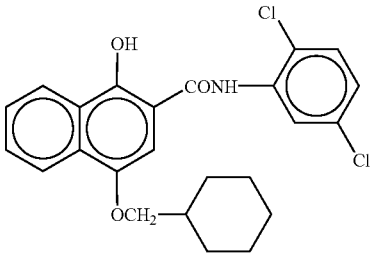

(A-9)

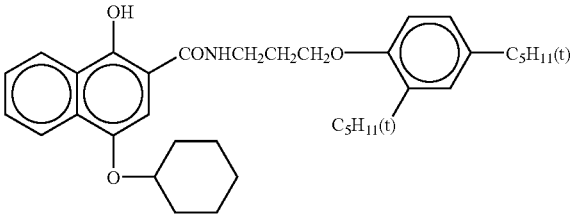

(A-10)

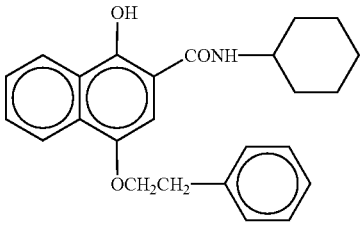

(A-11)

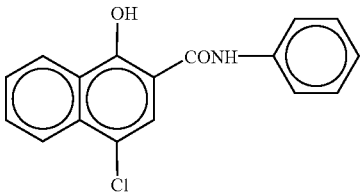

(A-12)

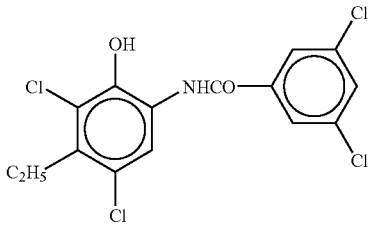

2-1-4. Hydrogen Bond-Forming Compound

When a reducing agent according to the invention has an aromatic hydroxyl group (—OH) or an amino group (—NHR in which R represents a hydrogen atom or an alkyl group), particularly when it is one of the above-described bisphenols, it is preferable that a non-reducible compound having a group capable of forming a hydrogen bond with at least one of these groups is simultaneously used.

Examples of groups each capable of forming a hydrogen bond with a hydroxyl group or an amino group include a phosphoryl group, a sulfoxide group, a sulfonyl group, a carbonyl group, an amide group, an ester group, a urethane group, a ureido group, a t-amino group, and a nitrogen-containing aromatic group. Among these groups, compounds each having a phosphoryl group, a sulfoxide group, an amide group (not having >N—H group but blocked like >N—Ra, in which Ra represents a substituent other than H), a urethane group (not having >N—H group but blocked like >N—Ra, in which Ra represents a substituent other than H), a ureido group (not having >N—H group but blocked like >N—Ra, in which Ra represents a substituent other than H) are preferable.

Particularly preferable hydrogen bond-forming compounds according to the invention are compounds represented by the following formula (D):

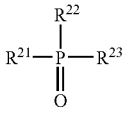

In the above formula (D), $R^{21}$, $R^{22}$, and $R^{23}$ each independently represent at least one group selected from the group consisting of an alkyl group, an aryl group, an alkoxy group, an aryloxy group, an amino group, and a heterocyclic group whereupon these groups may be unsubstituted or may each have a substituent.

When any one of $R^{21}$, $R^{22}$, and $R^{23}$ has a substituent, examples of such substituents include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group and a phosphoryl group; on this occasion, the substituent is preferably an alkyl group or an aryl group whereupon examples of such alkyl groups and aryl groups include a methyl group, an ethyl group, an isopropyl group, a t-butyl group, a t-octyl group, a phenyl group, a 4-alkoxyphenyl group, and a 4-acyloxyphenyl group.

Specific examples of such alkyl groups represented each independently by $R^{21}$, $R^{22}$, and $R^{23}$ include a methyl group, an ethyl group, a butyl group, an octyl group, a dodecyl group, an isopropyl group, a t-butyl group, a t-amyl group, a t-octyl group, a cyclohexyl group, a 1-methyl cyclohexyl group, a benzyl group, a phenethyl group, and a 2-phenoxypropyl group.

Specific examples of such aryl groups include a phenyl group, a cresyl group, a xylyl group, a naphthyl group, a 4-t-butylphenyl group, a 4-t-octylphenyl group, a 4-anisidyl group, and a 3,5-dichlorophenyl group.

Specific examples of such alkoxy groups include a methoxy group, an ethoxy group, a butoxy group, an octyloxy group, a 2-ethylhexyloxy group, a 3,5,5-trimethyl hexyloxy group, a dodecyloxy group, a cyclohexyloxy group, a 4-methyl cyclohexyloxy group, and a benzyloxy group.

Specific examples of such aryloxy groups include a phenoxy group, a cresyloxy group, an isopropylphenoxy group, a 4-t-butylphenoxy group, a naphthoxy group, and a biphenyloxy group.

Specific examples of such amino groups include a dimethylamino group, a diethylamino group, a dibutylamino group, a dioctylamino group, an N-methyl-N-hexylamino group, a dicyclohexylamino group, a diphenylamino group, and an N-methyl-N-phenylamino group.

As for $R^{21}$, $R^{22}$, and $R^{23}$, an alkyl group, an aryl group, an alkoxy group, and aryloxy group are preferable. From the standpoint of an effect according to the invention, it is preferable that at least one of $R^{21}$, $R^{22}$ and $R^{23}$ is an alkyl group or an aryl group, and it is more preferable that at least two of $R^{21}$, $R^{22}$ and $R^{23}$ are an alkyl group or an aryl group. Further, in view of availability at low costs, it is preferable that $R^{21}$, $R^{22}$, and $R^{23}$ are the same group.

Specific examples of hydrogen bond-forming compounds are described below, starting with compounds represented by formula (D) according to the invention; however, the invention is by no means limited thereto.

(D-1)

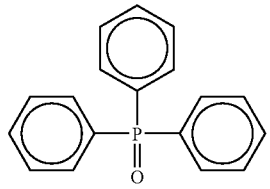

(D-2)

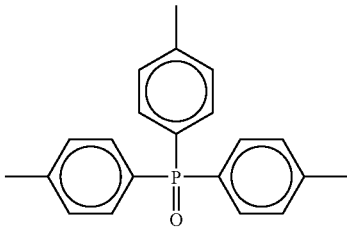

(D-3)

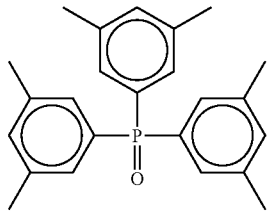

(D-4)

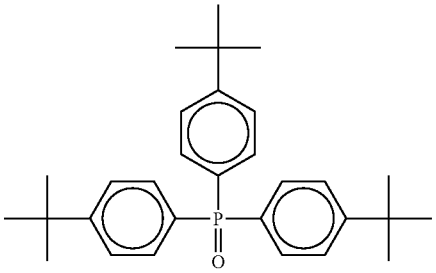

(D-5)

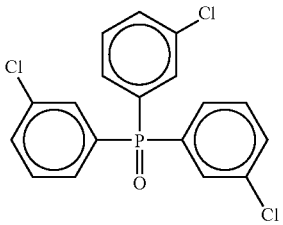

(D-6)

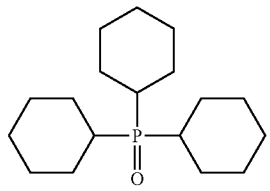

-continued (D-7)

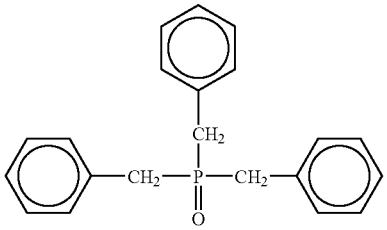

(D-8)

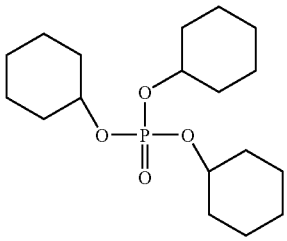

(D-9)

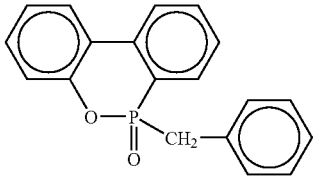

(D-10)

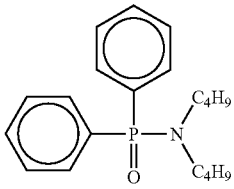

(D-11)

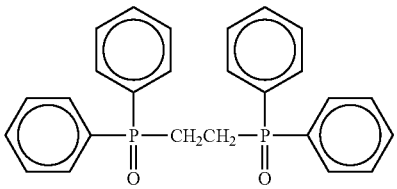

(D-12)

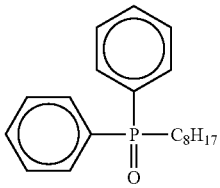

(D-13)

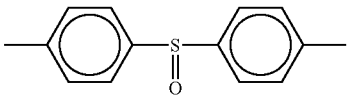

(D-14)

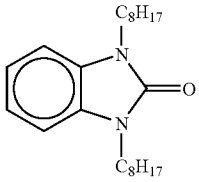

-continued (D-15)

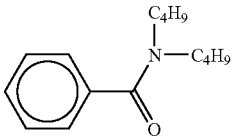

Specific examples of the hydrogen bond-forming compounds further include those as described in EP-A No. 1096310, JP-A No. 2002-156727 and Japanese Patent Application No. 2001-124796.

The compound represented by formula (D) according to the invention may be contained in the coating solution, in the same manner as in the reducing agent, in any one form selected from the group consisting of: the solution form, the emulsified dispersion form, and the solid fine grain dispersion form and, then, the resultant coating solution may be contained in the photosensitive material whereupon the compound according to the invention is preferably used in the solid dispersion form. The compound according to the invention forms a complex in a solution state by forming a hydrogen bond with a compound having a phenolic hydroxyl group or an amino group whereupon the complex, though depending on combinations of the reducing agents and the compounds represented by formula (D) according to the invention, may be isolated in a crystal state.

It is particularly preferable from the standpoint of obtaining a consistent performance that the thus-isolated crystal powder is used as the solid fine grain dispersion. Further, preferably used is a method in which the reducing agent and the compound represented by formula (D) according to the invention are mixed in powder states and, then, dispersed by using an appropriate dispersing agent by utilizing a sand grinder mill or the like to form a complex at the time of such dispersion.

The compound represented by formula (D) according to the invention is used preferably in the range of from 1% by mol to 200% by mol, more preferably in the range of from 10% by mol to 150% by mol and still more preferably in the range of from 20% by mol to 100% by mol, relative to the reducing agent.

2-1-5. Binder

A binder in a layer containing an organic silver salt according to the invention may incorporate any type of polymers. Such binders are preferably transparent or semi-transparent and ordinarily colorless whereupon examples of the binders include natural resins or polymers and copolymers, synthetic resins or polymers and copolymers, and other media which form a film whereupon specific examples thereof include gelatins, rubbers, poly(vinyl alcohol)s, hydoxyethyl celluloses, cellulose acetates, cellulose acetate butyrates, poly(vinylpyrrolidone)s, casein, starch, poly(acrylic acid)s, poly(methylmethacrylic acid)s, poly(vinyl chloride)s, poly(methacrylic acid)s, styrene/maleic acid anhydride copolymers, styrene/acrylonitrile copolymers, styrene/butadiene copolymers, poly(vinyl acetal)s (for example, poly(vinyl formal) and poly(vinyl butylal)), poly(ester)s, poly(urethane)s, phenoxy resins, poly(vinylidene chloride)s, poly(epoxide)s, poly(carbonate)s, poly(vinyl acetate)s, poly(olefin)s, cellulose esters and poly(amide)s. The binders may be incorporated by being dissolved in water or an organic solvent or as an emulsion for coating.

According to the invention, a glass transition temperature of the binder which can simultaneously be used in the organic silver salt-containing layer is preferably in the range of from 0° C. to 80° C., (hereinafter also referred to as "high Tg binder"), more preferably in the range of from 10° C. to 70° C., and still more preferably in the range of from 15° C. to 60° C.

As used herein, Tg is calculated according to the following equation:

$$1/Tg=\Sigma(Xi/Tgi)$$

The polymer whose glass transition point Tg is calculated as above comprises n's monomers copolymerized (i indicates the number of the monomers copolymerized, falling between 1 and n); Xi indicates the mass fraction of i'th monomer (ΣXi=1); Tgi indicates the glass transition point (in terms of the absolute temperature) of the homopolymer of i'th monomer alone; and Σ indicates the sum total of i falling between 1 and n. Incidentally, the value of glass transition point (Tgi) of the homopolymer of each monomer alone is adopted from the values described in "*Polymer Handbook*" (3rd edition) (written by J. Brandrup, E. H. Immergut (Wiley-Interscience, 1989)).

A single kind of polymer may be used for the binder, or alternatively, two or more kinds of polymers may be used in combination. For example, a combination of a polymer having a glass transition point of higher than 20° C. and another polymer having a glass transition point of lower than 20° C. is possible. In case where at least two kinds of polymers that differ in Tg are blended for use therein, it is desirable that the mass-average Tg of the resulting blend falls within the ranges specified as above.

According to the invention, it is preferable that, for the organic silver salt-containing layer, a coating liquid in which 30% by mass or more of the solvent is water is applied, and dried to form a film.

According to the invention, properties of the photothermographic material are improved when the organic silver salt-containing layer has been formed by first applying a coating solution comprising 30% by mass or more of water of the entire solvent and, then, drying and, further, when the binder in the organic solver salt-containing layer is soluble or dispersible in an aqueous solvent (a water solvent), and, in particular, when the binder comprises a latex of polymer in which an equilibrium moisture content at 25° C. 60% RH is 2% by mass or less.

The most preferable form is such a form as is prepared such that an ionic conductivity becomes 2.5 mS/cm or less. As for such preparation method, mentioned is a purification method using a functional membrane for separation after a polymer is synthesized.

The term "aqueous solvent in which the polymer is soluble or dispersible" as used herein refers to water or a mixture of water and a water-miscible organic solvent in a quantity of 70% by mass or less.

Examples of such water-miscible organic solvents include alcohol-type solvents such as methyl alcohol, ethyl alcohol and propyl alcohol; Cellosolve-type solvents such as methyl Cellosolve, ethyl Cellosolve and butyl Cellosolve; ethyl acetate; and dimethyl formamide.

Further, even in a system in which the polymer is not dissolved from a thermodynamics standpoint and is present in a so-called dispersion state, the term "aqueous solvent" is used herein.

Further, the term "equilibrium moisture content at 25° C. 60% RH" as used herein can be expressed by using a weight W1 of a polymer in an equilibrium with moisture conditioning under the atmosphere at 25° C. 60% RH and a weight W0 of the polymer in the absolutely dry state, as shown in the following equation:

The equilibrium moisture content at 25° C. 60%

$$RH=\{(W1-W0)/W0\}\times 100 \text{ (\% by mass)}$$

Regarding a definition and a measurement method of the moisture content, for example, Testing Methods of Polymer Materials, Polymer Engineering Course 14, compiled by the Society of Polymer Science of Japan, Chijin Shokan (Publishing) can be referred.

An equilibrium moisture content of the binder polymer according to the invention at 25° C. 60% RH is preferably 2% by mass or less, more preferably in the range of from 0.01% by mass to 1.5% by mass, and still more preferably in the range of from 0.02% by mass to 1% by mass.

According to the invention, a polymer dispersible in a water-based solvent is particularly preferred. Examples of dispersed states include a latex in which fine grains of a water-insoluble and hydrophobic polymer are dispersed and a dispersion in which polymer molecules are dispersed in a molecular state or a micelle-forming state. Any of them is favorable; however, grains in a latex dispersion state are more preferable. An average grain diameter of dispersed grains is in the range of from 1 nm to 50,000 nm, preferably in the range of from 5 nm to 1,000 nm, more preferably in the range of from 10 nm to 500 nm and still more preferably in the range of from 50 nm to 200 nm. A grain diameter distribution of the dispersed grains is not particularly limited whereupon either of dispersed grains having a broad grain diameter distribution or having a monodispersed grain diameter distribution may be used. It is a favorable method from the standpoint of capability of controlling physical properties of the coating liquid that 2 types or more each having the monodispersed grain diameter distribution are mixed and used.

According to the invention, examples of preferably usable polymers dispersible in aqueous solvents include hydrophobic polymers such as acrylic polymers, poly(ester)s, rubbers (e.g., SBR resins), poly(urethane)s, poly(vinyl chloride)s, poly(vinyl acetate)s, poly(vinylidene chloride)s and poly (olefin)s. These polymers may be a straight-chain polymer, a branched-chain polymer, a cross-linked polymer, a so-called homopolymer in which monomers of a single type have been polymerized, or a copolymer in which monomers of two or more types have been polymerized. In a case of the copolymer, it may be either a random copolymer or a block copolymer. A molecular weight of each of these polymers is, in terms of the number average molecular weight, in the range of from 5,000 to 1,000,000 and preferably in the range of from 10,000 to 200,000. When the polymer having an unduly small molecular weight is used, dynamic strength of the image-forming layer becomes insufficient, while, when the polymer having an unduly large molecular weight is used, film-forming properties thereof are deteriorated whereupon neither of these cases is preferable. Further, cross-linking-type polymer latex is particularly preferably used.

(Specific Examples of Latex)

Specific examples of preferable polymer latices include materials described below. These materials are each expressed in terms of a starting monomer; a value in each parenthesis is indicated in terms of "% by mass"; and a molecular weight means a number average molecular weight. In the case in which a multi-functional monomer has been used, the concept of a molecular weight may not be applied, since a cross-linked structure is formed. Accordingly, such a case is indicated as "cross-linking" to obviate describing the molecular weight. Tg means a glass transition temperature.

P-1; a latex (MW: 37,000; Tg: 61° C.) of MMA(70)/EA(27)/MAA(3)

P-2; a latex (MW: 40,000; Tg: 59° C.) of MMA(70)/2EHA(20)/St(5)/AA(5)

P-3; a latex (cross-linking; Tg: −17° C.) of St(50)/Bu(47)/MAA(3)

P-4; a latex (cross-linking; Tg: 17° C.) of St(68)/Bu(29)/AA(3)

P-5; a latex (cross-linking; Tg: 24° C.) of St(71)/Bu(26)/AA(3)

P-6; a latex (cross-linking) of St(70)/Bu(27)/IA(3)

P-7; a latex (cross-linking; Tg: 29° C.) of St(75)/Bu(24)/AA(1)

P-8; a latex (cross-linking) of St(60)/Bu(35)/DVB(3)/MAA(2)

P-9; a latex (cross-linking) of St(70)/Bu(25)/DVB(2)/AA(3)

P-10; a latex (MW: 80,000) of VC(50)/MMA(20)/EA(20)/AN(5)/AA(5)

P-11; a latex (MW: 67,000) of VDC(85)/MMA(5)/EA(5)/MAA(5)

P-12; a latex (MW: 12,000) of Et(90)/MAA(10)

P-13; a latex (MW: 130,000; Tg: 43° C.) of St(70)/2EHA(27)/AA(3)

P-14; a latex (MW 33,000; Tg: 47° C.) of MMA(63)/EA(35)/AA(2)

P-15; a latex (cross-linking; Tg: 23° C.) of St(70.5)/Bu(26.5)/AA(3)

P-16; a latex (cross-linking; Tg: 20.5° C.) of St(69.5)/Bu(27.5)/AA(3)

Abbreviations in the above structures denote respective monomers as follows:

MMA: methyl metacrylate; EA: ethy acrylate; MAA methacylic acid; 2EHA: 2-ethylhexyl acrylate; St: styrene; Bu: butadiene; AA: acrylic acid; DVB: divinyl benzene; VC: vinyl chloride; AN: acrylonitrile; VDC: vinylidene chloride; Et: ethylene; and IA: itaconic acid.

Polymer latices described above are commercially available and such products as described below may be utilized. Examples of acrylic polymers include Cevian A-4635, 4718 and 4601 (these are manufactured by Daicel Chemical Industries, Ltd.) and Nipol Lx811, 814, 821, 820 and 857 (these are manufactured by Zeon Corp.). Examples of poly(ester)s include FINETEX ES650, 611, 675 and 850 (these are manufactured by Dainippon Ink & Chemicals Inc.) and WD-size and WMS (these are manufactured by Eastman Chemical Company). Examples of poly(urethane)s include HYDRAN AP10, 20, 30 and 40 (these are manufactured by Dainippon Ink & Chemicals Inc.). Examples of rubbers include LACSTAR 7310K, 3307B, 4700H and 7132C (these are manufactured by Dainippon Ink & Chemicals Inc.) and Nipol Lx416, 410, 438C and 2507 (these are manufactured by Zeon Corp.). Examples of poly(vinyl chloride)s include G351 and G576 (these are manufactured by Zeon Corp.). Examples of poly(vinylidene chloride)s include L502 and L513 (these are manufactured by Asahi Chemical Industry Co., Ltd.). Examples of poly(olefin)s include Chemipearl S120 and SA100 (these are manufactured by Mitsui Petrochemical Industries, Ltd.).

These polymer latices may be used singly or in combination of two or more types according to necessity.

(Preferable Latex)

As for the polymer latices according to the invention, in particular, a latex of a styrene/butadiene copolymer is preferred. It is preferable that a weight ratio of styrene monomer units to butadiene monomer units in the styrene/butadiene copolymer is in the range of from 40:60 to 95:5. Further, it is preferable that a ratio of styrene monomer units together with butadiene monomer units in the copolymer is in the range of from 60% by mass to 99% by mass. Further, the polymer latex according to the invention preferably contains acrylic acid or methacrylic acid in the range of from 1% by mass to 6% by mass, more preferably in the range of from 2% by mass to 5% by mass, based on the entire mass of styrene and butadiene in each case.

The range of preferable molecular weight is the same as that described above.

As for preferable latices of styrene/butadiene/acid copolymers according to the invention, mentioned are P-3 to P-8, and P-15 as described above, and LACSTAR-3307B, 7132C and Nipol Lx416 which are commercially available.

To the organic silver salt-containing layer of the photosensitive material according to the invention, hydrophilic polymers such as gelatin, polyvinyl alcohol, methyl cellulose, hydroxypropyl cellulose and carboxymethyl cellulose may be added according to necessity. A quantity of each of these hydrophilic polymers to be added is preferably 30% by mass or less, and more preferably 20% by mass or less, based on a total mass of the binder in the organic silver salt-containing layer.

It is preferable that the layer containing the organic silver salt (namely, an image-forming layer) according to the invention is formed using a polymer latex. As for a quantity of the binder in the layer containing the organic silver salt, a weight ratio of a total binder/organic silver salt is preferably in the range or from 1/10 to 10/1, more preferably in the range of from 1/3 to 5/1, and still more preferably in the range of from 1/1 to 3/1.

Further, the layer containing the organic silver salt ordinarily acts as a photosensitive layer (an emulsion layer) in which a photosensitive silver halide is contained as a photosensitive silver salt. In such a case, a weight ratio of the total binder/silver halide is preferably in the range of from 400 to 5, and more preferably in the range of from 200 to 10.

The entire binder quantity in the image-forming layer according to the invention is preferably in the range of from 0.2 $g/m^2$ to 30 $g/m^2$, more preferably in the range of from 1 $g/m^2$ to 15 $g/m^2$, and still more preferably in the range of from 2 $g/m^2$ to 10 $g/m^2$. To the image-forming layer according to the invention, a cross-linking agent for causing cross-linking, a surfactant for improving coating properties or the like may be added.

(Preferable Solvent for Coating Liquid)

According to the invention, a solvent (for the purpose of simplicity, a solvent and a dispersing medium are unanimously expressed as a solvent) of a coating solution for an organic silver salt-containing layer of the photosensitive material is preferably an aqueous solvent containing 30% by mass or more of water. As for components other than water, any types of water-miscible organic solvents such as methyl alcohol, ethyl alcohol, isopropyl alcohol, methyl Cellosolve, ethyl Cellosolve, dimethyl formamide, and ethyl acetate may be used. A water content of such a solvent for the coating liquid is preferably 50% by mass or more, and more preferably 70% by mass or more. Examples of preferable solvent compositions include, taking a case of water for granted, water/methyl alcohol=90/10, water/methyl alcohol=70/30, water/methyl alcohol/dimethyl formamide=80/15/5, water/methyl alcohol/Ethyl Cellosolve=85/10/5 and water/methyl alcohol/isopropyl alcohol=85/10/5 (numerical values indicated in terms of "% by mass").

2-1-6. Antifoggant

As for antifoggants, stabilizers and stabilizer precursors according to the invention, compounds as described in paragraph [0070] of JP-A No. 10-62899, pp. 20 (line 57) to 21 (line 7) of EP-A No. 0803764, JP-A Nos. 9-281637 and 9-329864, U.S. Pat. No. 6,083,681, and EP-A No. 1048975 are mentioned. Further, favorable antifoggants according to the invention are organic halide materials. As for these materials, mentioned are those described in paragraphs [0111] to [0112] of JP-A No. 11-65021. In particular, organic halogen compounds represented by the general formula (P) in JP-A No. 2000-284399, organic polyhalogen compounds represented by the general formula (II) in JP-A No. 10-339934 and organic polyhalogen compounds described in JP-A Nos. 2001-31644 and 2001-33911 are preferred.

(Organic Polyhalogen Compound)

Preferable organic polyhalogen compounds according to the invention are now described in detail below.

The preferable organic polyhalogen compounds according to the invention are compounds represented by the following formula (H):

$$Q\text{-}(Y)n\text{-}C(Z_1)\text{-}(Z_2)X \quad (H)$$

wherein Q represents at least one group selected from the group consisting of an alkyl group, an aryl group and a heterocyclic group; Y represents a divalent linking group; n represents 0 or 1; $Z_1$ and $Z_2$ each independently represent a halogen atom; and X represents a hydrogen atom or an electron-attracting group.

In formula (H), Q preferably represents an aryl or a heterocyclic group. When Q represents a heterocyclic group, a nitrogen-containing heterocyclic group containing one or two nitrogen atoms therein is preferable whereupon any one of 2-pyridyl group and 2-quinolino group is particularly preferable. Whereas, when Q represents an aryl group, Q preferably represents a phenyl group substituted by an electron-attracting group in which the Hammet's substituent constant up has a positive value. In regard to the Hammet's substituent constant, for example, Journal of Medicinal Chemistry, Vol. 16, No. 11, pp. 1207 to 1216 (1973) may be referred to. Examples of such electron-attracting groups include a halogen atom (e.g., a fluorine atom (σp value: 0.06)), a chlorine atom (σp value: 0.23), a bromine atom (σp value: 0.23) and an iodine atom (σp value: 0.18)), a trihalomethyl group (e.g., a tribromomethyl group (σp value: 0.29), a trichloromethyl group (σp value: 0.33) and a trifluoromethyl group (σp value: 0.54)), a cyano group (σp value: 0.66), a nitro group (σp value: 0.78), an aliphatic, aryl or a heterocyclic sulfonyl group (for example, a methane sulfonyl group (σp value: 0.72)), an aliphatic, aryl or a heterocyclic acyl group (e.g., an acetyl group (σp value: 0.50) and a benzoyl group (σp value: 0.43)), an alkynyl group (e.g., a group of C═CH (σp value: 0.23)), an aliphatic, aryl or a heterocyclic oxycarbonyl group (e.g., a methoxycarbonyl group (σp value: 0.45) and a phenoxycarbonyl group (σp value; 0.44)), a carbamoyl group (σp value: 0.36), a sulfamoyl group (σp value: 0.57), a sulfoxide group, a heterocyclic group and a phosphoryl group. The up value is preferably in the range of from 0.2 to 2.0, and more preferably in the range of from 0.4 to 1.0. Particularly preferable examples of such electron-attracting groups include a carbamoyl group, an alkoxycarbonyl group, an alkylsulfonyl group, and an alkylphosphoryl group whereupon a carbamoyl group is most preferable among other things.

In formula (H), X preferably represents an electron-attracting group, and more preferably at least one atom or group selected from the group consisting of: a halogen atom, an aliphatic, aryl or a heterocyclic sulfonyl group, an aliphatic, aryl or a heterocyclic acyl group, an aliphatic, aryl or a heterocyclic oxycarbonyl group, a carbamoyl group and a sulfamoyl group whereupon a halogen atom is particularly preferred among other things.

Among such halogen atoms, a chlorine atom, a bromine atom and an iodine atom are preferable whereupon a chlorine atom and a bromine atom are more preferable and, further, a bromine atom is particularly preferable.

In formula (H), Y preferably represents at least one group selected from the group consisting of: —C(═O)—, —SO—, and —$SO_2$— whereupon —C(═O)— and —$SO_2$— are more preferable and, further, —$SO_2$— is particularly preferable.

In formula (H), n represents 0 or 1 whereupon 1 is preferable.

Specific examples of compounds represented by formula (H) according to the invention are described below.

(H-1)

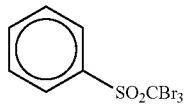

(H-2)

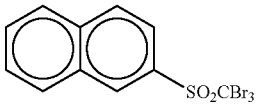

(H-3)

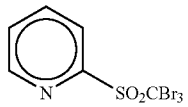

(H-4)

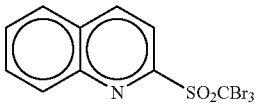

(H-5)

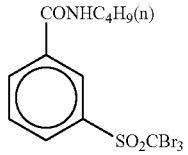

(H-6)

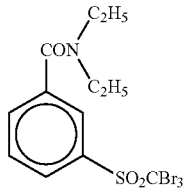

(H-7)

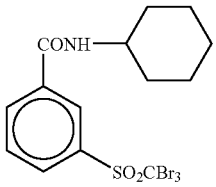

-continued (H-8)

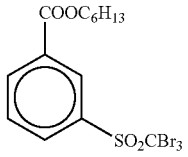

(H-9)

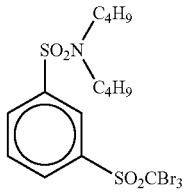

(H-10)

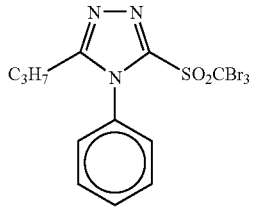

(H-11)

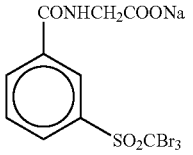

(H-12)

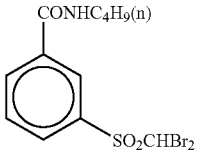

(H-13)

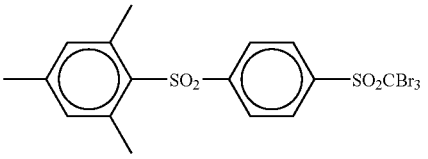

(H-14)

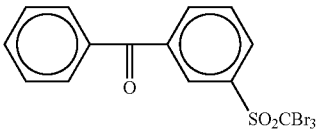

(H-15)

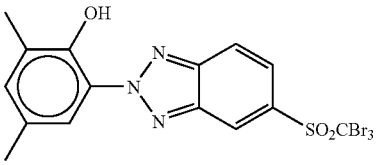

As for other polyhalogen compounds according to the invention than those as described above, mentioned are compounds as described in JP-A Nos. 2001-31644, 2001-56526 and 2001-209145.

The compound represented by formula (H) according to the invention is used preferably in the range of from $10^{-4}$ mol to 1 mol, more preferably in the range of from $10^{-3}$ mol to 0.5 mol, and still more preferably in the range of from $1\times10^{-2}$ mol to 0.2 mol, based on 1 mol of non-photosensitive silver salt in the image-forming layer.

As for methods for allowing the antifoggants to be contained in the photosensitive material, the same methods as those as described in the foregoing reducing agent are applicable whereupon even organic polyhalogen compounds are preferably added in a solid fine grain dispersion state.

(Other Antifoggants)

As for other antifoggants, a mercury (II) salt as described in paragraph [0113] of JP-A No. 11-65021, benzoic acids as described in paragraph [0114], ibid., a salicylic acid derivative as described in JP-A No. 2000-206642, a formalin scavenger compound represented by the general formula (S) in JP-A No. 2000-221634, a triazine compound related to claim 9 of JP-A No. 11-352624, compounds represented by the general formula (III) of JP-A No. 6-11791, 4-hydoxy-6-methyl-1,3,3a,7-tetrazaindene and the like are mentioned.

The photothermographic material according to the invention may contain an azolium salt for the purpose of inhibiting fog. Examples of such azolium salts include compounds represented by the general formula (XI) as described in JP-A No. 59-193447, compounds as described in Japanese Patent Publication No. 55-12581, and compounds represented by the general formula (II) as described in JP-A No. 60-153039. The azolium salt may be added in any part of the photosensitive material; however, as for a layer to be added with the azolium salt, the layer on a face having the photosensitive layer is preferable, and the layer containing the organic silver salt is more preferable. Timing of adding the azolium salt may be in any step during the preparation of a coating solution. When the azolium salt is added to the layer containing the organic silver salt, the azolium salt may be added in any step of from preparation of the organic silver salt to preparation of a coating solution; however, the azolium salt is preferably added during a period of from after the preparation of the organic silver salt to immediately before a coating operation. As for methods for adding the azolium salt, any addition method, such as that in a powder state, a solution state or a fine grain dispersion state thereof, may be adopted. The azolium salt may also be added in a state of solution mixed with other additives such as a sensitizing dye, a reducing agent and a color toning agent. According to the invention, a quantity of the azolium salt to be added may be optional; however, it is, based on 1 mol of silver, preferably in the range of from $1\times10^{-6}$ mol to 2 mol, and more preferably in the range of from $1\times10^{-3}$ mol to 0.5 mol.

2-1-7. Other Additives

1) Mercapto, Disulfide, and Thiones

According to the invention, for the purpose of controlling development by inhibiting or accelerating the development, improving spectral sensitization efficiency, improving storage properties before and after the development and the like, at least one compound selected from the group consisting of: a mercapto compound, a disulfide compound and a thione compound can be incorporated. Compounds as described in paragraphs [0067] to [0069] of JP-A No. 10-62899, compounds represented by the general formula (I) of JP-A No. 10-186572 and specific examples thereof as described in paragraphs [0033] to [0052], ibid., and compounds as described in page 20, lines 36 to 56 of EP-A No. 0803764 can be cited. Among other things, mercapto-substituted heteroaromatic compounds as described in, for example, JP-A Nos. 9-297367, 9-304875 and 2001-100358, Japanese Patent Application Nos. 2001-104213 and 2001-104214 are preferable.

2) Toning Agent

In the photothermographic material according to the invention, a toning agent is preferably added. Such toning agents are described in paragraphs [0054] to [0055] of JP-A No. 10-62899, page 21, lines 23 to 48 of EP-A No. 0803764, JP-A Nos. 2000-356317 and 2000-187298. In particular, phthalazinones (such as phthalazinone, phthalazinone derivatives or metal salts thereof, for example, 4-(1-naphthyl) phthalazinone, 6-chlorophthalazinone, 5,7-dimethoxy phthalazinone and 2,3-dihydro-1,4-phthalazinedione); combinations of phthalazinones and phthalic acids (for example, phthalic acid, 4-methylphthalic acid, 4-nitrophthalic acid, diammonium phthalate, sodium phthalate, potassium phthalate and tetrachlorophthalic acid anhydride); phthalazines (such as phthalazine, phthalazine derivatives or metal salts thereof, for example, 4-(1-naphthyl) phthalazine, 6-isopropyl phthalazine, 6-t-butyl phthalazine, 6-chlorophthalazine, 5,7-dimethoxyphthalazine and 2,3-dihydrophthalazine), combinations of phthalazines and phthalic acids are preferable whereupon any combinations of phthalazines and phthalic acids are particularly preferable. Among other things, a combination of 6-isopropylphthalazine and phthalic acid or 4-methylphthalic acid is particularly preferred.

3) Plasticizer and Lubricant

Plasticizers and lubricants employable in the photothermographic material according to the invention are described in paragraph [0117] of JP-A No. 11-65021. Slipping agents are described in paragraphs [0061] to [0064] of JP-A No. 11-84573, and paragraphs [0049] to [0062] of Japanese Patent Application No. 11-106881.

4) Dye and Pigment

From the standpoint of improving color tones, preventing an interference fringe pattern to be generated by laser light exposure, and preventing irradiation, various types of dyes and pigments (for example, C. I. Pigment Blue 60, C. I. Pigment Blue 64, and C. I. Pigment Blue 15:6) can be used in the photosensitive layer according to the invention. These dyes and pigments are described in detail, for example, in WO98/36322, JP-A Nos. 10-268465, and 11-338098.

5) Ultra-High Contrast Agent

For the purpose of forming an ultra-high contrast image that is applicable to making a printing plate, an ultra-high contrast agent is preferably added to an image-forming layer. As for such ultra-high contrast agents, addition methods thereof, and respective quantities thereof to be added, mentioned are compounds described in paragraph [0118] of JP-A No. 11-65021, and paragraphs [0136] to [0193] of JP-A No. 11-223898, compounds represented by the general formula (H), the general formulas (1) to (3) and the general formulas (A) and (B) in Japanese Patent Application No. 11-87297, and compounds represented by the general formulas (III) to (V) in Japanese Patent Application No. 11-91652 (specifically, compounds denoted by Chemicals 21 to 24). Further, hard gradation accelerators are also described in paragraph [0102] of JP-A No. 11-65021, and paragraph [0194] and [0195] of JP-A No. 11-223898.

When formic acid or a salt thereof is used as a strong fogging substance, the fogging substance is contained on a side having the image-forming layer containing the photosensitive silver halide, based on 1 mol of silver, preferably in a quantity of 5 mmol or less, and more preferably in a quantity of 1 mmol or less.

When the ultra-high contrast agent is used in the photothermographic material according to the invention, it is preferable to use in combination with an acid formed by hydration of phosphorus pentoxide or a salt thereof. As for such acids formed by hydration of phosphorus pentoxide or the salts thereof, mentioned are meta-phosphoric acid (and salts thereof, pyro-phosphoric acid (and salts thereof), ortho-phosphoric acid (and salts thereof), triphosphoric acid (and salts thereof), tetraphosphoric acid (and salts thereof), and hexameta-phosphoric acid (and salts thereof). Acids formed by hydration of phosphorus pentoxide or the salts thereof which are particularly preferably used are ortho-phosphoric acid (and salts thereof) and hexameta-phosphoric acid (and salts thereof). Specific examples of the salts include sodium ortho-phosphate, sodium dihydrogen ortho-phosphate, sodium hexameta-phosphate and ammonium hexameta-phosphate.

A quantity of the acid formed by hydration of phosphorus pentoxide or the salt thereof to be used (in terms of a coated quantity based on 1 $m^2$ of the photosensitive material) may be a desired quantity, depending on properties of sensitivity, fog, and the like; however, it is preferably in the range of from 0.1 $mg/m^2$ to 500 $mg/m^2$, and more preferably in the range of from 0.5 $mg/m^2$ to 100 $mg/m^2$.

The reducing agents, the hydrogen bond-forming compounds, development accelerators, and polyhalogen compounds according to the invention are preferably used each in a form of solid dispersion whereupon a preferable method for preparing the solid dispersion is described in JP-A No. 2002-55405.

2-1-8. Preparation and Application of Coating Solution

A temperature at which the coating solution for the image-forming layer according to the invention is prepared is preferably in the range of from 30° C. to 65° C., more preferably from 35° C. to less than 60° C., and still more preferably from 35° C. to 55° C. It is also preferable that the temperature of the coating solution for the image-forming layer immediately after addition of the polymer latex is maintained in the range of from 30° C. to 65° C.

2-2. Layer Constitution and Layer Component

The image-forming layer according to the invention is constituted with one or more layers on the support. When the image-forming layer is made up of one layer, it comprises an organic silver salt, a photosensitive silver halide, a reducing agent and a binder and optionally, additional materials such as a toning agent, a covering aid, and any other auxiliaries. Then the image-forming layer is made of a plurality of layers, an organic silver salt and a photosensitive silver halide are allowed to be contained in a first image-forming layer (ordinarily, a layer adjacent to the support) and any other components are allowed to be contained in a second image-forming layer or both of the first and second image-forming layers. Constitution of a multi-color photothermographic material may include a combination of these two layers per color or one layer containing all components therein as described in U.S. Pat. No. 4,708,928.

In a case of a multi-dye multi-color photothermographic material, respective emulsion layers are, as described in U.S. Pat. No. 4,460,681, ordinarily maintained in a separate manner from one another by being provided with a functional or non-functional barrier layer between any two of the respective photosensitive layers.

The photothermographic material according to the invention may contain a non-photosensitive layer in addition to the image-forming layer. The non-photosensitive layer may be classified according to its position as follows; (a) a surface protective layer formed on the image-forming layer (on a farther side from a support), (b) an intermediate layer formed between any two of a plurality of image-forming layers or between the image-forming layer and the protective layer, (c) an undercoat layer formed between the image-forming layer and the support, and (d) a back layer formed on a side of the support opposite to the image-forming layer.

Further, a layer acting as an optical filter can be formed in the photosensitive material as a layer classified in the above-described (a) or (b). An antihalation layer is formed in the photosensitive material as a layer classified in the above-described (c) or (d).

1) Surface Protective Layer

The photothermographic material according to the invention may have a surface protective layer for the purpose of preventing adhesion of the image-forming layer and the like. The surface protective layer may be of a single layer or of a plurality of layers. Such surface protective layers are described in paragraphs [0119] and [0120] of JP-A Nos. 11-65021, and 2000-171936.

As for binders for the surface protective layer according to the invention, gelatin is preferably used, and polyvinyl alcohol (PVA) is also preferably used solely or in combination with gelatin. As for gelatin, inert gelatin (e.g., Nitta Gelatin 750), phthalated gelatin (e.g., Nitta Gelatin 801) and the like can be used. As for PVA, those described in paragraphs [0009] to [0020] of JP-A No. 2000-171936 can be cited. PVA-105 as a completely saponified PVA, PVA-205 and PVA-335 as partly saponified PVA, and MP-203 as a modified polyvinyl alcohol (these are manufactured by Kuraray Co., Ltd.) are preferably mentioned. A quantity (based on 1 $m^2$ of the support) of polyvinyl alcohol to be coated of the protective layer (per one layer) is preferably in the range of from 0.3 $g/m^2$ to 4.0 $g/m^2$, and more preferably in the range of from 0.3 $g/m^2$ to 2.0 $g/m^2$.

A quantity (based on 1 $m^2$ of the support) of the entire binder (inclusive of water-soluble polymer and latex polymer) to be coated of the surface protective layer (per layer) is preferably in the range of from 0.3 $g/m^2$ to 5.0 $g/m^2$, and more preferably in the range of from 0.3 $g/m^2$ to 2.0 $g/m^2$.

2) Antihalation Layer

In the photothermographic material according to the invention, an antihalation layer can be formed at the remotest side from a light source relative to the photosensitive layer.

Such antihalation layers are described, for example, in paragraphs [0123] and [0124] of JP-A No. 11-65021, JP-A Nos. 11-223898, 9-230531, 10-36695, 10-104779, 11-231457, 11-352625, and 11-352626.

The antihalation layer contains an antihalation dye that absorbs light having an exposure wavelength. When such an exposure wavelength is in an infrared region, a dye absorbing an infrared ray may be used; on this occasion, the dye not absorbing light in a visible wavelength region is preferred.

When antihalation is performed using a dye absorbing light in the visible wavelength region, it is preferred that color of the dye does not substantially remain after an image is formed; it is also preferable that a device to decolorize the dye by heat in thermal development is used; and it is particularly preferable that a thermally decolorizable dye and a base precursor are added to the non-photosensitive layer to allow the resultant non-photosensitive layer to function as an antihalation layer. Relevant techniques are described in JP-A No. 11-231457 and the like.

A quantity of the decolorizable dye to be added is determined depending on use purposes of the dye. Ordinarily, the decolorizable dye is used in a quantity such that an optical density (absorbance) measured at the objective wavelength exceeds 0.1. The optical density is preferably in the range of from 0.15 to 2 and more preferably in the range of from 0.2 to 1. A quantity of the decolorizable dye for obtaining the above-described optical density is ordinarily in the range of from about 0.001 $g/m^2$ to about 1 $g/m^2$.

When the dye is decolorized in such a way, the optical density after thermal development is performed can be lowered to 0.1 or less. Two or more types of decolorizable dyes may be used in combination in a thermally decolorizable-type recording material or in the photothermographic material. In a similar way, two or more types of base precursors may be used in combination.

In the thermal decolorization using such a decolorizable dye and a base precursor as described above, it is preferable from the viewpoint of thermal decolorization properties and the like that a substance (e.g., diphenylsulfone, or 4-chlorophenyl (phenyl) sulfone) which decreases a melting point by 3° C. or more when mixed with the base precursor as described in JP-A No. 11-352626, 2-naphthyl benzoate, or the like is simultaneously used.

3) Back Layer

Back layers to be applicable to the invention are described in paragraphs [0128] to [0130] of JP-A No. 11-65021.

According to the invention, a coloring agent having an absorption maximum in the wavelength range of from 300 nm to 450 nm may be added for the purpose of improving silver color tone and improving a change in an image over time. Such coloring agents are described in, for example, JP-A Nos. 62-210458, 63-104046, 63-103235, 63-208846, 63-306436, 63-314535, 1-61745, and 2001-100363.

The coloring agents are each added ordinarily in the range of from 0.1 $mg/m^2$ to 1 $g/m^2$ whereupon, as a layer to be added, a back layer provided on an opposite side of the photosensitive layer is preferred.

In order to adjust a basic color tone, it is preferable to use a dye having an absorption peak in the wavelength range of from 580 nm to 680 nm. As for dyes for this purpose, an oil-soluble dye of azomethine-type having a small absorption intensity in a short wavelength side as described in JP-A Nos. 4-359967 and 4-359968, and a water-soluble dye of phthalocyanine type as described in Japanese Patent Application No. 2002-96797 are preferable. Dyes for this purpose may be added to any layer and is preferably added to the non-photosensitive layer on the side of an emulsion face or to the side of a back face.

It is preferable that the photothermographic material according to the invention which comprises a photosensitive layer having at least one layer of silver halide emulsion on one side of the support and a back layer on the other side thereof is a so-called one-side photosensitive material.

4) Matting Agent

According to the invention, it is preferred to add a matting agent to the material for improving conveying properties. Such matting agents are described in paragraphs [0126] and [0127] of JP-A No. 11-65021. A quantity of the matting agent to be added is preferably in the range of from 1 $mg/m^2$ to 400 $mg/m^2$, and more preferably in the range of from 5 $mg/m^2$ to 300 $mg/m^2$, based on 1 $m^2$ of the photosensitive material in each case.

The matting agent according to the invention is allowed to be in a regular shape or in a irregular shape, but is preferably in a regular shape whereupon that in spherical form is preferably used. An average grain size thereof is preferably in the range of from 0.5 μm to 10 μm, more preferably in the range of from 1.0 μm to 8.0 μm, and still more preferably in the range of from 2.0 μm to 6.0 μm. Further, a size distribution fluctuation coefficient is preferably 50% or less, more preferably 40% or less, and still more preferably 30% or less. The term "fluctuation coefficient" as used herein refers to a value calculated by the following expression:

Standard Deviation of Grain Diameter/Average Grain Diameter×100

It is also preferable that two types of matting agents each having a small fluctuation coefficient and having a ratio of the average grain diameters therebetween of more than 3 are simultaneously used.

Further, as a matting degree of an emulsion face, any degree is permissible insofar as a so-called star dust-like defect does not occur; however, a Beck's smoothness is preferably in the range of from 30 seconds to 2000 seconds, and particularly preferably in the range of from 40 seconds to 1500 seconds. The Beck's smoothness may readily be obtained in accordance with "Testing Method for Smoothness of Paper and Paperboard by Beck's Tester" defined by the Japanese Industrial Standards (JIS) P8119 and the TAPPI Standard Method T479.

According to the invention, the Beck's smoothness as a matting degree for the back layer is preferably in the range of from 10 seconds to 1200 seconds, more preferably from 20 seconds to 800 seconds, and still more preferably from 40 seconds to 500 seconds.

According to the invention, the matting agent is preferably contained in an outermost surface layer, a layer functioning as the outermost surface layer, or a layer close to the outer surface layer which functions as the so-called protective layer.

5) Polymer Latex

When the photothermographic material according to the invention is used for printing in which, particularly, size changes cause a problem, a polymer latex is preferably used in the surface protective layer or the back layer. Such polymer latices are described in, for example, "Synthetic Resin Emulsion", compiled by Taira Okuda and Hiroshi Inagaki, Kobunshi Kankokai (Polymer Publishing) (1978), "Application of Synthesized Latex", compiled by Takaaki Sugimura, Yasuo Kataoka, Soichi Suzuki and Keiji Kasahara, Kobunshi Kankokai (Polymer Publishing) (1993), and Soichi Muroi, "Chemistry of Synthesized Latex", Kobunshi Kankokai (Polymer Publishing) (1970). Specific examples of the polymer latices include a latex of a methyl methacrylate (33.5% by mass)/ethyl acrylate (50% by mass)/methacrylic acid (16.5% by mass) copolymer, a latex of a methyl methacrylate (47.5% by mass)/butadiene (47.5% by mass)/itaconic acid (5% by mass) copolymer, a latex of an ethyl acrylate/methacrylic acid copolymer, a latex of a methyl methacrylate (58.9% by mass)/2-ethylhexyl acrylate (25.4% by mass)/styrene (8.6% by mass)/2-hydroxyethyl metacrylate (5.1% by mass)/acrylic acid (2.0% by mass) copolymer, and a latex of a methyl methacrylate (64.0% by mass)/styrene (9.0% by mass)/butyl acrylate (20.0% by mass)/2-hydroxyethyl metacrylate (5.0% by mass)/acrylic acid (2.0% by mass) copolymer. Further, as a binder for use in the surface protective layer, a combination of polymer lattices as described in Japanese Patent Application No. 11-6872, a technique as described in paragraphs [0021] to [0025] of JP-A, No. 2000-267226, paragraphs [0027] and [0028] of Japanese Patent Application No. 11-6872, or paragraphs [0023] to [0041] of JP-A No. 2000-19678 may be adopted.

A proportion of the polymer latex in the surface protective layer is preferably in the range of from 10% by mass to 90% by mass, and particularly preferably in the range of from 20% by mass to 80% by mass, based on a total binder mass.

6) Film Surface pH

In the photothermographic material according to the invention, a film surface pH before the thermal development is preferably 7.0 or less, and more preferably 6.6 or less. A lower limit is not particularly restricted but is approximately 3. A most preferable pH is in the range of from 4 to 6.2. For adjusting the film surface pH, it is preferred from the viewpoint of lowering the film surface pH that an organic acid such as a phthalic acid derivative, a non-volatile acid such as sulfuric acid or a volatile base such as ammonia is used. Particularly, ammonia is preferable for achieving a low film surface pH, because ammonia is particularly apt to be vaporized and may be removed during a coating step or before being subjected to the thermal development. Further, it is also preferred that a non-volatile base such as sodium hydroxide, potassium hydroxide or lithium hydroxide is used with ammonia in combination. Furthermore, a measuring method of the film surface pH is described in paragraph [0123] of JP-A No. 2000-284399.

7) Hardening Agent

A hardening agent may be used in each of the photosensitive layer, the protective layer, the back layer and the like according to the invention. Examples of such hardening agents are found in various methods described in T. H. James, The Theory of the Photographic Process, 4th edition, Macmillan Publishing Co., Inc., pp. 77 to 87 (1977). In addition to compounds such as chrome alum, sodium salt of 2,4-dichloro-6-hydroxy-s-triazine, N,N-ethylene bis(vinylsulfone acetamide) and N,N-propylene bis(vinylsulfone acetamide), polyvalent metal ions as described in the above-cited reference, page 78 and the like, polyisocyanates as described in U.S. Pat. No. 4,281,060, JP-A No. 6-208193 and the like, epoxy compounds as described in, for example, U.S. Pat. No. 4,791,042, and vinyl sulfone-type compounds as described in, for example, JP-A No. 62-89048 are preferably used.

The hardening agent is added as a solution. A time point of adding such a hardening agent solution into the coating solution for the protective layer is in a period of from 180 minutes before coating to immediately before coating, and preferably in a period of from 60 minutes before coating to 10 seconds before coating; however, mixing methods and mixing conditions for the hardening agent solution are not particularly limited insofar as the effects according to the invention are sufficiently exerted. Specific examples of mixing methods include a mixing method using a tank in which an average staying time calculated from an addition flow rate and a feeding flow rate to a coater is adjusted to be a desired time, and a mixing method using a static mixer described in N. Harnby, M. F. Edwards and A. W. Nienow, Techniques of Mixing Liquids, translated by Koji Takahashi, Nikkan Kogyo Shimbun (1989), Chapter 8 an the like.

8) Surfactant

Surfactants applicable to the invention are described in paragraph [0132] of JP-A No. 11-65021; solvents in paragraph [0133], ibid.; supports in paragraph [0134], ibid.; antistatic agents or electrically conductive layers in paragraph [0135], ibid.; methods for obtaining color images in paragraph [0136], ibid.; and slipping agents in paragraphs [0061] to [0064] of JP-A No. 11-84573 or paragraphs [0049] to [0062] of Japanese Patent Application No. 11-106881.

According to the invention, fluorine-type surfactants may preferably be used. Specific examples of preferable fluorine-type surfactants include compounds as described in, for example, JP-A Nos. 10-197985, 2000-19680, and 2000-214554. Also, polymeric fluorine-type surfactants as described in JP-A 9-281636 are preferably used. In the photothermographic material according to the invention, the fluorine-type surfactants as described in JP-A No. 2002-82411 and Japanese Patent Application Nos. 2001-242357 and 2001-264110 are particularly preferably used. When a coating operation is performed by using a water-based coating liquid, the fluorine-type surfactants as described particularly in Japanese Patent Application Nos. 2001-242357 and 2001-264110 are preferable from the standpoints of electrostatic adjusting capability, stability of a coated face state and a slipping property. Among other things, the fluorine-type surfactants as described in Japanese Patent Application No. 2001-264110 is most preferable, since a high electrostatic adjusting capability thereof allows a quantity thereof to be used to be small.

The fluorine-type surfactant according to the invention may be used either in the emulsion face or the back face whereupon it is preferable that it is used on both faces. Further, it is more preferable to use it in combination with an electrically conductive layer containing the above-described metal oxides. In this case, even when a quantity of the fluorine-type surfactant on the face having the electrically conductive layer is reduced or removed, a sufficient effect may be obtained.

A quantity of the fluorine-type surfactant to be used in each of the emulsion and back faces is preferably in the range of from 0.1 $mg/m^2$ to 100 $mg/m^2$, more preferably in the range of from 0.3 $mg/m^2$ to 30 $mg/m^2$, and still more preferably in the range of from 1 $mg/m^2$ to 10 $mg/m^2$. The fluorine-type surfactant as described in Japanese Patent Application No. 2001-264110 has a large effect whereupon it is used preferably in the range of from 0.01 $mg/m^2$ to 10 $mg/m^2$ and more preferably in the range of from 0.1 $mg/m^2$ to 5 $mg/m^2$.

9) Antistatic Agent

The photothermographic material according to the invention preferably has an electrically conductive layer containing a metal oxide or an electrically conductive polymer. The antistatic layer may simultaneously function as an undercoat layer or a surface protective layer of the back layer or be separately provided. As for electrically conductive materials for the antistatic layer, a metal oxide in which an electrically conductive property has been enhanced by being incorporated with oxygen deficiency or a metallic hetero atom is preferably used. Preferable examples of such metal oxides include ZnO, $TiO_2$, and $SnO_2$. It is preferable that ZnO is added with Al, or In; $SnO_2$ is added with, for example, Sb, Nb, P, or a halogen atom; and $TiO_2$ is added with, for example, Nb, or Ta. Sb-added $SnO_2$ is particularly preferable. A quantity of a hetero atom to be added is preferably in the range of from 0.01% by mol to 30% by mol and more preferably in the range of from 0.1% by mol to 10% by mol. A shape of the metal oxide may be in any one of spherical form, acicular form, or tabular form. In order to secure an effect of imparting the electrically conductive property, the metal oxide is preferably in acicular form in which a ratio of long axis/short axis is 2.0 or more, and preferably from 3.0 to 50. A quantity of the metal oxide to be used is preferably in the range of from 1 $mg/m^2$ to 1000 $mg/m^2$, more preferably in the range of from 10 $mg/m^2$ to 500 $mg/m^2$ and still more preferably in the range of from 20 $mg/m^2$ to 200 $mg/m^2$. The antistatic layer according to the invention may be provided either on the emulsion face side or the back face side; however, the antistatic layer is preferably provided between the support and the back layer. Specific examples of the antistatic layers according to the invention include those as described in paragraph [0135] of JP-A No. 11-65021, JP-A Nos. 56-143430, 56-143431, 58-62646, and 56-120519, paragraphs [0040] to [0051] of JP-A No. 11-84573, U.S. Pat. No. 5,575,957, and paragraphs [0078] to [0084] of JP-A No. 11-223898.

10) Support

As for transparent supports, polyester, particularly, polyethylene terephthalate, which has been subjected to a thermal treatment in the temperature range of from 130° C. to 185° C. in order to relax residual internal stress generated when being biaxially stretched and to eliminate the strain of thermal contraction generated when subjected to the thermal treatment, is preferably used. In the case of the photothermographic materials for medical use, the transparent support may be colored with a blue dye (e.g., Dye-1 as described in JP-A No. 8-240877) or may not be colored. In the supports, undercoat techniques of a water-soluble polyester as described in JP-A No. 11-84574, a styrene-butadiene copolymer as described in JP-A No. 10-186565, vinylidene chloride copolymers as described in JP-A No. 2000-39684, paragraphs [0063] to [0080] of Japanese Patent Application No. 11-106881 and the like are preferably applied. When the emulsion layer or a back layer is provided on the support, a moisture content of the support is preferably 0.5% by weight or less.

11) Other Additives

To the photothermographic material according to the invention, an anti-oxidant, a stabilizing agent, a plasticizer, an ultraviolet ray-absorbing agent or a covering aid may further be added. Various types of these additives are added to either the photosensitive layer or the non-photosensitive layer. Concerning those additives, WO98/36322, EP-A No. 803764, JP-A Nos. 10-186567 and 10-18568 and the like may be referred.

12) Coating Method

The photothermographic material according to the invention may be applied by any method. Various types of coating operations may be used whereupon specific examples thereof include extrusion coating, slide coating, curtain coating, dip coating, knife coating, flow coating, and extrusion coating using such a kind of hopper as described in U.S. Pat. No. 2,681,294. Extrusion coating or slide coating as described in Stephen F. Kistler and Peter M. Schweizer, Liquid Film Coating, Chapman & Hall, pp. 399 to 536 (1997) is preferably used. In particular, slide coating is preferably used. Examples of shapes of slide coaters to be used for slide coating are described in the above-cited reference, pp. 427, FIG. 11*b*-1. Further, as desired, two or more layers can simultaneously be coated by methods described in the above-cited reference, pp. 399 to 536, U.S. Pat. No. 2,761,791 and BP-A No. 837,095. Particularly favorable methods according to the invention are those as described in JP-A Nos. 2001-194748, 2002-153808, 2002-153803, and 2002-182333.

It is preferable that a coating solution for the organic silver salt-containing layer according to the invention is a so-called thixotropic fluid. Techniques related to this fluid can be referred to JP-A No. 11-52509. In regard to the coating solution for the organic silver salt-containing layer according to the invention, a viscosity thereof at the shearing velocity of 0.1 $S^{-1}$ is preferably in the range of from 400 mPa·s to 100,000 mPa·s, and more preferably in the range of from 500 mPa·s to 20,000 mPa·s. Further, a viscosity at the shearing velocity of 1000 $S^{-1}$ is preferably in the range of from 1 mPa·s to 200 mPa·s, and more preferably in the range of from 5 mPa·s to 80 mPa·s.

When two types of liquid are mixed with each other at the time of preparing the coating liquid according to the invention, a known in-line mixer or in-plant mixer is preferably used. A preferable in-line mixer according to the invention is described in JP-A No. 2002-85948, while a preferable in-plant mixer according to the invention is described in JP-A No. 2002-90940.

The coating liquid according to the invention is preferably subjected to a defoaming treatment, in order to keep a coated face state to be favorable. A preferable method for the defoaming treatment according to the invention is described in JP-A No. 2002-66431.

When the coating liquid according to the invention is applied, it is preferable to eliminate electrostatic forces of a support, in order to prevent sticking of dirt, dust or the like to be caused by the electrostatic forces of the support. A preferable method for eliminating the electrostatic forces is described in JP-A 2002-143747.

According to the invention, when the coating liquid for the image-forming layer of non-setting type is dried, it is important to precisely control a drying air, and a drying temperature. A preferable drying method according to the invention is recited in detail in JP-A Nos. 2001-194749 and 2002-139814.

It is preferable that the photothermographic material according to the invention is subjected to a thermal treatment immediately after apply-dried, in order to enhance a film-forming property. A temperature of the thermal treatment is, in terms of film surface temperature, preferably in the range of from 60° C. to 100° C. while a period of heating time is preferably in the range of from 1 second to 60 seconds. More preferably, the film surface temperature is in the range of from 70° C. to 90° C. while the period of heating time is in the range of from 2 seconds to 10 seconds. A preferable heating method according to the invention can be referred to those as described in JP-A No. 2002-107872.

Further, in order to stably perform a continuous production of the photothermographic material according to the invention, a production method as described in JP-A Nos. 2002-156728 and 2002-182333 is favorably used.

The photothermographic material according to the invention is preferably of a mono-sheet type (a type capable of forming an image on the photothermographic material without using any other sheets such as an image-receiving material).

13) Packaging Material

It is preferable that the photosensitive material according to the invention is packed by a packaging material having at least one of a low oxygen transmittance and a low moisture transmittance in order to suppress changes of photographic properties thereof in storage before being used, or improving curling or a winding habit. The oxygen transmittance at 25° C. is preferably 50 ml/atm·m$^2$·day or less, more preferably 10 ml/atm·m$^2$·day or less, and still more preferably 1.0 ml/atm·m$^2$·day or less. The moisture transmittance is preferably 10 g/atm·m$^2$·day or less, more preferably 5 g/atm·m$^2$·day or less, and still more preferably 1 g/atm·m$^2$·day or less. Specific examples of packaging materials in which at least one of the oxygen transmittance and the moisture transmittance is low include those as described in JP-A Nos. 8-254793 and 2000-206653.

14) Other Employable Techniques

As for techniques employable in the phototermographic materials according to the invention, techniques described in the following references are further cited: EP-A Nos. 803764, and 883022, WO98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, from 10-186569 to 10-186572, 10-197974, 10-197982, 10-197983, from 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, from 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, and 11-343420, 2000-187298, 2000-10229, 2000-47345, 2000-206642, 2000-98530, 2000-98531, 2000-112059, 2000-112060, 2000-112104, 2000-112064, and 2000-171936.

In the case of the multi-color photothermographic material, respective emulsion layers are, as described in U.S. Pat. No. 4,460,681, ordinarily maintained in a separate manner from one another by being provided with a functional or non-functional barrier layer between any two of the respective photosensitive layers.

Constitution of a multi-color photothermographic material may comprise a combination of at least two layers of different colors or may comprise one layer containing all components therein as described in U.S. Pat. No. 4,708,928.

3. Image Forming Method 3-1. Exposure

The photosensitive material according to the invention may be exposed by any method; however, it is preferable to use laser light as an exposure source.

The silver halide emulsion having a high silver iodide content according to the invention has so far had a problem that sensitivity thereof is low. However, it has been found that the problem of such low sensitivity is solved by performing writing-in by means of such an intense irradiation as laser light whereupon image recording may be performed by a smaller energy than conventional. Thus, desired sensitivity may be attained by performing writing-in by strong light in a short period of time.

Particularly when a quantity of exposure which realizes a maximum density (Dmax) is provided, a quantity of light on a surface of the photosensitive material is preferably in the range of from 0.1 W/mm$^2$ tp 100 W/mm$^2$, more preferably in the range of from 0.5 W/mm$^2$ to 50 W/mm$^2$, and most preferably in the range of from 1 W/mm$^2$ to 50 W/mm$^2$.

As for laser light according to the invention, a gas laser ($Ar^+$, He—Ne, or He—Cd), a YAG laser, a dye laser, a semiconductor laser and the like are preferable. Further, a combination of the semiconductor laser and a second harmonic generating element or the like may also be used. Preferable laser is, although being determined in correspondence to a light-absorbing peak wavelength of a spectral sensitizing dye or the like of the photothermographic material, an He—Ne laser or a red semiconductor laser which radiates red to infrared light, or an Ar+, He—Ne, He—Cd laser, or a blue semiconductor laser which radiates blue to green light. In recent years, particularly, a module fabricated by unifying SHG (Second Harmonic Generator) element with the semiconductor laser, or the blue semiconductor laser has been developed, thereby rapidly attracting people's attention to a laser outputting device in a short wavelength region. Since the blue semiconductor laser is capable of performing ultra-fine image recording, increasing a recording density and obtaining a long-life and consistent output, it is expected that demand for the blue semiconductor laser will be increased.

The peak wavelength of the laser light is preferably in the range of from 300 nm to 500 nm, more preferably in the range of from 350 nm to 450 nm, and still more preferably in the range of from 370 nm to 430 nm.

The laser light is favorably used in a manner in which it is oscillated in a vertical multi-mode by a method such as a high frequency superimposition method.

3-2. Thermal Development

The photothermographic material according to the invention may be developed by any method. Ordinarily, a temperature of the photothermographic material which has imagewise been exposed is elevated to allow the photothermographic material to be developed. A developing temperature is preferably in the range of from 80° C. to 250° C., more preferably in the range of from 100° C. to 140° C., and still more preferably in the range of from 110° C. to 130° C.

A development time is preferably in the range of from 1 second to 60 seconds, more preferably in the range of from 3 seconds to 30 seconds, still more preferably in the range of from 5 seconds to 25 seconds, and particularly preferably in the range of from 7 seconds to 15 seconds.

As for thermal development systems, any one of a drum-type heater system and a plate-type heater system may be used whereupon the plate-type heater system is preferable. In regard to the thermal development systems utilizing the plate-type heater system, a method as described in JP-A No. 11-133572 is preferable. This method uses a thermal development apparatus for obtaining a visible image by allowing the photothermographic material, in which a latent image has been formed, to be in contact with a heating unit in a thermal developing section. The heating unit comprises a plate heater and a plurality of pressing rollers arranged along one surface of the plate heater such that they face to the surface thereof. The photothermographic material is allowed to pass through between the pressing rollers and the plate heater to be thermally developed. It is preferable that the plate heater is divided into 2 to 6 steps, and that the top step has a temperature lowered by approximately 1° C. to 10° C. For example, four sets of plate heaters which can each individually control temperatures thereof such that they become 112° C., 119° C., 121° C., and 120° C., respectively, are used. Such methods are also described in JP-A No. 54-30032. According to these methods, moisture and organic solvents contained in the photothermographic material may be removed out of a system, and deformation of the support of the photothermographic material caused by rapid heating may also be suppressed.

In order to down-sizing the thermal development apparatus and also to reduce the thermal development time, it is preferable that the heater may be controlled in a more stable manner and also that an exposure of a sheet of the photosensitive material starts from a leading part thereof and thermal development starts before the exposure is finished at a tailing part thereof. A preferable imager which may perform rapid processing according to the invention is described in, for example, Japanese Patent Application Nos. 2001-088832 and 2001-091114. When this imager is used, thermal development processing can be performed by a three-step plate-type heater system in which temperatures of three steps are controlled to be 107° C., 121° C., and 121° C., respectively whereupon an output time of a first sheet may be reduced to be about 60 seconds. In performing such rapid development processing, it is preferable that the photothermographic material which is high in sensitivity and is least influenced by an ambient temperature condition is used in a combination manner.

3-3. System

As for a laser imager having an exposure part and a thermal development part for the medical use, Fuji Medical Dry Laser Imager FM-DPL (available from Fuji Photo Film Co., Ltd.) may be mentioned. The FM-DPL is described in Fuji Medical Review No. 8, pp. 39 to 55. The techniques as described therein are applicable as a laser dry imager of the photothermographic material according to the invention. Further, the photothermographic material according to the invention may also be applied as a photothermographic material for the laser imager in "AD network" proposed by Fuji Film Medical which is a network system adapted to DICOM Standards.

4. Application of the Invention

The photothermographic material using a high silver iodide photographic emulsion according to the invention forms a black-and-white image based on a silver image; hence, it is preferred that the photothermographic material is used as a photothermographic material for medical use, as a photothermographic material for industrial photography, as a photothermographic material for printing use, and as a photothermographic material for COM (computer output microfilm).

EXAMPLES

The following specific examples are provided to further illustrate the invention, however, should not be interpreted as limiting it in any way.

Example 1

1. Preparation of PET Support and Undercoating 1-1. Film Forming

From terephthalic acid and ethylene glycol, PET was produced in an ordinary manner. PET thus produced had an intrinsic viscosity, IV, of 0.66, as measured in a phenol/tetrachloroethane ratio (6/4by mass) at 25° C. After pelletized, the PET was dried at 130° C. for 4 hours, melted at 300° C., and allowed to contain 0.04% by mass of Dye BB having a structure shown below, followed by extrusion through a T-die. After rapid cooling, a non-oriented film was obtained which had a thickness of 175 μm after thermal fixation.

Dye BB

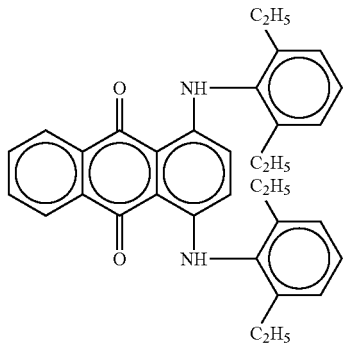

The resultant film was stretched 3.3 times in MD (machine direction) using a roll at different rotating speeds, then stretched 4.5 times in CD (cross direction) using a tenter. The temperatures for MD and CD stretchings were 110° C. and 130° C., respectively. Then, the film was thermally fixed at 240° C. for 20 seconds, and relaxed by 4% in CD at the same temperature. Subsequently, the chuck of the tenter was released, the both edges of the film was knurled, and the film was rolled up under 4 kg/cm$^2$ to give a rolled film having a thickness of 175 μm.

1-2. Corona Discharge Surface Treatment

Both surfaces of the support were subjected to corona discharge treatment at room temperature at a speed of 20 m/min, using a solid-state corona discharge system MODEL 6KVA manufactured by Pillar Technologies. From the data of the current and the voltage read from the system, the support was found to be processed at 0.375 kV·A·min/m$^2$. The frequency for the treatment was 9.6 kHz, and the gap clearance between an electrode and a dielectric roll was 1.6 mm.

1-3. Undercoating (1) Preparation of Coating Solution for Undercoat Layer

| | |
|---|---|
| Formulation (1) (for an undercoat layer at the side of providing an image-forming layer): | |
| Pesuresin A-520 (a 30 mass % solution) manufactured by Takamatsu Yushi KK | 59 g |
| Polyethylene glycol monononylphenyl ether (average ethylene oxide number = 8.5, a 10 mass % solution) | 5.4 g |
| Polymer microparticles (MP-1000, mean particle size: 0.4 μm) manufactured by Soken Chemical & Engineering Co., Ltd. | 0.91 g |
| Distilled water | 935 ml |
| Formulation (2) (for a first back layer): | |
| Styrene-butadiene copolymer latex (solid content: 40 mass %, styrene/butadiene ratio = 68/32 by mass) | 158 g |
| Sodium 2,4-Dichloro-6-hydroxy-S-triazine (a 8 mass % aqueous solution) | 20 g |
| Sodium laurylbenzenesulfonate (a 1 mass % aqueous solution) | 10 ml |
| Distilled water | 854 ml |
| Formulation (3) (for a second back layer): | |
| $SnO_2$/SbO (9/1 by mass, mean particle size: 0.038 μm, a 17 mass % dispersion) | 84 g |
| Gelatin (a 10% aqueous solution) | 89.2 g |
| Metolose TC-5 (a 2% aqueous solution) manufactured by Shin-etsu Chemical Industry Co., Ltd. | 8.6 g |
| MP-1000 manufactured by Soken Chemical & Engineering Co., Ltd. | 0.01 g |
| Sodium dodecylbenzenesulfonate (a 1 mass % aqueous solution) | 10 ml |
| NaOH (1 mass %) | 6 ml |
| Proxel (manufactured by ICI) | 1 ml |
| Distilled water | 805 ml |

(2) Undercoating

Both surfaces of the biaxially-oriented polyethylene terephthalate support (thickness: 175 μm) were subjected to corona discharge treatment in the same manner as above. One surface (to have an image-forming layer thereon) of the support was coated with a coating solution of the undercoat layer formulation (1) using a wire bar, and then dried at 180° C. for 5 minutes to provide a wet coated amount of 6.6 ml/m$^2$ (one surface). Next, the other surface (back surface) of the support was coated with a coating solution of the back layer formulation (2) using a wire bar, and then dried at 180° C. for 5 minutes to provide a wet coated amount of 5.7 ml/m$^2$. The thus-coated back surface was further coated with the back layer formulation (3) using a wire bar, and then dried at 180° C. for 6 minutes to provide a wet coated amount of 7.7 ml/m$^2$, to finally give an undercoated support.

2. Back Layer 2-1. Preparation of Coating Solution for Back Layer

1) Preparation of Base Precursor Microparticle Dispersion (a))

64 g of a base precursor compound 11, 28 g of diphenyl sulfone and 10 g of a surfactant DEMOLE N (manufactured by Kao Corporation) were admixed with 220 ml of distilled water, and the resulting mixture was milled in a sand mill (¼ GALLON SAND GRINDER manufactured by Imex) with beads. Thus, a dispersion (a) containing solid microparticles of the base precursor compound having a mean particle size of 0.2 μm was obtained.

2) Preparation of Dye Solid Microparticle Dispersion (a)

9.6 g of a cyanine dye compound 13 and 5.8 g of sodium p-dodecylbenzenesulfonate were admixed with 305 ml of distilled water, and the resulting mixture was milled in a sand mill (¼ GALLON SAND GRINDER manufactured by Imex) with beads. Thus, a dispersion containing solid microparticles of the dye having a mean particle size of 0.2 μm was obtained.

3) Preparation of Coating Solution for an Antihalation Layer 17 g of gelatin, 9.6 g of polyacrylamide, 70 g of the dispersion of base precursor microparticles (a), 56 g of the dispersion of the above-produced dye microparticles, 1.5 g of a monodispersion of polymethyl methacrylate microparticles (mean particle size: 8.0 μm, particle size standard deviation: 0.4), 0.03 g of benzoisothiazolinone, 2.2 g of sodium polyethylenesulfonate, 0.2 g of a blue dye compound 14, 3.9 g of a yellow dye compound 15, and 844 ml of water were admixed together to prepare a coating solution for an antihalation layer.

4) Preparation of Coating Solution for a Back Surface Protective Layer

A reaction vessel was maintained at 40° C., into which were charged 50 g of gelatin, 0.2 g of sodium polystyrenesulfonate, 2.4 g of N,N-ethylenebis(vinylsulfonacetamide), 1 g of sodium tert-octylphenoxyethoxyethanesulfonate, 30 mg of benzoisothiazolinone, 37 mg of fluorine-type surfactant (F-1), 0.15 mg of fluorine-type surfactant (F-2), 64 mg of fluorine-type surfactant (F-3), 32 mg of fluorine-type surfactant (F-4), 8.8 g of an acrylic acid/ethylacrylate copolymer (weight ratio of copolymerization: 5/95), 0.6 g of Aerosol OT (trade name; manufactured by American Cyanamid Company), 1.8 g of a liquid paraffin emulsion in terms of liquid paraffin, and 950 ml of water, to thereby prepare a coating solution for a back surface protective layer.

2-2. Coating of Back Layer

On a back surface side of the thus-undercoated support, the coating solution for antihalation layer was applied such that a coated quantity of solid fine grain dye came to be 0.04 g/m$^2$, and the coating solution for the back surface protective layer was applied in a simultaneous multi-layer manner such that a coated quantity of gelatin came to be 1.7 g/m$^2$ and dried to prepare a back layer.

3. Image-Forming Layer, Intermediate Layer, and Surface Protective Layer 3-1. Preparation of Material for Coating 1) Preparation of Silver Halide Emulsion (Preparation of Silver Halide Emulsion)

To 1,420 ml of distilled water, 4.3 ml of a 1% by mass potassium iodide solution was added and, further, 3.5 ml of sulfuric acid having a concentration of 0.5 mol/L and 36.7 g of phthalated gelatin were added. While the resultant mixture was stirred, being maintained at 35° C., in a reaction vessel made of stainless steel, a total weight of both a solution A which had been prepared by adding distilled water to 22.22 g of silver nitrate to be 195.6 ml and a solution B which had been prepared by adding distilled water to 21.8 g of potassium iodide to be 219 ml was added to the foregoing mixture at a constant flow-rate consuming 9 minutes and, then, 10 ml of a 3.5% by mass aqueous solution of hydrogen peroxide and 10.8 ml of a 10% by mass aqueous solution of benzimidazole were added thereto to prepare a mixture. To the thus-prepared mixture, a solution C which had been prepared by adding distilled water to 51.86 g of silver nitrate to be 317.5 ml and a solution D which had been prepared by adding distilled water to 60 g of potassium iodide to be 600 ml were added such that a total weight of the solution C was added at a constant flow rate consuming 120 minutes and the solution D was added according to a controlled double jet method while keeping a pAg value at 8.1.

10 minutes after such additions of Solution C and Solution D were started, a total weight of potassium hexachloroiridate (III) was added to allow it to be $1\times10^{-4}$ mol, based on 1 mol of silver. Further, a total weight of $3\times10^{-4}$ mol of an aqueous potassium solution of hexacyanoiron (II), based on 1 mol of silver, was added 5 seconds after completion of addition of the solution C. When a pH of the resultant mixture was adjusted to be 3.8 using sulfuric acid having a concentration of 0.5 mol/L, a stirring operation was stopped to perform precipitation/desalting/washing steps. Then, the pH of the resultant mixture was adjusted to 5.9 using sodium hydroxide having a concentration of 1 mol/L, thereby preparing a silver halide dispersion having a pAg value of 8.0. Grains in the thus-prepared silver halide emulsion were pure silver iodide grains having an average sphere-equivalent diameter of 0.037 μm and a variation coefficient of a sphere-equivalent diameter is 17%. Grain size and the like were determined from an average of 1,000 grains by means of an electron microscope.

The silver halide dispersion was added, while it is stirred and maintained at 38° C., with 5 ml of a 0.34% by mass methanol solution of 1,2-benzoisothiazoline-3-one and, after 40 minutes elapsed, with $1.2\times10^{-3}$ mol as a total of Spectral Sensitizing Dye A and Sensitizing Dye B, based on 1 mol of silver, of a methanol solution of a 1:1 mixture in a molar ratio of Spectral Sensitizing Dye A and Sensitizing Dye B and, after one minute elapsed, heated to 47° C. 20 minutes after such heating, the resultant mixture was added with $7.6\times10^{-5}$ mol, based on 1 mol of silver, of a methanol solution of sodium benzene thiosulfonate. Then, a pAg of the resultant mixture was adjusted to be 5.5 and, after 5 minutes have elapsed, the resultant mixture was added with $5.1\times10^{-4}$ mol, based on 1 mol of silver, of a tellurium sensitizing agent (bis(N-phenyl-N-methyl carbamoyl) telluride) and, thereafter, ripened for 84 minutes. After the pAg of the resultant mixture was adjusted to be 7.5, the mixture was added with 1.3 ml of a 0.8% by mass methanol solution of N,N'-dihydroxy-N"-diethylmelamine and, further, after 4 minutes elapsed, added with $4.8\times10^{-3}$ mol, based on 1 mol of silver, of a methanol solution of 5-methyl-2-mercaptobenzimidazole and $5.4\times10^{-3}$ mol, based on 1 mol of silver, of a methanol solution of 1-phenyl-2-heptyl-5-mercapto-1,3,4-triazole to prepare a silver halide emulsion.

The thus-prepared emulsion was divided into small portions and added with compounds described in Table 1 to prepare silver halide emulsions 1 to 8. A comparative compound (Comparative Compound-1) and another comparative compound (Comparative Compound-2) which were used for comparisons are compounds as follows:

Comparative Compound-1

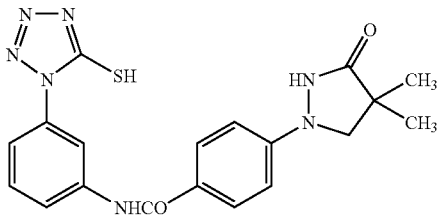

Comparative Compound-2

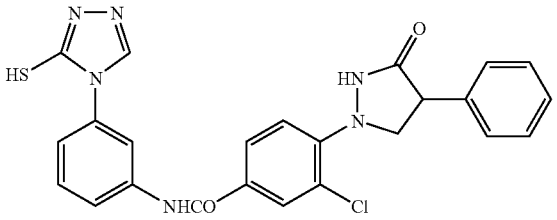

(Preparation of Diluted Emulsion for Coating Solution)

Each of the thus-prepared silver halide emulsions was dissolved and, then, added with $5\times10^{-3}$ mol, based on 1 mol of silver, of 1-(3-methylureido)phenyl-5-mercaptotetrazole. Further, the resultant mixture was added with water such that a silver halide content per 1 kg of a diluted emulsion for a coating solution came to be 38.2 g in terms of silver.

2) Preparation of Fatty Acid Silver Dispersion 87.6 kg of behenic acid (product name: Edenor C22-85R; manufactured by Henkel Co.), 423 L of distilled water, 49.2 L of an aqueous solution of NaOH having a concentration of 5 mol/L and 120 L of t-butyl alcohol were mixed and, then, allowed to react with one another, while being stirred at 75° C. for 1 hour, to obtain a sodium behenate solution. Separately from the sodium behenate solution, 206.2 L of an aqueous solution (pH: 4.0) containing 40.4 kg of silver nitrate was prepared and maintained at 10° C. A reaction vessel charged with 635 L of distilled water and 30 L of t-butyl alcohol was maintained at 30° C. and, then, while being sufficiently stirred, charged with a total weight of the foregoing sodium behenate solution and a total weight of the foregoing silver nitrate aqueous solution at a constant flow rate consuming 93 minutes 15 seconds and 90 minutes, respectively. At that time, the silver nitrate aqueous solution was solely added for 11 minutes after the addition of the silver nitrate aqueous solution was started. After that, the addition of the sodium behenate solution was started. For 14 minutes 15 seconds after the addition of the silver nitrate aqueous solution was completed, the sodium behenate solution was solely added. At that time, a temperature inside the reaction vessel was maintained at 30° C. and a solution temperature was maintained constant by means of an external temperature control. Further, piping of an addition system for the sodium behenate solution was warmed by circulating warm water in an outer part of a double-walled tube so that the solution temperature at an outlet of an addition nozzle tip was adjusted to be 75° C. Piping of an addition system of the aqueous silver nitrate solution was also heat-controlled by circulating cold water in an outer part of a double-walled tube. Positions where the sodium behenate solution and the aqueous silver nitrate solution were added were arranged symmetrically in relation to a stirring shaft in the center, and respective heights of the positions were adjusted such that they did not contact with a reaction solution.

After the addition of the sodium behenate solution was completed, the resultant reaction solution was held at a temperature thereof as it was for 20 minutes with stirring and, then, the temperature was elevated up to 35° C. consuming 30 minutes. After that, the reaction solution was ripened for 210 minutes. Immediately after such ripening, the solid content was separated by centrifugal filtration and, then, the thus-separated solid content was rinsed with water until electrical conductivity of the filtrate reached 30 μS/cm. Thus, a fatty acid silver salt was obtained. A solid substance obtained in such a manner as described above was stored as a wet cake without drying.

Shapes of silver behenate grains thus obtained were evaluated by electron microscopic photography. The obtained silver behenate grains were flaky crystals having average values of a=0.14 μm, b=0.4 μm and c=0.6 μm, an average aspect ratio of 5.2, an average sphere-equivalent diameter of 0.52 μm, and a variation coefficient of a sphere-equivalent diameter of 15% (a, b and c are determined as defined above).

19.3 kg of polyvinyl alcohol (trade name: PVA-217; manufactured by Kuraray Co., Ltd.) and water were added to the wet cake corresponding to 260 kg of dried solid content to make a total weight of the resultant mixture to be 1,000 kg and, then, the resultant mixture was changed into a slurry by means of dissolver-blades. Further, the slurry was preliminarily dispersed with a pipeline-mixer (Model PM-10; manufactured by Mizuho Industrial Co., Ltd.)

Then, a starting dispersion thus preliminarily dispersed was processed three times using a dispersing machine (trade name: Microfluidizer M-610 equipped with a Z-type interaction chamber; manufactured by Microfluidex International Corporation) under a pressure adjusted to 1,260 kg/cm$^2$ to obtain a silver behenate dispersion. A dispersion temperature was set at 18° C. by adjusting a temperature of coolant such that a cooling operation was performed using coil type heat exchangers installed in front and rear of the interaction chamber, respectively.

3) Preparation of Reducing Agent Dispersion (a)

7.2 kg of water was added to 10 kg of Reducing Agent Complex-1 (1:1 complex of 2,2'-methylene-bis(4-ethyl-6-tert-butyl phenol) and triphenyl phosphine oxide), 0.12 kg of triphenyl phosphine oxide, and 16 kg of a 10% by mass aqueous solution of modified polyvinylalcohol (trade name: POVAL MP203; manufactured by Kuraray Co. Ltd.). Then, the resultant mixture was thoroughly mixed to form a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed therein for 4 hours 30 minutes. Then, 0.2 g of a sodium salt of benzoisothiazolinone and water were added to the resultant dispersion so as to make a concentration of the reducing agent complex to be 25% by mass, thereby obtaining a Reducing Agent Dispersion (a). Grains of the reducing agent complex contained in the reducing agent dispersion thus obtained had a median grain diameter of 0.46 μm and a maximum grain diameter of 1.6 μm or less. The thus-obtained reducing agent complex dispersion was filtrated with a filter made of polypropylene having a pore diameter of 3.0 μm to remove foreign matters such as dust and, then, stored.

4) Preparation of Polyhalogen Compound (Preparation of Organic Polyhalogen Compound Dispersion (a))

14 kg of water was added to 10 kg of Organic Polyhalogen Compound-1 (tribromomethane sulfonyl benzene), 10 kg of a 20% by mass aqueous solution of modified polyvinylalcohol (trade name: POVAL MP203; manufactured by Kuraray Co., Ltd.), and 0.4 kg of a 20% by mass aqueous solution of sodium triisopropylnaphthalene sulfonate. Then, the resultant mixture was thoroughly mixed to give a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed therein for 5 hours. Then, 0.2 g of a sodium salt of benzoisothiazolinone and water were added to the resulting dispersion so as to make a concentration of the organic polyhalogen compound to be 26% by mass, thereby obtaining Organic Polyhalogen Compound Dispersion (a). Grains of the organic polyhalogen compound contained in the organic polyhalogen compound dispersion thus obtained had a median grain diameter of 0.41 μm and a maximum grain diameter of 2.0 μm or less. The organic polyhalogen compound dispersion obtained was filtrated with a filter made of polypropylene having a pore diameter of 10.0 μm to remove foreign matters such as dust and, then, stored.

(Preparation of Organic Polyhalogen Compound Dispersion (b))

10 kg of Organic Polyhalogen Compound-2 (N-buryl-3-tribromomethane sulfonyl benzamide), 20 kg of a 10% by mass aqueous solution of modified polyvinylalcohol (trade name: POVAL MP203; manufactured by Kuraray Co., Ltd.), 0.4 kg of a 20% by mass aqueous solution of sodium triisopropylnaphthalene sulfonate, and 8 kg of water were thoroughly mixed to yield a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed therein for 5 hours. Then, 0.2 g of a sodium salt of benzoisothiazolinone and water were added to the produced dispersion so as to make a concentration of the organic polyhalogen compound to be 25% by mass. The resultant dispersion was heated at 40° C. for 5 hours to obtain Organic Polyhalogen Compound-3 Dispersion. Grains of the organic polyhalogen compound contained in the organic polyhalogen compound dispersion thus obtained had a median grain diameter of 0.36 μm and a maximum grain diameter of 1.5 μm or less. The organic polyhalogen compound dispersion thus obtained was filtrated with a filter made of polypropylene having a pore diameter of 3.0 μm to remove foreign matters such as dust and, then, stored.

6) Preparation of Phthalazine Compound-1 Solution 8 kg of modified polyvinylalcohol (trade name: MP203; manufactured by Kuraray Co., Ltd.) was dissolved in 174.57 kg of water. Then, 3.15 kg of a 20% by mass aqueous solution of sodium triisopropylnaphthalene sulfonate and 14.28 kg of a 70% by mass aqueous solution of Phthalazine Compound-1 (6-isopropylphthalazine) were added to the resultant solution to prepare a 5% by mass solution of Phthalazine Compound-1.

7) Preparation of Aqueous Solution of Mercapto Compound-1

7 g of Mercapto Compound-1 (1-(3-sulfophenyl)-5-mercaptotetrazole) was dissolved in 993 g of water to prepare a 0.7% by mass aqueous solution.

8) Preparation of Pigment-1 Dispersion 250 g of water was added to 64 g of C.I. Pigment Blue 60 and 6.4 g of DEMOL N (trade name; manufactured by Kao Corporation). Then, the resultant mixture was thoroughly mixed to form a slurry. 800 g of zirconia beads having an average diameter of 0.5 mm was prepared and charged in a vessel together with the slurry. The slurry was dispersed for 25 hours with a dispersing machine (trade name: ¼ G Sand-Grinder Mill; manufactured by Imex Co., Ltd.) and, then, taken out of the vessel and, thereafter, added with water to make a concentration of such pigment to be 5% by mass, thereby obtaining Pigment-1 Dispersion. Pigment grains contained in the pigment dispersion thus obtained had an average grain diameter of 0.21 μm.

9) Preparation of SBR Latex Liquid

An SBR latex at Tg=23° C. was prepared in a manner as described below.

70.5 parts by mass of styrene, 26.5 parts by mass of butadiene, and 3 parts by mass of acrylic acid were allowed to cause emulsion polymerization using ammonium persulfate as a polymerization initiator and an anionic surfactant as an emulsifying agent and, then, the resultant reaction product was subjected to aging at 80° C. for 8 hours. Thereafter, the reaction product was cooled to 40° C. and, then, a pH thereof was adjusted to 7.0. Further, the resultant mixture was added with SANDET BL (trade name; manufactured by Sanyo Chemical Industries, Ltd.) to give a concentration of 0.22%. A pH of the resultant mixture was adjusted to 8.3 using an aqueous 5% NaOH solution and, further, adjusted to 8.4 using an aqueous ammonia solution whereupon a molar ratio of $Na^+$ ion to $NH_4^+$ ion which was employed on this occasion was 1:2.3.

Still further, 0.15 ml of an aqueous 7% solution of a sodium salt of benzoisothiazolinone was added to the thus-pH-adjusted mixture, thereby preparing an SBR latex solution.

(SBR Latex: Latex of -St(70.5)-Bu(26.5)-AA(3))

Properties of the latex were as follows: an average grain diameter at Tg=23° C.: 0.1 μm; concentration: 43% by mass; equilibrium moisture content at 25° C. 60% RH: 0.6% by mass; ionic conductance: 4.2 mS/cm (as for ionic conductance, latex starting solution (43% by mass) was measured at 25° C. using a diagometer (trade name: CM-30S; manufactured by DKK-TOA Corporation); and pH: 8.4.

3-2. Preparation of Coating Solution

1) Preparation of Coating Solution for Image-Forming Layer 1,000 g of Fatty Acid Silver Salt Dispersion obtained in a manner as described above, 104 ml of water, 30 g of Pigment-1 Dispersion, 6.3 g of Organic Polyhalogen Compound (a) Dispersion, 20.7 g of Organic Polyhalogen Compound (b) Dispersion, 173 g of Phthalazine Compound-1 Solution, 1,082 g of SBR Latex (Tg: 23° C.) Solution, 258 g of Reducing Agent Dispersion (a), and 9 g of Mercapto Compound-1 Solution were added in this order such that a quantity of each of silver halide-mixed emulsions came to be 6.6% by mass, based on the mass of a silver salt of an organic acid, to prepare each of well-mixed coating solutions for the emulsion layers. Each of the thus-obtained coating solutions for emulsion layers was fed to a coating die as it was to be applied.

2) Preparation of Coating Solution for Intermediate Layer 2 ml of a 5% by mass aqueous solution of Aerosol OT (trade name; manufactured by American Cyanamid Company) and 10.5 ml of a 20% by mass aqueous solution of diammonium phthalate were added to 772 g of a 10% by mass aqueous solution of polyvinyl alcohol (trade name: PVA-205; manufactured by Kuraray Co., Ltd.), 5.3 g of Pigment-1 Dispersion, and 226 g of a 27.5% by mass solution of a latex of a methyl methacrylate/styrene/butyl acrylate/hydroxyethyl methacrylate/acrylic acid copolymer (copolymerization ratio by mass: 64/9/20/5/2) and, then, water was added to the resultant mixture to make the entire quantity thereof to be 880 g. A pH value of the thus-made mixture was adjusted to 7.5 using NaOH, thereby obtaining a coating solution for an intermediate layer. The coating solution was fed to a coating die such that a coating amount became 10 ml/$m^2$.

Viscosity of the coating solution measured by a B-type viscometer (No. 1 rotor at 60 rpm) was 65 [mPa·s] at 40° C.

3) Preparation of Coating Solution for Surface Protective First Layer 64 g of inert gelatin was dissolved in water. To the resultant gelatin solution were added 80 g of a 27.5% by mass solution of a latex of a methyl methacrylate/styrene/butyl acrylate/hydroxyethyl methacrylate/acrylic acid copolymer (copolymerization ratio by mass: 64/9/20/5/2), 23 ml of a 10% by mass methanol solution of phthalic acid, 23 ml of a 10% by mass aqueous solution of 4-methyl phthalic acid, 28 ml of sulfuric acid having a concentration of 0.5 mol/L, 5 ml of a 5% by mass aqueous solution of Aerosol OT (trade name; manufactured by American Cyanamid Company), 0.5 g of phenoxyethanol and 0.1 g of benzoisothiazolinone. Then, water was added to the resultant mixture to make the entire quantity thereof to be 750 g, thereby obtaining a coating solution. Immediately before coating, the coating solution was mixed with 26 ml of a 4% by mass chrome alum solution using a static mixer and, then, fed to a coating die such that a coating amount became 18.6 ml/$m^2$.

Viscosity of the coating solution measured by a B-type viscometer (No. 1 rotor at 60 rpm) was 20 [mPa·s] at 40° C.

4) Preparation of Coating Solution for Surface Protective Second Layer 80 g of inert gelatin was dissolved in water. To the resultant gelatin solution were added 102 g of a 27.5% by mass solution of a latex of a methyl methacrylate/styrene/butyl acrylate/hydroxyethyl methacrylate/acrylic acid copolymer (copolymerization ratio by mass: 64/9/20/5/2), 3.2 ml of a 5% by mass solution of a fluorine-type surfactant (F-1), 32 ml of a 2% by mass aqueous solution of a fluorine-type surfactant (F-2), 23 ml of a 5% by mass solution of Aerosol OT (trade name; manufactured by American Cyanamid Company), 4 g of polymethyl methacrylate fine grains (average grain diameter: 0.7 μm), 21 g of polymethyl methacrylate fine grains (average grain diameter: 4.5 μm), 1.6 g of 4-methyl phthalic acid, 4.8 g of phthalic acid, 44 ml of sulfuric acid having a concentration of 0.5 mol/L, and 10 mg of benzoisothiazolinone. Then, water was added to the resultant mixture to make the entire quantity thereof to be 650 g, thereby obtaining a mixture. Immediately before coating, the thus-obtained mixture was further added with 445 ml of an aqueous solution containing 4% by mass of chrome alum and 0.67% by mass of phthalic acid using a static mixer to obtain a coating solution for a second layer of a surface protective layer. The thus-obtained coating solution for the surface protective second layer was fed to a coating die such that a coating amount became 8.3 ml/$m^2$.

Viscosity of the coating solution measured by a B-type viscometer (No. 1 rotor at 60 rpm) was 19 [mPa·s] at 40° C.

3-3. Preparation of Photothermographic Material

On a surface opposite to a back surface, an image-forming layer, an intermediate layer, a surface protective first layer, and a surface protective second layer were coated in a simultaneously multi-layer manner employing a slide bead coating method in this order to prepare samples of photothermographic materials. Temperatures, at that time, of coating solutions were adjusted such that the coating solution for the image-forming layer and that for the intermediate layer were maintained at 35° C., that for the surface protective first layer was maintained at 36° C. and that for the surface protective second layer was maintained at 37° C.

Coated amount (g/m$^2$) of each compound in the image-forming layer is shown below.

| | |
|---|---|
| Silver salt of fatty acid | 6.19 |
| Pigment (C.I. Pigment Blue 60) | 0.036 |
| Polyhalogen Compound-1 | 0.04 |
| Polyhalogen Compound-2 | 0.12 |
| Phthalazine Compound-1 | 0.21 |
| SBR latex | 11.1 |
| Reducing Agent Complex-1 | 1.54 |
| Mercapto Compound-1 | 0.002 |
| Silver halide (in terms of silver) | 0.10 |

Coating and drying conditions are described below.

Coating was performed at a coating speed of 160 m/min. A distance between the tip of the coating die and the support was specified in the range of from 0.10 mm to 0.30 mm. Pressure inside a reduced pressure chamber was set lower than the atmospheric pressure by from 196 Pa to 882 Pa. The support was destaticized with ionized air before coating.

After the coating solution was chilled in a subsequent chilling zone with air having a dry bulb temperature of from 10° C. to 20° C., the coated support was conveyed to a helical non-contact-type drying apparatus in a non-contact manner and, then, dried therein with drying air having a dry bulb temperature of from 23° C. to 45° C. and a wet bulb temperature of from 15° C. to 21° C. to obtain coated samples 1 to 8.

After dried, the thus-obtained samples were conditioned in moisture contents at 25° C. from 40% to 60% RH and, then, heated such that a temperature of each of surfaces thereof reached 70° C. to 90° C. and, subsequently, cooled such that the temperature of the surface dropped to 25° C.

Matting degrees of the thus-prepared photothermographic material were 550 seconds on the side of the surface of the image-forming layer and 130 seconds on the side of the back surface in terms of Beck's smoothness. When the pH value of such film surface on the side of the image-forming layer was measured, it was 6.0.

Chemical structures of compounds which are employed in Example 1 according to the invention are described below.

Spectral Sensitizing Dye A

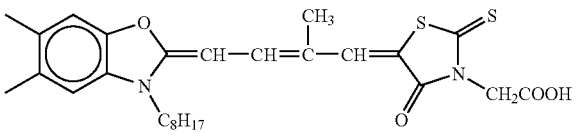

-continued

Spectral Sensitizing Dye B

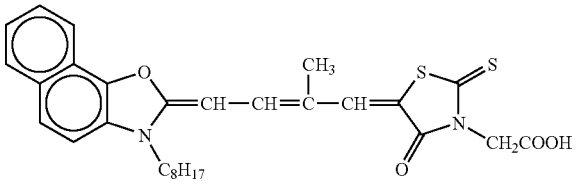

Tellurium Sensitizer C

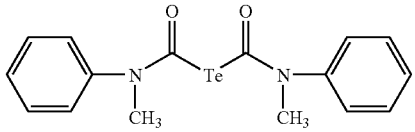

Reducing Sensitizing Agent C

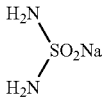

Base Precursor Compound-11

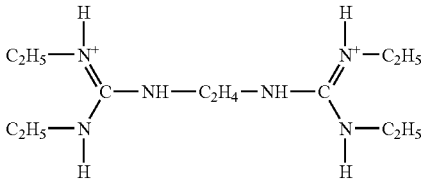

Cyanine Dye Compound-13

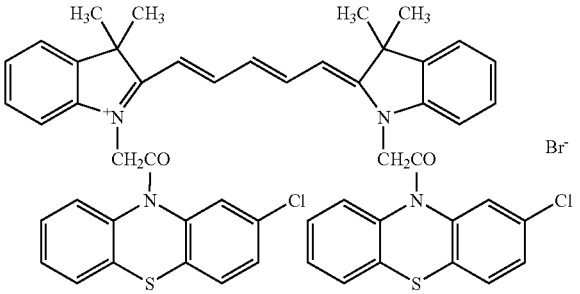

Blue Dye Compound-14

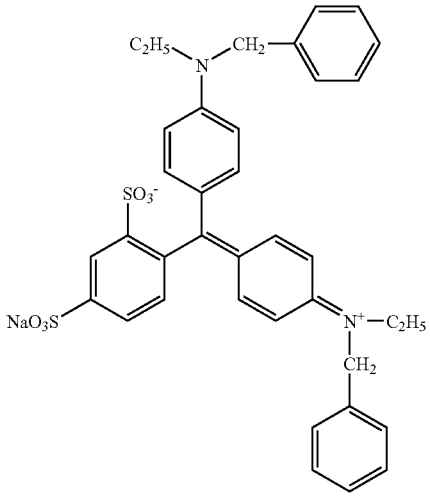

-continued

Yellow Dye Compound-15

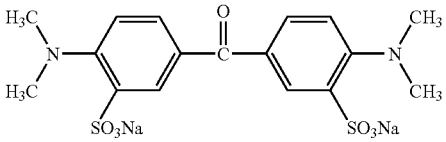

(F-1)

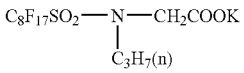

(F-2)

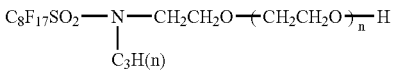

n = 15(av.)

(F-3)

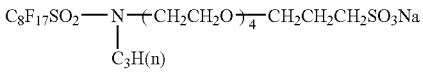

(F-4)

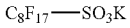

4. Evaluation of Photographic Performance (Preparation)

Each of the thus-obtained samples was cut into pieces of a half-size (20×12 inch sized sheets), packed with a packaging material described below at 25° C. 50% RH and, then, stored for 2 weeks at room temperature.

(Packaging Material)

The packaging material used was 50 μm thick polyethylene film containing 10 μm PET/12 μm PE/9 μm aluminum foil/15 μm Ny/50 μm polyethylene containing 3% by mass of carbon.

Oxygen transmittance was 0.02 ml/atm·m$^2$·25° C.·day; and moisture transmittance was 0.10 g/atm·m$^2$·25° C.·day.

The above-described photothermographic material was evaluated according to the following tests.

(Exposure of Photothermographic Material)

The photothermographic material was subjected to light exposure in a manner as described below.

A modified Fuji Medical Dry Laser Imager FM-DP L was employed for performing light exposure and developing treatment.

Photosensitive materials were irradiated with a 660 nm semiconductor laser having a maximum output of 60 mW (IIIB) in a manner of focusing in an area of 100 μm×100 μm. This light exposure was conducted by changing irradiation quantities of laser in steps. Development was conducted by means of a thermally developing section of the FM-DP L, while using four plates of panel heaters therein which had respectively been set at 112° C., 119° C., 121° C., and 121° C. whereupon the entire developing time was 24 seconds.

(Evaluation of Samples)

Density of the resultant image was measured using a Macbeth densitometer to prepare a characteristic curve of the density to a logarithm of exposed quantity.

Gamma that indicates gradation was measured by the method as described above utilizing the prepared characteristic curve. In regard to sensitivity, an optical density at an unexposed area was designated as fog (Dmin), while an optical density at an area which has been exposed at a maximum exposure quantity was designated as Dmax. Then, sensitivity was designated in terms of a reciprocal number of an exposure quantity necessary for obtaining an optical density of Dmin+2.0 and was shown as a relative value by taking the sensitivity of Sample No. 1 as 100 whereupon it shows that, as the relative value becomes larger, the sensitivity becomes higher.

TABLE 1

| | Compound represented by Formula (1) of Present Invention | | | | | |
|---|---|---|---|---|---|---|
| Sample No. | Compound No. | Addition Amount mol/mol of Ag | Dmin | Dmax | Relative Sensitivity | Remarks |
| 1 | — | — | 0.18 | 4.0 | 100 | Comparative Example |
| 2 | 1 | $3 \times 10^{-3}$ | 0.18 | 4.5 | 256 | Present Invention |
| 3 | 2 | $3 \times 10^{-3}$ | 0.18 | 4.4 | 234 | Present Invention |
| 4 | 6 | $3 \times 10^{-3}$ | 0.18 | 4.5 | 250 | Present Invention |
| 5 | 13 | $3 \times 10^{-3}$ | 0.18 | 4.4 | 225 | Present Invention |
| 6 | 18 | $3 \times 10^{-3}$ | 0.18 | 4.4 | 230 | Present Invention |
| 7 | 27 | $3 \times 10^{-3}$ | 0.18 | 4.3 | 219 | Present Invention |
| 8 | Comparative Compound-1 | $3 \times 10^{-3}$ | 0.18 | 4.3 | 186 | Comparative Example |
| 9 | Comparative Compound-2 | $3 \times 10^{-3}$ | 0.18 | 4.2 | 161 | Comparative Example |

As is apparent from the results summarized in Table 1, when Comparative Compound-1 having only one mercapto group or Comparative Compound-2 having only one mercapto group was added to the material, sensitivity was considerably enhanced; however, when the compound according to the invention was added to the material, an unexpectedly remarkable enhancement of sensitivity and an increase of Dmax were obtained.

Example 2

A silver iodide emulsion was prepared in the same manner as in the silver halide emulsion 1 in Example 1, except that $5.1\times10^{-4}$ mol/mol of Ag of selenium sensitizer (pentafluorophehyl-diphenyl phosphine selnide) was used in place of a tellurium sensitizer. Then, the thus-prepared silver iodide emulsion was divided into small portions which were, then, added with compounds as summarized in Table 2, respectively. Thereafter, from the resultant small portions, coating samples 11 to 15 were prepared in the same manner as in Example 1. Incidentally, Comparative Compound-2 was the same compound as in Example 1. Subsequently, the samples were subjected to the same treatments as in Example 1 to obtain the results summarized in Table 2. Further, relative sensitivity as shown therein is a value determined by taking the sensitivity of the sample 11 as 100.

TABLE 2

| Sample No. | Compound represented by Formula (1) of Present Invention: Compound No. | Addition Amount mol/mol of Ag | Dmin | Dmax | Relative Sensitivity | Remarks |
|---|---|---|---|---|---|---|
| 11 | — | — | 0.18 | 3.8 | 100 | Comparative Example |
| 12 | 1 | $3\times10^{-3}$ | 0.18 | 4.3 | 221 | Present Invention |
| 13 | 12 | $3\times10^{-3}$ | 0.18 | 4.3 | 224 | Present Invention |
| 14 | 18 | $3\times10^{-3}$ | 0.18 | 4.0 | 208 | Present Invention |
| 15 | 27 | $3\times10^{-3}$ | 0.18 | 4.1 | 210 | Present Invention |
| 16 | Comparative Compound-2 | $3\times10^{-3}$ | 0.18 | 4.0 | 148 | Comparative Example |

As is apparent from Table 2, also in the silver iodide emulsion sensitized by selenium, an unexpectedly remarkable enhancement of sensitivity and an increase of Dmax was obtained by adding the compound according to the invention, as compared to a case in which Comparative Compound-2 having only one mercapto group was added to the material.

Example 3

A silver iodide emulsion was prepared in the same manner as in the silver halide emulsion in Example 1, except that none of sensitizing dyes A and B, and selenium sensitizer were used, namely, being in a chemically unsensitized state. Then, the thus-prepared silver iodide emulsion was divided into small portions which were, then, added with compounds summarized in Table 3, respectively. Thereafter, from the resultant small portions, coating samples 21 to 28 were prepared in the same manner as in Example 1. Incidentally, Comparative Compounds-1 and -2 were the same compounds as in Example 1, respectively. Subsequently, the samples were subjected to the same treatments as in Example 1, except for using blue laser light having a wavelength of 405 nm to obtain the results summarized in Table 3. Note that the relative sensitivity shown therein is a value determined by taking the sensitivity of the sample 21 as 100.

TABLE 3

| Sample No. | Compound represented by Formula (1) of Present Invention: Compound No. | Addition Amount mol/mol of Ag | Dmin | Dmax | Relative Sensitivity | Remarks |
|---|---|---|---|---|---|---|
| 21 | — | — | 0.18 | 3.3 | 100 | Comparative Example |
| 22 | 1 | $8\times10^{-3}$ | 0.18 | 4.5 | 417 | Present Invention |
| 23 | 3 | $8\times10^{-3}$ | 0.18 | 4.5 | 362 | Present Invention |
| 24 | 6 | $8\times10^{-3}$ | 0.18 | 4.5 | 402 | Present Invention |
| 25 | 15 | $8\times10^{-3}$ | 0.18 | 4.4 | 382 | Present Invention |
| 26 | 24 | $8\times10^{-3}$ | 0.18 | 4.5 | 388 | Present Invention |
| 27 | 27 | $8\times10^{-3}$ | 0.18 | 4.4 | 360 | Present Invention |
| 28 | Comparative Compound-1 | $8\times10^{-3}$ | 0.18 | 4.2 | 275 | Comparative Example |
| 29 | Comparative Compound-2 | $8\times10^{-3}$ | 0.18 | 4.1 | 242 | Comparative Example |

As is apparent from the results summarized in Table 3, in case where a silver iodide emulsion that has been chemically unsensitized was used, when Comparative Compound-1 having only one mercapto group or Comparative Compound-2 having only one mercapto group was added to the material, sensitivity was considerably enhanced; however, when the compound according to the invention was added to the material, an unexpectedly remarkable enhancement of sensitivity and an increase of Dmax was obtained.

Example 4

A developing treatment was conducted in the same manner as in Example 3, except for changing a conveying speed in a thermally developing apparatus such that a thermally developing time becomes 14 seconds and, as a result, a favorable enhancement of sensitivity and an increase of Dmax were obtained when the compound according to the invention was used in the same manner as in Example 3.

Example 5

Image-formed samples which had been obtained by carrying out thermal development on the material samples No. 1 to 8, 11 to 15, and 21 to 28 according to the invention were exposed for 3 days under a fluorescent lamp having an illumination intensity of 1000 lux. As a result, no printout occurred at all on all of these samples. This reveals that all of these samples have high light-fastness due to usage of the silver iodide emulsion.

(1) An addition time of the solutions A and B was changed from 9 minutes to 3 minutes, and an addition time of the solutions C and D was changed from 120 minutes to 40 minutes;

(2) An addition amount of the aqueous potassium solution of hexacyanoiron (II) was changed from $3\times10^{-4}$ mol to $2\times10^{-3}$ mol, based on 1 mol of Ag;

(3) Neither the sensitizing dyes A nor B was added (no color sensitization was conducted); and (4) Tellurium sensitizer was not added (no chemical sensitization was conducted).

The thus-prepared silver halide emulsion was divided into small portions which were, then, added with compounds summarized in Table 4, respectively and, thereafter, treated in the same manner as in Example 1 to thereby obtain coating samples 31 to 40.

These coating samples were irradiated with blue semiconductor laser light having a wavelength of 405 nm in the same manner as in Example 3, thermally developed and subjected to a photographic performance test. The results are summarized in Table 4. As is apparent from the results shown in Table 4, even in the case of a chemically unsensitized silver iodide emulsion, when Comparative Compound-1 having only one mercapto group or Comparative Compound-2 having only one mercapto group was used, sensitivity was considerably enhanced; however, when the compound according to the invention was used, an unexpectedly remarkable enhancement of sensitivity was obtained.

TABLE 4

| Sample No. | Compound represented by Formula (1) of Present Invention: Compound No. | Addition Amount mol/mol of Ag | Dmin | Dmax | Relative Sensitivity | Remarks |
|---|---|---|---|---|---|---|
| 31 | — | — | 0.16 | 3.8 | 100 | Comparative Example |
| 32 | 1 | $4\times10^{-3}$ | 0.16 | 4.7 | 341 | Present Invention |
| 33 | 1 | $8\times10^{-3}$ | 0.16 | 4.7 | 363 | Present Invention |
| 34 | 2 | $8\times10^{-3}$ | 0.16 | 4.7 | 302 | Present Invention |
| 35 | 5 | $8\times10^{-3}$ | 0.16 | 4.7 | 316 | Present Invention |
| 36 | 13 | $8\times10^{-3}$ | 0.16 | 4.6 | 308 | Present Invention |
| 37 | 15 | $8\times10^{-3}$ | 0.16 | 4.7 | 331 | Present Invention |
| 38 | 21 | $8\times10^{-3}$ | 0.16 | 4.7 | 310 | Present Invention |
| 39 | 27 | $8\times10^{-3}$ | 0.16 | 4.6 | 300 | Present Invention |
| 40 | Comparative Compound-1 | $8\times10^{-3}$ | 0.16 | 4.7 | 196 | Comparative Example |
| 41 | Comparative Compound-2 | $4\times10^{-3}$ | 0.16 | 4.5 | 178 | Comparative Example |

Example 6

A photosensitive silver halide emulsion (pure silver iodide; average grain size: 0.029 μm) was prepared in the same manner as in the silver halide emulsion in Example 1, except for the following changes:

Example 7

A sample was prepared in the same manner as in Example 1, except that Reducing Agent-2 and Hydrogen bond-forming Compound-2 each in a dispersion state as described below were used in place of Reducing Agent Complex-1 and, then, photographic performance thereof was evaluated in the same manner as in Example 1. As a result, the sample having a constitution according to the invention exhibited a favorable performance to the same extent as in Example 1.

(Preparation of Reducing Agent-2 Dispersion)

6 kg of water was added to 10 kg of Reducing Agent-2 and 20 kg of a 10% by mass aqueous solution of modified polyvinylalcohol (trade name: POVAL MP203; manufactured by Kuraray Co. Ltd.). Then, the resultant mixture was thoroughly mixed to give a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed therein for 3 hours 30 minutes. Then, 0.2 g of a sodium salt of benzoisothiazolinone and water were added to the resultant dispersion so as to make a concentration of the reducing agent to be 25% by mass, thereby obtaining Reducing Agent-5 Dispersion. Grains of the reducing agent contained in the reducing agent dispersion thus obtained had a median grain diameter of 0.38 μm and a maximum grain diameter of 1.5 μm or less. The thus-obtained reducing agent dispersion was filtrated with a filter made of polypropylene having a pore diameter of 3.0 μm to remove foreign matters such as dust and, then, stored.

(Preparation of Hydrogen Bond-Forming Compound-2 Dispersion)

10 kg of water was added to 10 kg of Hydrogen Bond-Forming Compound-2 and 20 kg of a 10% by mass aqueous solution of modified polyvinylalcohol (trade name: POVAL MP203; manufactured by Kuraray Co. Ltd.). Then, the resultant mixture was thoroughly mixed to yield a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed therein for 3 hours 30 minutes. Then, 0.2 g of a sodium salt of benzoisothiazolinone and water were added to the resultant dispersion so as to make a concentration of the reducing agent to be 22% by mass, thereby obtaining Hydrogen Bond-Forming Compound-2 Dispersion. Grains of the hydrogen bond-forming compound contained in the thus-obtained hydrogen bond-forming compound dispersion had a median grain diameter of 0.35 μm and a maximum grain diameter of 1.5 μm or less. The thus-obtained hydrogen bond-forming compound dispersion was filtrated with a filter made of polypropylene having a pore diameter of 3.0 μm to remove foreign matters such as dust and, then, stored.

Coated amount (g/m$^2$) of each compound in the image-forming layer is shown below.

| | |
|---|---|
| Silver salt of fatty acid | 6.0 |
| Reducing Agent-2 | 0.76 |
| Hydrogen Bond-Forming Compound-2 | 0.59 |
| Pigment (C.I. Pigment Blue 60) | 0.032 |
| Polyhalogen Compound-1 | 0.04 |
| Polyhalogen Compound-2 | 0.12 |
| Phthalazine Compound-1 | 0.21 |
| SBR latex | 11.1 |
| Mercapto Compound-1 | 0.002 |
| Silver halide (in terms of silver) | 0.09 |

Example 8

A sample was prepared in the same manner as in Example 7, except that the compound, that is, Reducing Agent-3 (similarly prepared in a dispersion state and, then, added) was used in place of Reducing Agent-2 and, further, a dispersion of Development acceleratore-1 as described below was added such that a quantity of the development accelerator came to be 0.01 g/m$^2$.

A developing treatment was conducted in the same manner as in Example 7, except for changing a conveying speed in a thermally developing apparatus such that a thermally developing time became 14 seconds. As a result, the sample having a constitution according to the invention showed favorable results to the same extent as in Example 7.

(Preparation of Development Accelerator-1 Dispersion)

10 kg of water was added to 10 kg of Development Accelerator-1 and 20 kg of a 10% by mass aqueous solution of modified polyvinylalcohol (trade name: POVAL MP203; manufactured by Kuraray Co. Ltd.). Then, the resultant mixture was thoroughly mixed to afford a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed therein for 3 hours 30 minutes. Then, 0.2 g of a sodium salt of benzoisothiazolinone and water were added to the resultant dispersion so as to make a concentration of the reducing agent to be 20% by mass, thereby obtaining Development Accelerator-1 Dispersion.

Grains of the thus-obtained Development Accelerator-1 had a median grain diameter of 0.48 μm and a maximum grain diameter of 1.4 μm or less. The thus-obtained dispersion was filtrated with a filter made of polypropylene having a pore diameter of 3.0 μm to remove foreign matters such as dust and, then, stored.

Reducing Agent-2

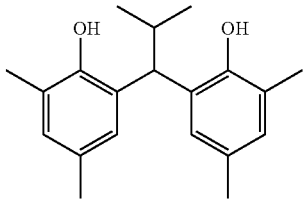

Reducing Agent-3

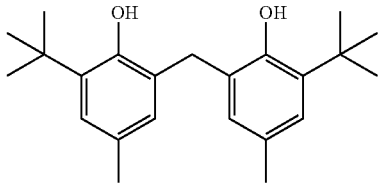

Development Accelerator-1

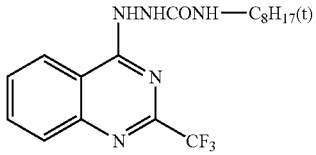

-continued

Hydrogen Bond-Forming Compound-2

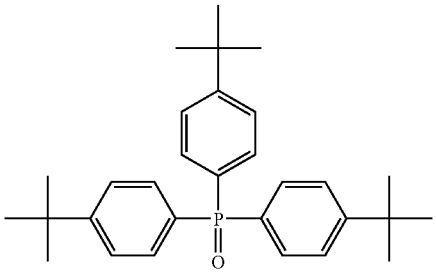

Example 9

In Example 3, the samples were each subjected to a developing treatment after being stored for two weeks at 50° C. 60% RH. The results are summarized in Table 5. It is revealed that the samples in which pyrazolidone group had been protected with a protective group were particularly excellent in storability.

TABLE 5

| Sample No. | Compound represented by Formula (1) of Present Invention: Compound No. | Addition Amount mol/mol of Ag | Dmin | Dmax | Relative Sensitivity | Remarks |
|---|---|---|---|---|---|---|
| 51 | — | — | 0.18 | 4.0 | 100 | Comparative Example |
| 52 | (1) | $8 \times 10^{-3}$ | 0.18 | 4.2 | 225 | Present Invention |
| 53 | (2) | $8 \times 10^{-3}$ | 0.18 | 4.3 | 225 | Present Invention |
| 54 | (27) | $8 \times 10^{-3}$ | 0.18 | 4.5 | 250 | Present Invention |
| 55 | (29) | $8 \times 10^{-3}$ | 0.18 | 4.5 | 240 | Present Invention |

As detailed above, the present invention can provide a photothermographic material that has high light-fastness, high sensitivity, low Dmin and high Dmax.

What is claimed is:

1. A photothermographic materiai comprising a support having disposed thereon an image-forming layer that contains at least a non-photosensitive organic silver salt, a photosensitive silver halide, a reducing agent for an organic silver salt and a binder, and the material further comprising a compound represented by the following formula (I):

A-(W)n-P (I)

wherein A represents an atomic group having at least two mercapto groups as the substituent; W represents a divalent linking group; n represents 0 or 1; and P represents a pyrazolidone group.

2. The photothermographic material according to claim 1, wherein the atomic group is a group selected from the group consisting of an alkyl group, an aryl group and a heterocyclic group.

3. The photothermographic material according to claim 1, wherein the atomic group is a heterocyclic group.

4. The photothermographic material according to claim 1, wherein the atomic group is an aromatic nitrogen-containing heterocyclic group.

5. The photothermographic material according to claim 2, wherein the atomic group is an aromatic nitrogen-containing heterocyclic group.

6. The photorhermographic material according to claim 1, wherein the pyrazolidone group is a group obtained by removing a hydrogen atom from a compound represented by the following formula (P-2):

Formula (P-2)

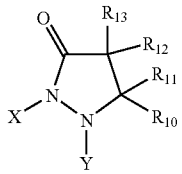

wherein Y represents a hydrogen atom, an alkyl group, an aryl group or a heterocyclic group; X represents a hydrogen atom, an alkyl group, an acyl group, a carbamoyl group, an alkoxycarbonyl group, an alkylsulfonyl group or an arylsulfonyl group; $R_{10}$, $R_{11}$, $R_{12}$ and $R_{13}$ each represent a hydrogen atom or a stibstituent; and wherein at least one of Y, X, $R_{10}$, $R_{11}$, $R_{12}$ and $R_{13}$ is a hydrogen atom.

7. The photothermographic material according to claim 2, wherein the pyrazolidone group is a group obtained by removing a hydrogen atom from a compound represented by the following formula (P-2):

Formula (P-2)

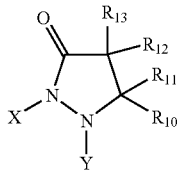

wherein Y reprcscnts a hydrogen atom, an alkyl group, an aryl group or a heterocyclic group; X represents a hydrogen atom, an alkyl group, an acyl group, a carbamoyl group, an alkoxycarbonyl group, an alkylsulfonyl group or an arylsulfonyl group; $R_{10}$, $R_{11}$, $R_{12}$ and $R_{13}$ each represent a hydrogen atom or a substituent; and wherein at least one of Y, X, $R_{10}$, $R_{11}$, $R_{12}$ and $R_{13}$ is a hydrogen atom.

8. The photothermographic material according to claim 1, wherein the pyrazolidone group is a 1-phenyl-3-pyrazolidone group.

9. The photothermographic material according to claim 2, wherein the pyrazolidone group is a 1-phenyl-3-pyrazolidone group.

10. The photothermographic material according to claim 1, wherein the photosensitive silver halide has a silver iodide content ranging from 40% by inol to 100% by mol.

11. The photothermographic matcrial according to claim 2, wherein the photosensitive silver halide has a silver iodide content ranging from 40% by mol to 100% by mol.

12. The photothermographic material according to claim 1, wherein the compound represented by formula (I) is added in an amount ranging from $1\times10^{-6}$ mol, per mol of the photosensitive silver halide.

13. The photothermographic material according to claim 2, wherein the compound represented by formula (I) is added in an amount ranging from $1\times10^{-6}$ mol to 1 mol, per mol of the photosensitive silver halide.

14. The photothermographic material according to claim 1, wherein the reducing agent is a hindered phenol reducing agent or a bisphenol reducing agent.

15. The photothermographic material according to claim 2, wherein the reducing agent is a hindered phenol reducing agent or a bisphenol reducing agent.

16. The photothermographic material according to claim 1, further comprising a hydrogen bond-forming compound represented by the following formula (D):

Formula (D)

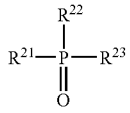

wherein $R^{21}$, $R^{22}$, and $R^{23}$ each independently represent an optionally substituted alkyl, aryl, alkoxy, aryloxy, amino, or heterocyclic group.

17. The photothermographic material according to claim 2, further comprising a hydrogen bond-forming compound represented by the following formula (D):

Formula (D)

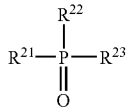

wherein $R^{21}$, $R^{22}$, and $R^{23}$ each independently represent an optionally substituted alkyl, aryl, alkoxy, aryloxy, amino, or heterocyclic group.

* * * * *